US008787610B2

(12) United States Patent
Stevinson

(10) Patent No.: US 8,787,610 B2
(45) Date of Patent: Jul. 22, 2014

(54) ERGONOMIC SYSTEM FOR COMPACT WINDING AND STORAGE OF EARPHONE SET/HEADPHONES USED WITH DIGITAL MEDIA DEVICES

(76) Inventor: Dean Stevinson, Centennial, CO (US)

( * ) Notice: Subject to any disclaimer, the term of this patent is extended or adjusted under 35 U.S.C. 154(b) by 74 days.

(21) Appl. No.: 13/336,918

(22) Filed: Dec. 23, 2011

(65) Prior Publication Data

US 2012/0128193 A1 May 24, 2012

Related U.S. Application Data

(63) Continuation-in-part of application No. 13/167,662, filed on Jun. 23, 2011.

(60) Provisional application No. 61/357,921, filed on Jun. 23, 2010.

(51) Int. Cl.
*H04R 25/00* (2006.01)

(52) U.S. Cl.
USPC ..... 381/384

(58) Field of Classification Search
USPC ..... 381/384; D14/200–250
See application file for complete search history.

(56) References Cited

U.S. PATENT DOCUMENTS

| | | | | |
|---|---|---|---|---|
| 363,495 | A | 5/1887 | Wilson | |
| 1,426,537 | A | 8/1922 | Bauer | |
| 2,287,368 | A | 6/1941 | Anderson | |
| D136,783 | S | 12/1943 | Veck | |
| 2,396,906 | A | 3/1946 | Windson | |
| 2,981,990 | A | 9/1957 | Balderee | |
| 3,161,723 | A | 12/1964 | Flower et al. | |
| D209,330 | S | 11/1967 | Coderre et al. | |
| 3,353,232 | A | 11/1967 | Brownson | |
| 3,465,391 | A | 9/1969 | Armstrong | |
| D221,511 | S | 8/1971 | Dufault | |
| 3,736,925 | A | 6/1973 | Erman | |
| 3,785,080 | A | 1/1974 | Wallace | |
| 4,270,247 | A | 6/1981 | Freedom | |
| D284,299 | S | 6/1986 | Auerbach et al. | |
| 4,680,886 | A | 7/1987 | Caselli | |
| D347,989 | S | 6/1994 | DeWard | |
| 5,383,091 | A * | 1/1995 | Snell | 361/679.01 |
| 5,867,355 | A * | 2/1999 | Arai et al. | 360/137 |

(Continued)

OTHER PUBLICATIONS

U.S. Appl. No. 29/409,525 Notice of Allowance mailed Jan. 9, 2013, 8 pages.

(Continued)

*Primary Examiner* — Brian Ensey
*Assistant Examiner* — Norman Yu
(74) *Attorney, Agent, or Firm* — Lathrop & Gage LLP

(57) ABSTRACT

A case stores an earphone set proximate to a digital media device (DMD). The case includes a storage compartment for storing the earphone set proximate a rear side of the DMD. The earphone set may be wound onto a retaining clip that is formed to receive ear-pieces of the earphone set and has a pair of notches, disposed on opposite edges of the clip, about which the two wires are wound. A distance between inner segments of the notches is a function of the length of the wires such that an inline control panel and a junction splitter of the earphone set are positioned within a periphery of the retaining clip. The earpieces and a jack plug of the earphone set may be retained by the clip to facilitate retention of the cable and wires.

21 Claims, 73 Drawing Sheets

(56) References Cited

U.S. PATENT DOCUMENTS

| | | | | |
|---|---|---|---|---|
| 5,984,224 | A | 11/1999 | Yang | |
| 6,006,915 | A | 12/1999 | Moor | |
| 6,254,114 | B1 * | 7/2001 | Pulling et al. | 280/93.511 |
| 6,370,401 | B1 | 4/2002 | Baranowski et al. | |
| 6,542,757 | B2 * | 4/2003 | Bae | 455/575.2 |
| 6,601,808 | B1 | 8/2003 | Nagel | |
| D485,834 | S | 1/2004 | Davetas | |
| D488,460 | S | 4/2004 | Alwicker et al. | |
| 6,847,724 | B1 | 1/2005 | Weng et al. | |
| 6,928,704 | B2 | 8/2005 | Johnson | |
| D514,923 | S | 2/2006 | Brown | |
| 7,086,512 | B2 | 8/2006 | Shack et al. | |
| D529,288 | S | 10/2006 | Ham | |
| D556,020 | S | 11/2007 | Whitney | |
| D576,785 | S | 9/2008 | TerMeer | |
| D576,867 | S | 9/2008 | Kretz | |
| 7,492,917 | B2 | 2/2009 | Ito | |
| 7,500,644 | B2 | 3/2009 | Naudet et al. | |
| D600,673 | S | 9/2009 | Kim et al. | |
| D601,879 | S | 10/2009 | Kim et al. | |
| D603,376 | S | 11/2009 | Blasko | |
| D604,501 | S | 11/2009 | Lee | |
| D620,781 | S | 8/2010 | Weckworth | |
| 7,801,322 | B2 | 9/2010 | Chiu | |
| D634,115 | S | 3/2011 | Long et al. | |
| 8,345,913 | B2 | 1/2013 | Pang et al. | |
| 2001/0035242 | A1 | 11/2001 | Hughs et al. | |
| 2002/0079244 | A1 | 6/2002 | Kwong | |
| 2005/0150796 | A1 * | 7/2005 | Wong et al. | 206/320 |
| 2007/0154048 | A1 * | 7/2007 | Chang | 381/371 |
| 2008/0053851 | A1 * | 3/2008 | Ko et al. | 206/320 |
| 2009/0242364 | A1 | 10/2009 | Prest et al. | |
| 2010/0096284 | A1 | 4/2010 | Bau | |
| 2011/0077061 | A1 | 3/2011 | Danze et al. | |
| 2011/0203954 | A1 * | 8/2011 | Kroupa | 206/320 |

OTHER PUBLICATIONS

U.S. Appl. No. 29/409,547 Non-Final Office Action mailed Jan. 8, 2013, 7 pages.

U.S. Appl. No. 29/409,547 Response to Office Action filed Apr. 8, 2013, 9 pages.

U.S. Appl. No. 29/409,520 Notice of Allowance Oct. 3, 2012, 8 pages.

PCT/US11/67263 Search Report and Written Opinion mailed Jul. 11, 2012, 13 pages.

U.S. Appl. No. 29/409,520 Notice of Allowance mailed Oct. 3, 2012, 8 pages.

U.S. Appl. No. 29/409,528 Notice of Allowance mailed Sep. 26, 2012, 8 pages.

U.S. Appl. No. 29/409,525 Ex Parte Quayle Action mailed Sep. 26, 2012, 6 pages.

U.S. Appl. No. 29/409,521 Notice of Allowance mailed Sep. 26, 2012, 8 pages.

* cited by examiner

ERGONOMIC SYSTEM FOR COMPACT WINDING AND STORAGE OF EARPHONE SET/HEADPHONES USED WITH DIGITAL MEDIA DEVICES

RELATED APPLICATIONS

This application is a continuation-in-part of U.S. patent application Ser. No. 13/167,662, filed Jun. 23, 2011, which claims priority to U.S. Patent Application Ser. No. 61/357,921, titled "Protective Holder for Digital Media Device and Auxiliary Devices", filed Jun. 23, 2010, and incorporated herein by reference.

FIELD OF THE INVENTION

This application relates to storage for an earphone set used with a portable digital media device.

BACKGROUND OF THE INVENTION

Hand held digital media devices (DMDs) come in many forms, such as: cellular phones, digital music players, digital video players, AM/FM radios, and so on. Most DMDs are small enough to fit in a pocket, a purse or a briefcase, and many require the user to wear an earphone set or a headset (or similar listening device) for optimal enjoyment. However, these earphone sets (or other listening devices) easily become tangled, damaged, or are lost when transported unprotected, such as when wound around a DMD or carried loose in a pocket or bag. When included, a carrying case supplied with an earphone set is typically either a bulky hard structure or a cloth bag. Bulky earphone storage cases and cloth storage bags are additional items that a user must keep track of. Although cloth bags are not bulky, they do nothing to neatly store and organize the earphone set. As a result, earphone sets/headsets are usually stored separate from the DMD and are thus easily lost, or are wrapped around the DMD and exposed to damage, and further inhibit use of the DMD.

SUMMARY

In one embodiment, a retaining clip securely captures and stores an earphone set. The earphone set comprising two ear-pieces, a length of cable divided into two wires at a junction splitter. Each of the wires couples to a different one of the earpieces and one of the wires has an inline control panel coupled thereto. An undivided end of the cable couples to a jack plug. The retaining clip includes a plate shaped and sized to securely capture the earphone set. The plate includes a first cutout sized to receive the two ear-pieces and a first pair of notches, disposed on opposite edges of the plate, about which the two wires are wound. The distance between inner segments of the notches is a function of the length of the wires such that the inline control panel and the junction splitter are positioned within a periphery of the retaining clip when the two wires are completely wound around the plate in a winding path between the notches. The jack plug is retained within the periphery by the wires and the cable when the wires and the cable are wound around the plate.

In another embodiment, a case stores an earphone set proximate to a digital media device (DMD). The case includes a top component that forms a storage compartment for storing the earphone set, and a coupling mechanism for attaching the top component to the DMD such that the storage compartment is proximate a rear side of the DMD.

In another embodiment, a case stores an earphone set proximate to a digital media device (DMD). The case includes a protective DMD case that couples with the DMD, a storage compartment formed from stretchable material with an opening for accessing the storage compartment, and a retention clip for holding the earphone set in the storage compartment. The storage compartment is coupled to the protective DMD case, and the stretchable pocket conforms to a contour of the retention clip and the earphone set held thereby. The retention clip is removable from the storage compartment through the opening.

In another embodiment, a retractable earphone storage case stores an earphone set proximate to a digital media device (DMD). The case includes a DMD protective case, a storage compartment with at least one opening positioned on a rear of the DMD protective case, and a retractable mechanism positioned within the storage compartment for storing the earphone set such that the earphone set may be withdrawn from the case.

DETAILED DESCRIPTION

Figure 1:
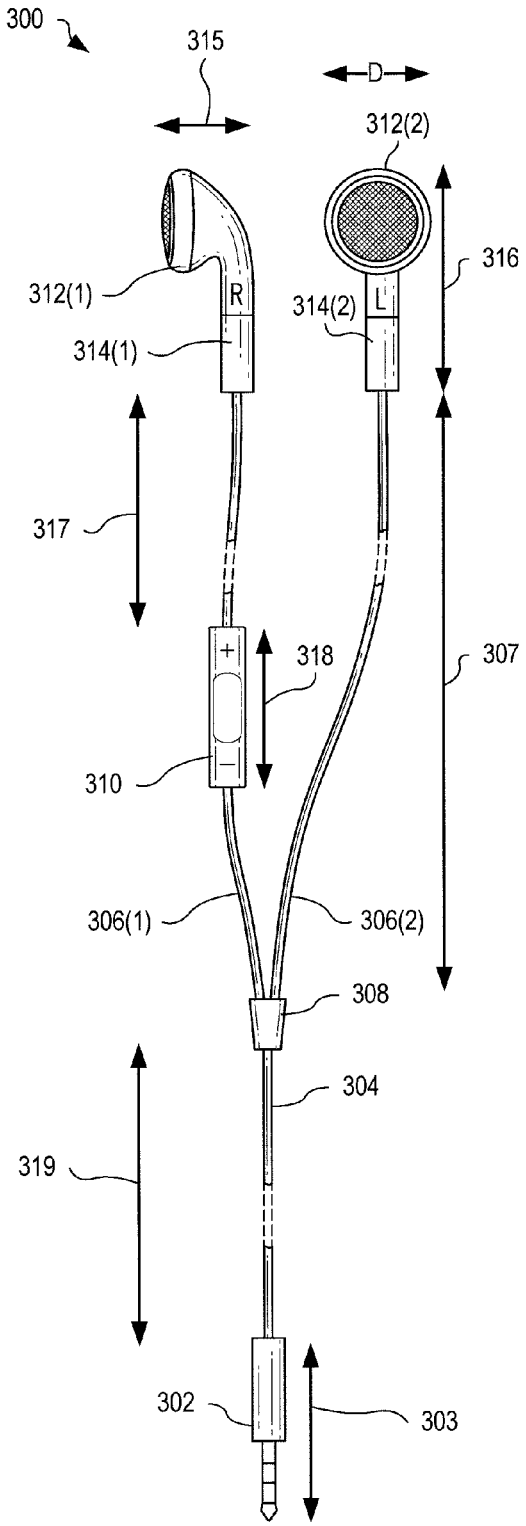
FIG. 1 PRIOR ART
FIG. 1 shows first exemplary prior art earphone set with ear-bud style earpieces.

The present disclosure may be understood by reference to the following detailed description considered in conjunction with the drawings. Note that, for purposes of illustrative clarity, certain elements in the drawings are not drawn to scale. Reference numbers for items that appear multiple times may be omitted for clarity. Where possible, the same reference numbers are used throughout the drawings and the following description to refer to the same or similar parts.

In the following embodiments, reference is made to a digital media device (DMD) that may be selected from the group including a digital media player (e.g., an iPod™ or iTouch™), a mobile phone (e.g., an iPhone™), a tablet computer (e.g., an iPad™), a notebook computer, a laptop computer, a personal DVD player, an MP3 player, a cell phone, a hand-held recording device and a personal digital assistant (PDA).

FIGS. 1 through 4 show exemplary earphone sets and their characteristics. These earphone sets are used to illustrate use of retaining clips and storages cases in certain embodiments described herein. Although a particular earphone may be used to describe a certain feature, features of other earphone sets may also apply. That is, within the described embodiments, earphone sets may be interchangeable without departing from the scope hereof.

FIG. 1 shows a first exemplary prior art earphone set 300 with a jack plug 302 coupled with a cable 304 that splits into wires 306(1) and 306(2) at a junction splitter 308, a remote control and microphone 310 positioned inline with wire 306(1), and two ear-bud style earpieces 312(1) and 312(2), each having a stem 314(1) and 314(2) that couples to wires 306(1) and 306(2), respectively. Earpieces 312 have a diameter D that allows their use within a human ear. Earpieces 312 have a depth 315 and a length 316. Remote control and microphone 310 has a length 318 and is positioned a distance 317 from stem 314(1) along wire 306(1), which has an overall length 307. Cable 304 has a length 319 from junction splitter 308 to jack plug 302, which has a length 303. Jack plug 302, junction splitter 308, remote control and microphone 310, and earpieces 312 are substantially rigid. Earphone set 300 may represent prior art ear-bud style earphone sets sold by Apple™, for example.

Figure 2:
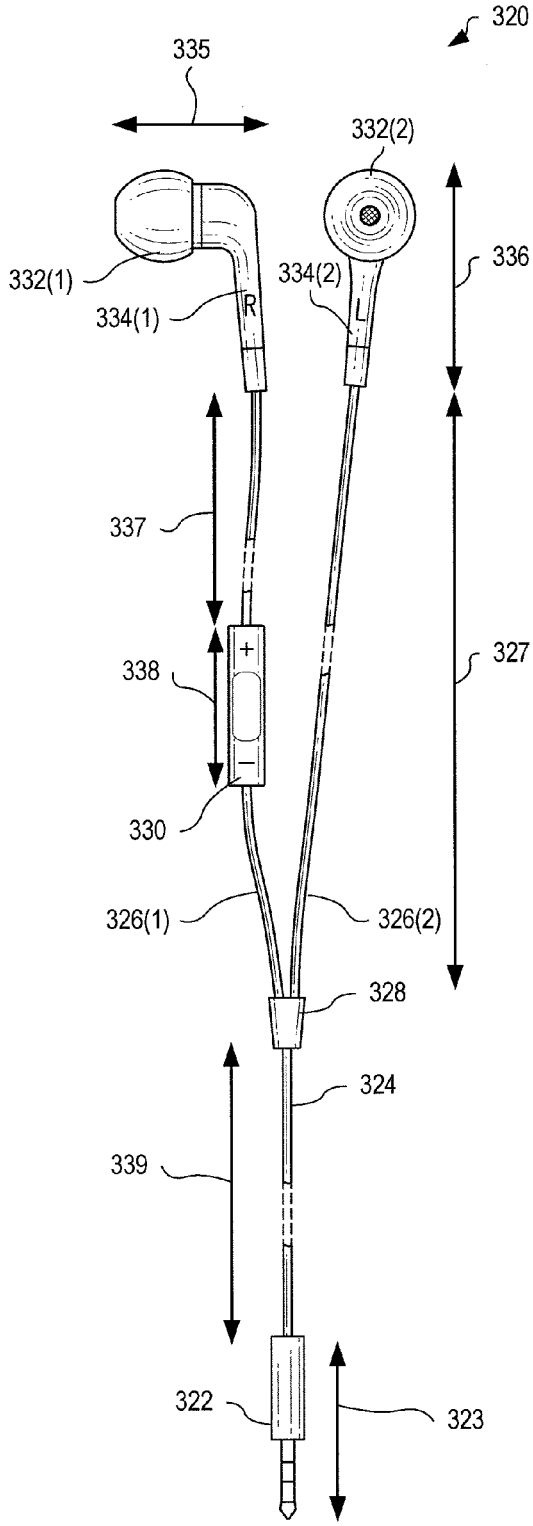
FIG. 2 PRIOR ART
FIG. 2 shows second exemplary prior art earphone set with in-ear style earpieces.

FIG. 2 shows second exemplary prior art earphone set 320 of an in-ear style that include a jack plug 322 coupled with a cable 324 that splits into wires 326(1) and 326(2) at a junction splitter 328, a remote control and microphone 330 positioned inline with wire 326(1), and two in-ear style earpieces 332(1) and 332(2), each having a stem 334(1) and 334(2) that couples to wires 326(1) and 326(2), respectively. Dimension of earphone set 320 may be similar to those of earphone set 300, except that depth 335 may be larger than depth 315 due to the in-ear styling. Earpieces 332 have a depth 335 and a length 336. Remote control and microphone 330 has a length 338 and is positioned a distance 337 from stem 334(1) along wire 326(1), which has an overall length 327. Cable 324 has a length 339 from junction splitter 328 to jack plug 322, which has a length 323. Jack plug 322, junction splitter 328, remote control and microphone 330, and earpieces 332 are substantially rigid. Earphone set 320 may represent in-ear style prior art earphone devices sold by Apple™, for example.

Figure 3:
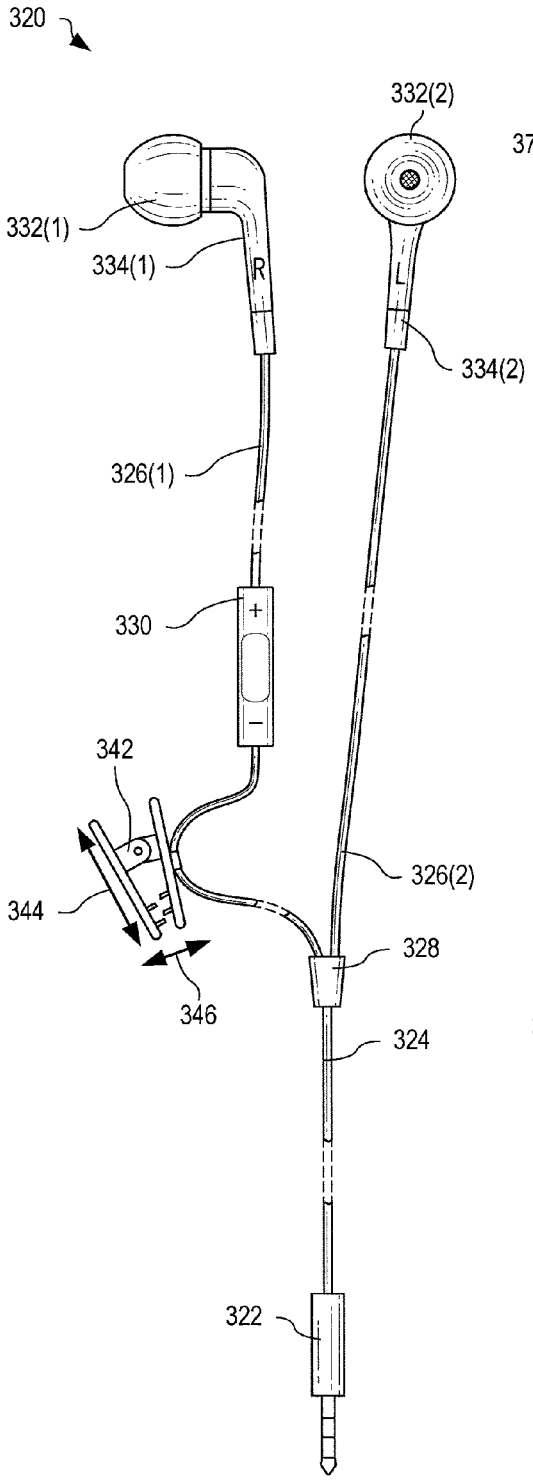
FIG. 3 PRIOR ART
FIG. 3 shows the earphone set of FIG. 2 with a prior art lapel clip.

FIG. 3 shows earphone set 320 of FIG. 2 with an additional prior art lapel clip 342 positioned on wire 306(1) below remote control and microphone 330. Lapel clip 342 forms another rigid structure of earphone set 320 with a width 346 and length 344.

Figure 4:
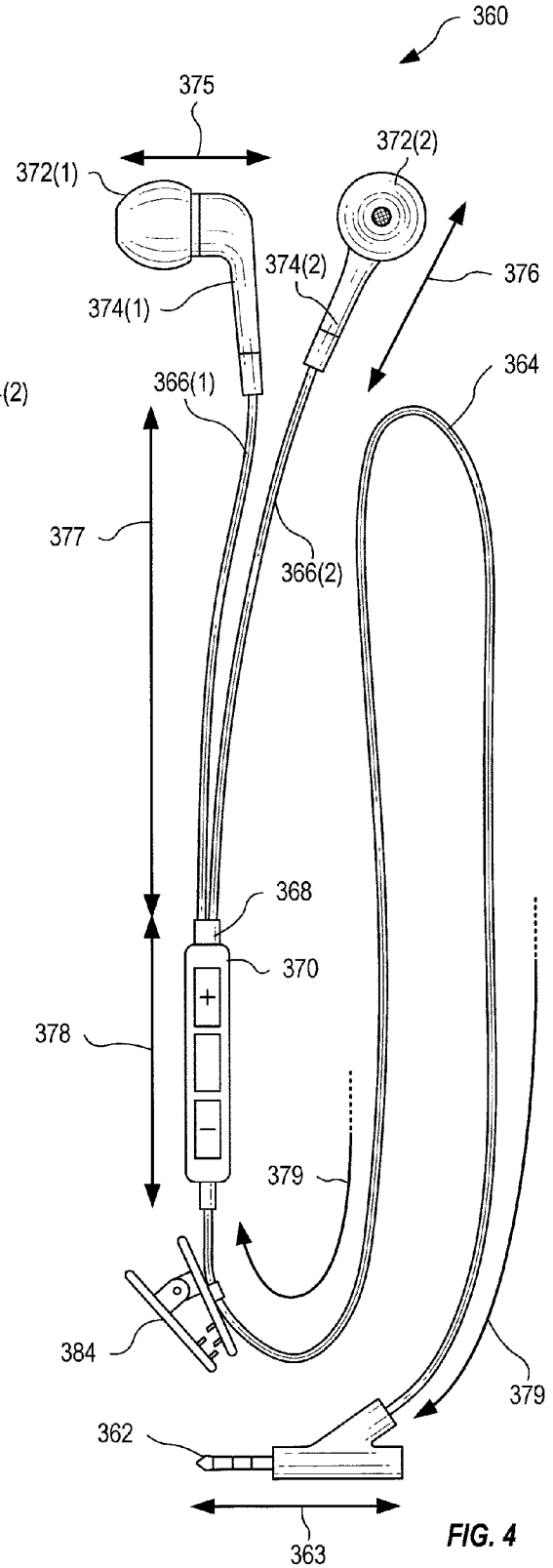
FIG. 4 PRIOR ART
FIG. 4 shows fourth exemplary prior art earphone set with in-ear style earpieces, a combined remote control and microphone and junction splitter, and a lapel clip.

FIG. 4 shows fourth exemplary earphone set 360 with a jack plug 362 coupled with a cable 364 that splits into wires 366(1) and 366(2) at a junction splitter 368 that is combined with a remote control and microphone 370 positioned inline with cable 364, a lapel clip 384 and two in-ear style earpieces 372(1) and 372(2), each having a stem 374(1) and 374(2) that couples to wires 366(1) and 366(2), respectively. Earpieces 372 have a depth 375 and a length 376. Remote control and microphone 370 has a length 378. Wires 366 each have a length 377. Cable 364 has a length 379 from remote control and microphone 370 to jack plug 362, which has a length 363. Jack plug 362, junction splitter 368, remote control and microphone 370, and earpieces 372 are substantially rigid. Earphone set 360 may represent prior art in-ear style earphone devices sold by V-Moda™, for example.

It should be noted that size and position of rigid components vary for earphone sets from different manufacturers, and for different models from the same manufacturer. Safe storage of earphone sets 300, 320, and 360 thus requires either a dedicated retaining clip or a versatile clip that allows positioning of rigid components for optimal compactness, or for optimal fit to an ergonomically styled case, as described in detail below.

Figure 5:
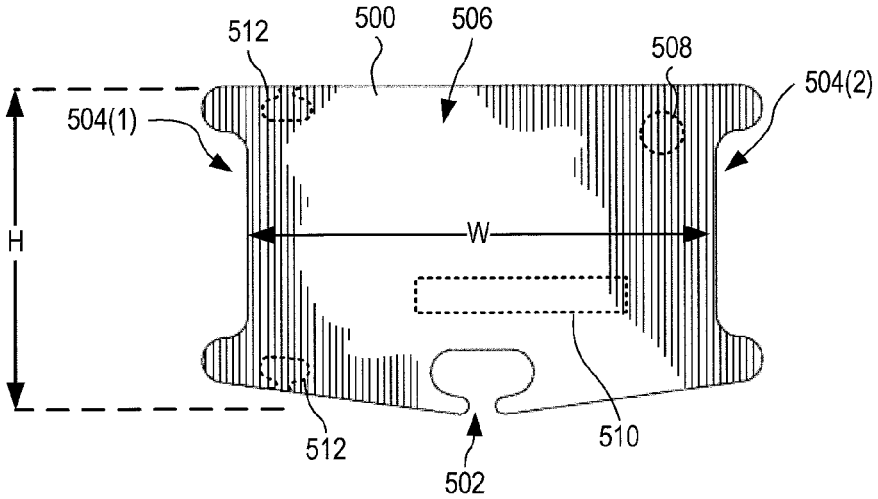
FIG. 5 shows one exemplary earphone retaining clip with winding notches and an earpiece alignment notch, in an embodiment.
Figure 6:
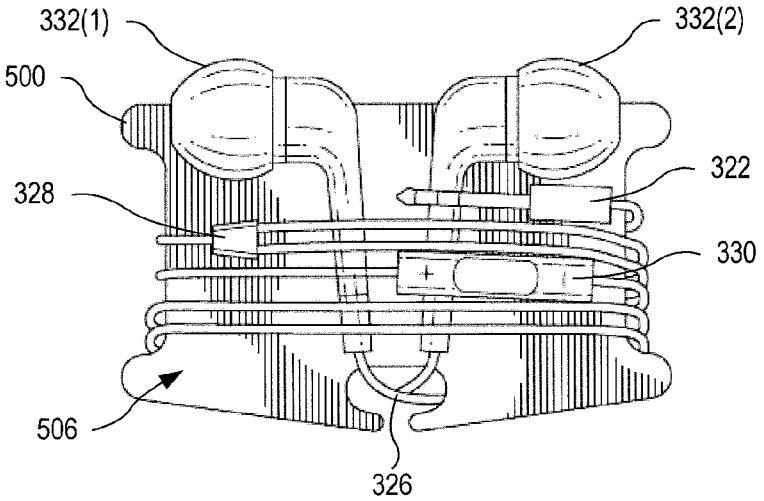
FIGS. 6, 7 and 8 are various views of the retaining clip of FIG. 5 retaining the earphone set of FIG. 2.
Figure 7:
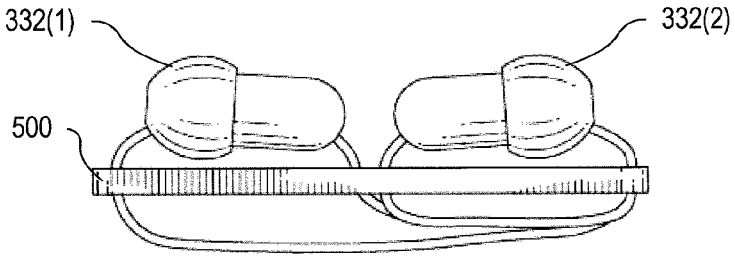
Figure 8:
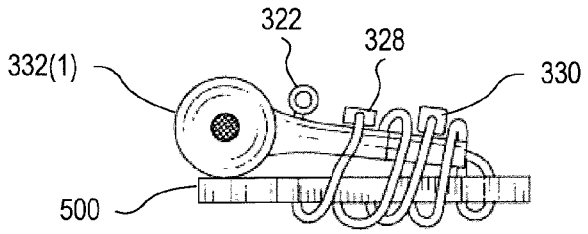

FIG. 5 shows one exemplary earphone retaining clip 500 with winding notches 504(1) and 504(2) and an alignment notch 502. Clip 500 is formed from a substantially flat material, such as plastic and/or metal, or any other easily fabricated material. FIGS. 6-8 show alternate views of retaining clip 500 of FIG. 5 retaining earphone set 320 of FIG. 2. FIGS. 5-8 are best viewed together with the following description.

Notch 502 receives wires 326 with earpieces 332 positioned against a front surface 506 of retaining clip 500, as shown in FIG. 6. Winding notches 504 have a distance W between inner segments thereof. Distance W is selected, based upon earphone set 320, such that as wires 326 and cable 324 are wound around winding notches 504, earpieces 332 are retained in position and junction splitter 328, remote control and microphone 330, and jack plug 322 lay adjacent to front surface 506 without any substantial slack in cable 324 and wires 326. Retaining clip 500 neatly retains earphone set 320. Height H and distance W of clip 500 are selected based, at least in part, upon measurements 323, 327 and 335-339 of earphone set 320. In particular, height H and distance W of clip 500 may be selected based upon size of rigid components 322, 328, 330, 332, and 334, and lengths 327, 337, 339 of earphone set 320, such that when the earphone set is wrapped on clip 500, it is tidy and takes up as small a space as possible. Distance W is equal or greater than a maximum of length 323 and length 338, for example, such that jack plug 322 and inline control panel 330 may be positioned between edges of notches 505. Optionally, clip 500 may include one or more securing holes 508, through which jack plug 322 may be passed to prevent cable 324 (and wires 326) from unwinding, and/or a jack plug retaining slot 510 for receiving jack plug 322 such that jack plug 322 may be tucked under, and retained by, windings of cable 324 and/or wires 326. Clip 500 may also optionally include one or more additional notches 512 that allow the length of one or more windings to be varied when clip 500 is used for retaining earphone sets of different lengths. Thus, earphone retaining clip 500 may be manufactured to retain in-ear style headphones, such as sold by Apple™ and V-Moda™, among others.

Figure 9:
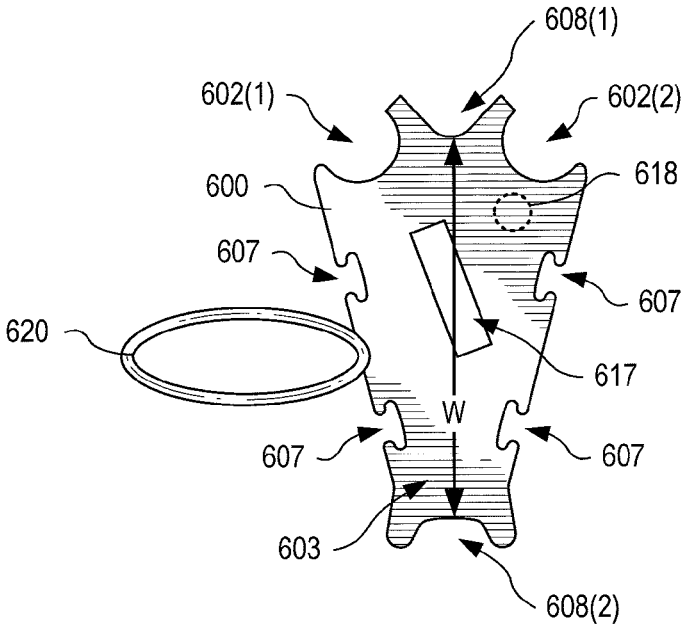
FIGS. 9, 10 and 11 are various views of one exemplary earphone retaining clip with winding notches, two earpiece retaining cutouts, and a jack plug retaining cutout, in an embodiment.
Figure 10:
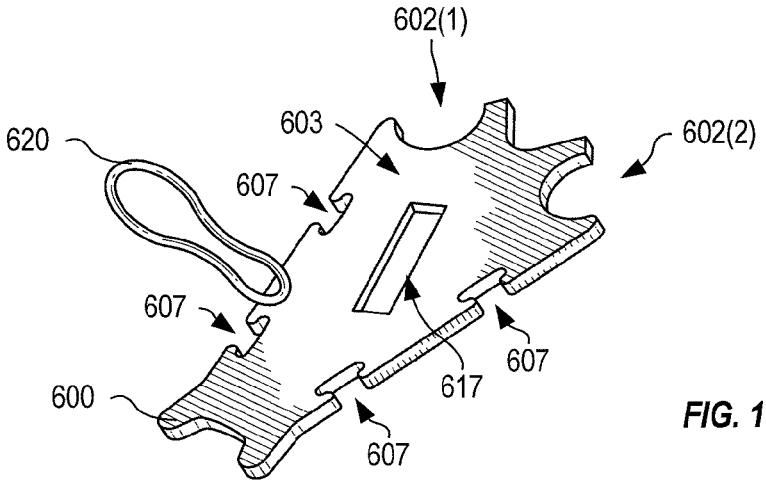
Figure 11:
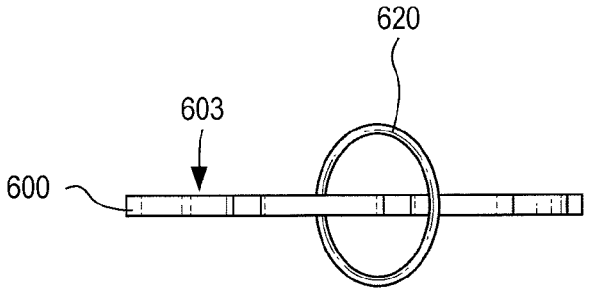

FIGS. 9, 10 and 11 show views of one exemplary earphone retaining clip 600 with winding notches 608(1) and 608(2), two earpiece retaining cutouts 602(1) and 602(2), a jack plug retaining cutout 617, and a plurality of notches 607. Clip 600 is formed from a substantially flat material, such as plastic or other easily fabricated material. Optionally, clip 600 includes a retaining band 620 made out of elastic material that may be used to further secure the earphone set wound onto clip 600. Earphone retaining clip 600 is ideally suited for retaining earphone sets with ear-bud style earpieces such as earphone set 300 of FIG. 1.

Winding notches 608 are formed with a distance W between inner segments thereof. Clip 600 allows an earphone set to be wound around winding notches 608 resulting in a winding with fewer turns and with a thinner profile, as compared to winding on clips 700, 800, and 900 of FIGS. 7, 8 and 9, described below. Clip 600 is particularly suited for use where larger areas (e.g., when associated with larger digital media devices) are available for storage of the earphone set. Optionally, clip 600 may include one or more holes 618, through which jack plug 302 may be passed to help secure the earphone set onto clip 600.

Earphone sets of various dimensions may be wound neatly onto earphone retaining clip 600 by passing cable 304 and/or wires 306, for one or more turns, through one or more notches 607 rather than around winding notches 608, as needed to adjust the position of the rigid components (e.g., remote control and microphone 310, junction splitter 308, and jack plug 302) of the earphone set. Specifically, by winding cable 304 and/or wires 306 through one or more notches 607 instead of around winding notches 608, junction splitter 308 and remote control and microphone 310 may be positioned adjacent a front surface 603 of clip 600 and jack plug 302 may be positioned within jack plug retaining cutout 617 without leaving slack in cable 304 and wires 306. In particular, rigid components of earphone set 300 may be positioned within a periphery of clip 600.

Figure 12:
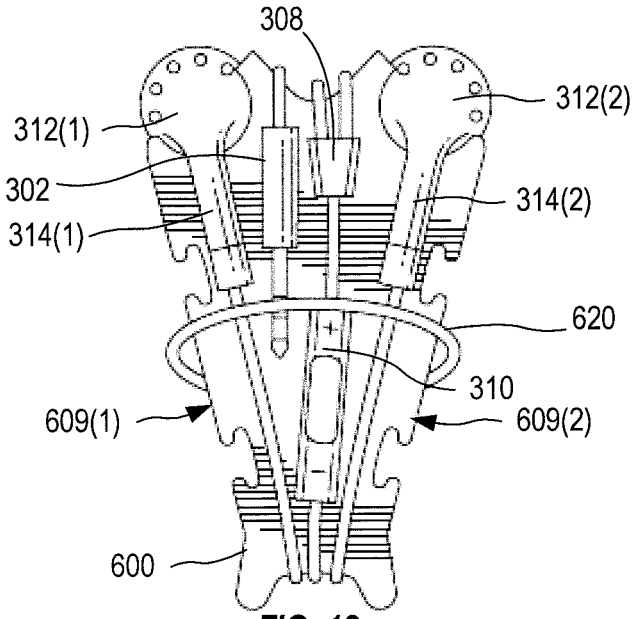
FIGS. 12, 13, and 14 are various views of the retaining clip of FIGS. 9, 10 and 11 retaining the earphone set of FIG. 1.
Figure 13:
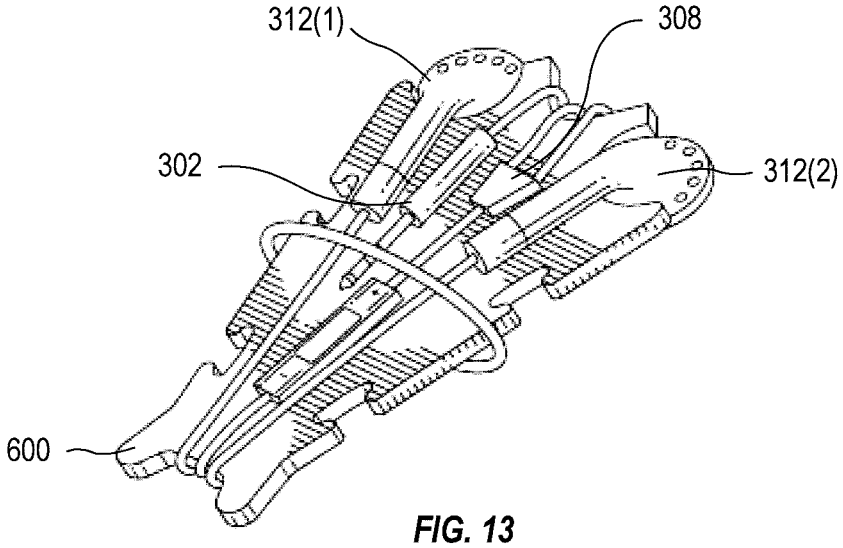
Figure 14:
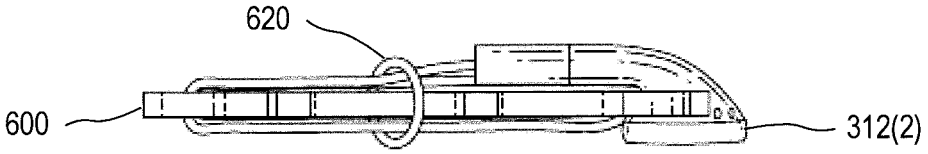

FIGS. 12, 13, and 14 show front, perspective and side views of retaining clip 600 of FIGS. 9, 10 and 11 retaining earphone set 300 of FIG. 1. Rigid components 302, 308, and 310 of earphone set 300 are positioned within a periphery (that is, inside the boundaries) of retaining clip 600 and earphone set 300 are neatly organized on clip 600 for easy storage. Earpiece retaining cutouts 602 are located at one end of clip 600.

Earpieces 312 are positioned within cutouts 602 and wrapping of wires 306 and cable 304 proceeds around winding notches 608 (see, e.g., FIG. 9). If rigid components 308 and 310 are not positioned as desired with front surface 603 (e.g., relatively flush with front surface 603) component 310, wires 306 may be passed through one or more of notches 607 to adjust a winding length of one or more turns until rigid components 308, 310 are positioned within the periphery of front surface 603. In one example of winding, wires 306 and/or cable 304 passes through one notch 607 and then wraps around secondary winding edges 609(1) and 609(2) (i.e., substantially perpendicular to winding notches 608). Secondary winding edges 609 are not parallel. Jack plug 302 is positioned within (i.e., tucked into) jack plug cutout 617 beneath wound wires 306 and cable 304.

By including notches 607, a winding length of each turn of wires and cables onto clip 600 may be adjusted to match most earphone configurations, such that long axes of the rigid components are positioned substantially parallel to front surface 603 of clip 600.

Figure 15:
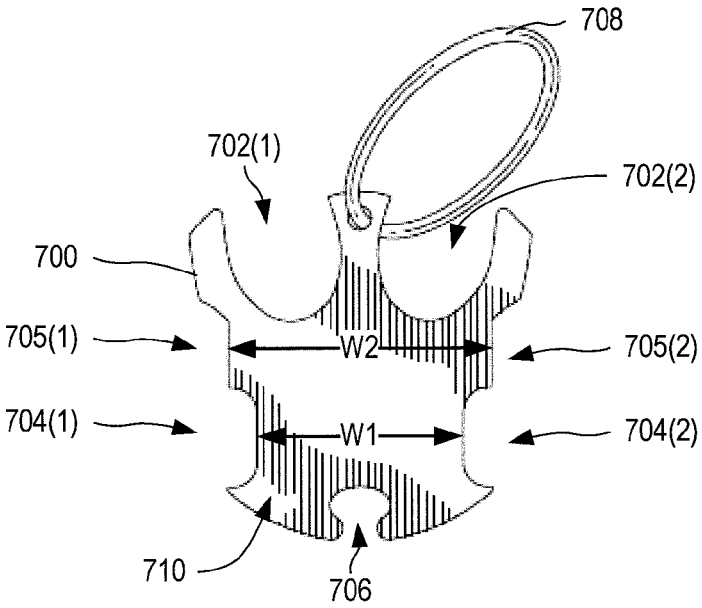
FIG. 15 shows one exemplary earphone retaining clip with two earpiece retaining cutouts, winding notches with two different distances and an earpiece alignment notch, in an embodiment.

FIG. 15 shows one exemplary earphone retaining clip 700 with two earpiece retaining cutouts 702(1) and 702(2), two first winding notches 704(1) and 704(2) and two second winding notches 705(1) and 705(2) that have different winding widths W1 and W2, respectively, and an earpiece alignment notch 706 for compact storage of an earphone set (e.g., earphone set 300 of FIG. 1). Clip 700 may optionally include an elastic band 708 for use in securing wrapped the earphone set to clip 700. Cutouts 702(1) and 702(2) are partially open to allow easy insertion of earpieces 312(1) and 312(2), respectively. Cutouts 702(1) and 702(2) are also shaped (e.g., rounded) based upon the shape of earpieces 312 and are sized slightly smaller than the largest diameter D of earpieces 312. A distance W1 between inner segments of winding notches 704(1) and 704(2) and a distance W2 between inner segments of winding notches 705(1) and 705(2) are determined based upon dimensions of earphone set 300, such that as wires 306 and cable 304 are wound around winding notches 704 and 705, earpieces 312 are retained in position in cutouts 702, and junction splitter 308, remote control and microphone 310 and jack plug 302 lay adjacent to front surface 710 without any substantial slack in cable 304 and wires 306.

FIGS. 16, 17, 18, 19, 20, 21 and 22 show views of exemplary wrapping of ear-bud style earphone set 300 of FIG. 1 around retaining clip 700 of FIG. 15. Precise dimensioning of clip 700 allows earphone set 300 to be wrapped and stored very compactly, thereby allowing easy storage of earphone set 300.

Figure 16:
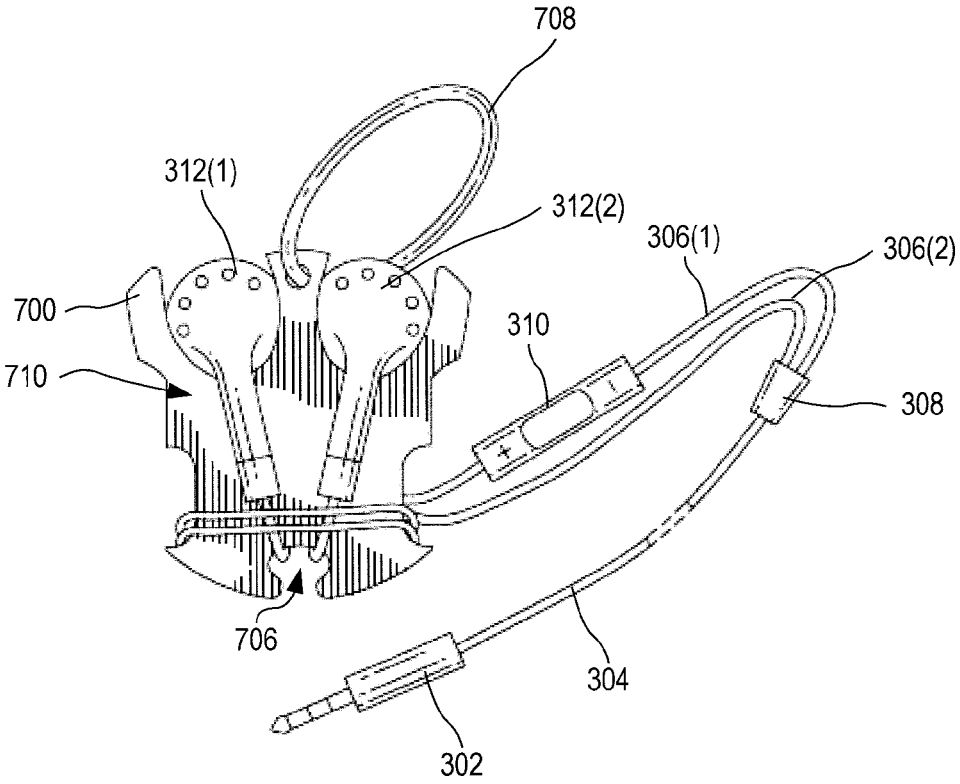
FIGS. 16, 17, 18, 19, 20, 21 and 22 are various views showing the retaining clip of FIG. 15 retaining the ear-bud style earphone set of FIG. 1.
Figure 17:
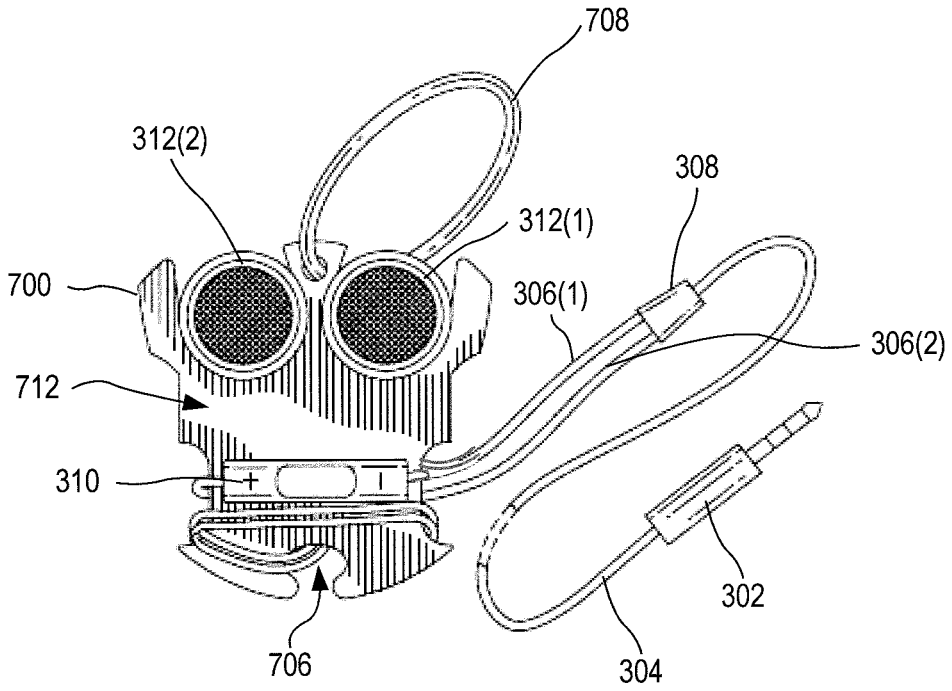
Figure 18:
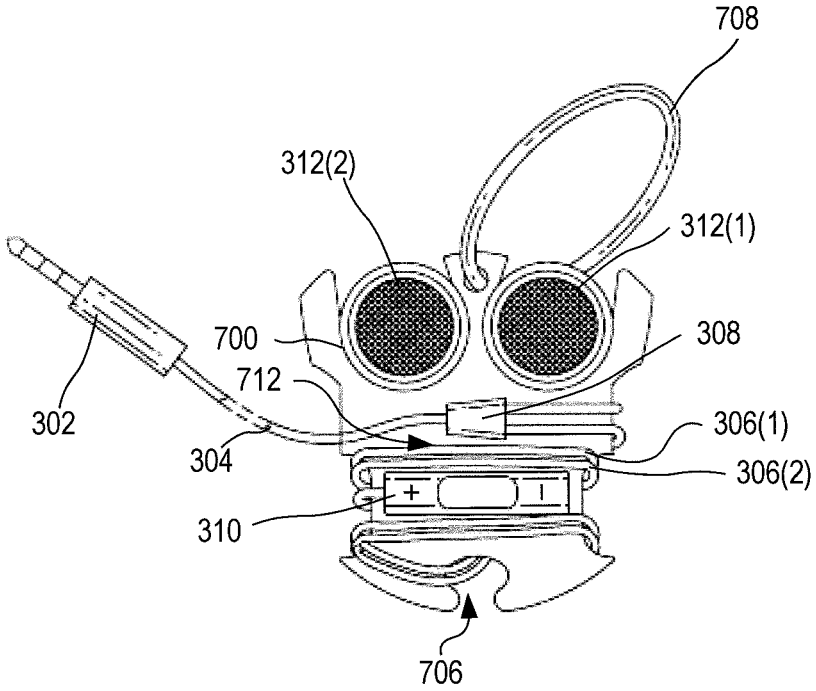
Figure 19:
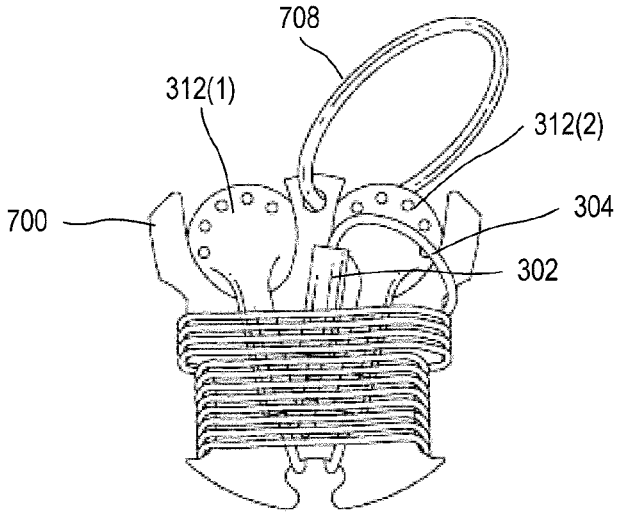
Figure 20:
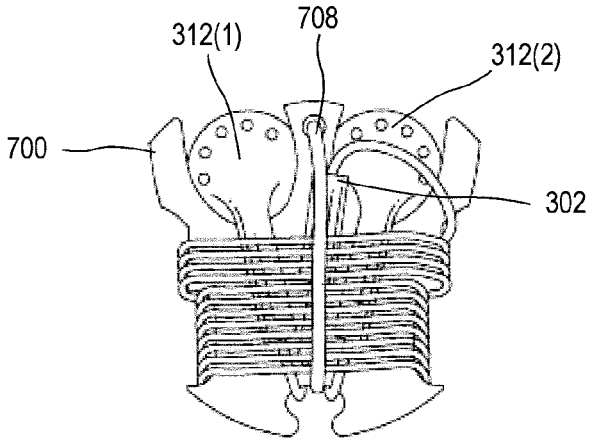
Figure 21:
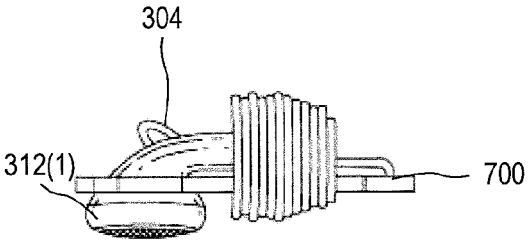
Figure 22:
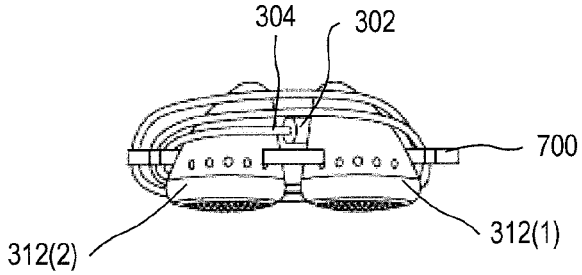

Earpieces 312(1) and 213(2) are positioned in cutouts 702 (1) and 702(2) such that stems 314 lay on a front surface 710 of clip 700 and wires 306 pass through alignment notch 706 from front to back, as shown in FIG. 16. Wires 306 are then wrapped around winding notches 704 such that remote control and microphone 310 (a rigid structure) is aligned substantially parallel to a reverse surface 712 (opposite front surface 710) without extending beyond the periphery of clip 700, as shown in FIG. 17. Winding of wire 306 continues around winding notches 704 and onto winding notches 705 such that junction splitter 308 (another rigid part) is also positioned parallel to surface 712 and within a periphery of clip 700, as shown in FIG. 18. Winding of cable 304 continues around winding notches 705 until jack plug 302 may be inserted in a space between stems 314 and beneath cable 304, as shown in FIG. 19. Jack plug 302 is thereby positioned substantially flat against front surface 710 and without unnecessary slack in wires 306 and cable 304. If included, optional elastic band 708 may be positioned around earphone set 300 retained by clip 700, as shown in FIG. 20. Since distance W2 is greater than distance W1, fewer turns are required to store cable 304.

In one embodiment, the overall dimensions of wrapped earphone set 300 onto retaining clip 700 are approximately 1½ inches, by 1½ inches, by ⅝ of an inch, which makes it small enough to be stored compactly against the back of a digital music device while allowing the user full function of all DMD features, such as using handheld cell phone features. See for example, FIGS. 20, 21, and 22. Earphone set 300 is easily removed from clip 700 without damage or tangling. Further, the compact nature of earphone set 300 wrapped on clip 700 allows easy storage, as described below.

Figure 23:
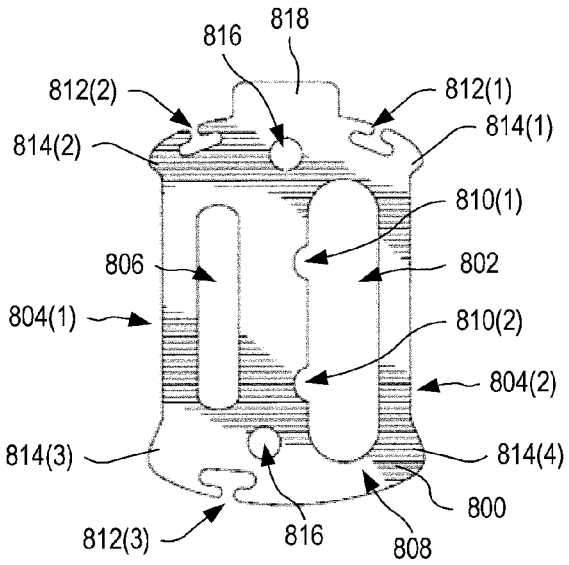
FIGS. 23 and 24 are different views of one exemplary earphone retaining clip with an earpiece retaining cutout, winding notches, and a jack plug retaining cutout, in an embodiment.
Figure 24:
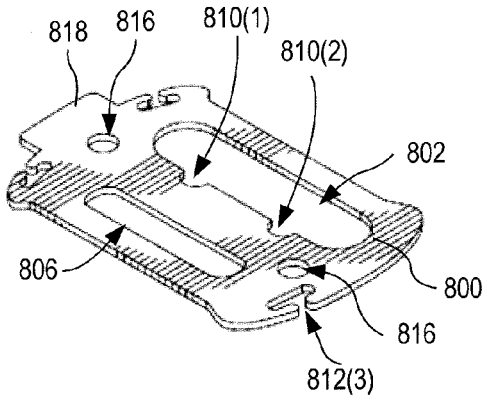
Figure 25:
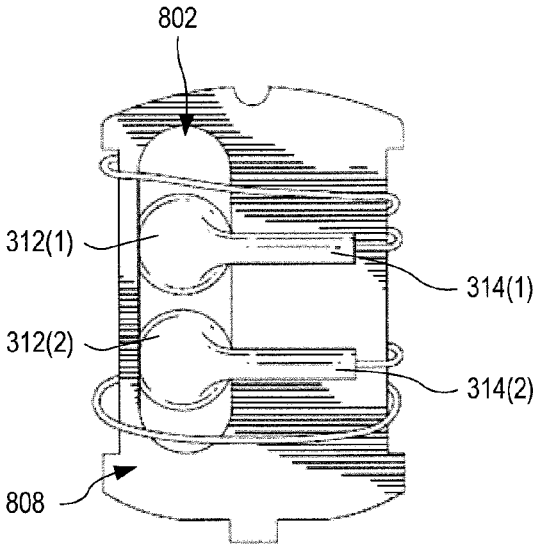
FIG. 25 shows the earphone retaining clip of FIGS. 23 and 24 retaining the earphone set of FIG. 1.

FIGS. 23 and 24 show two views of one exemplary earphone retaining clip 800 with an earpiece retaining cutout 802, winding notches 804, and a jack plug retaining cutout 806, in an embodiment. FIG. 25 shows the earphone retaining clip of FIGS. 23 and 24 retaining earphone set 300 of FIG. 1. FIGS. 23, 24 and 25 are best viewed together with the following description.

Earpiece retaining cutout 802 is shaped and sized to capture earpieces, such as earpieces 312, 332, and 372, of FIGS. 1, 2 and 4, respectively. As shown in FIG. 25, earpieces 312 may be inserted through cutout 802 such that stems 314 lie flat on a front surface 808 of clip 800. Cutout 802 may include notches 810(1) and 810(2) for aligning stems 314(1) and 314(2), respectively. When used for in-ear earpieces 332, 372, each earpiece is laid flat along cutout 802, rather than though it, in a similar positions to earpieces 332 of FIG. 6. Clip 800 may include a connector 818 for coupling with a storage case, described in further detail below.

To wind earphone set 300 onto clip 800, first earpieces 312 are positioned within cutout 802, wires 306 and cable 304 are then wound around winding notches 804(1) and 804(2) such that rigid portions (e.g., remote control and microphone 310) of earphone set 300 are positioned within the periphery of clip 800. Clip 800 includes additional notches 812 that may be used to alter winding of wires 306 and/or cable 304 of earphone 300 such that the rigid portions are positioned within the periphery of clip 800. Once cable 304 is wrapped around winding notches 804, jack plug 302 is then tucked into jack plug retaining cutout 806 behind cable 304 and wires 306. Wrapping is maintained to a specified width through the use of side rails 814 that extend a desired distance from upper and lower "corners" of clip 800 to define a winding path between winding notches 804. Edges or other portions of clip 800 that are not used to accumulate winding of cable 304 and wires 306 may be used to hold clip 800 (e.g., between the fingers of one hand of the user) while wrapping the earphone set around clip 800 with the other hand. Additional notches 812 are provided to assist the user in completing the wrap of earphone set 300 successfully. For example, in the event rigid components 302, 308, and 310 do not lay parallel to surfaces 808, or protrude outside the periphery of clip 800, notches 812 may be used to shorten the length of one or more winding turns to reposition one or more rigid components of earphone 300. One or more cord capture holes 816 allows jack plug 302 pass through and then be stored within jack plug capture cutout 806.

In one embodiment, clip 800 has a thickness of approximately ⅛ inch. Cutouts 802 and 806 are positioned within the periphery of clip 800 such that earpieces 312 and jack plug 302 are stored with minimal increase in overall thickness of clip 800 when wound with earphone set 300, as compared to positioning of earpieces 312 and jack plug 302 on surface 808.

Figure 26:
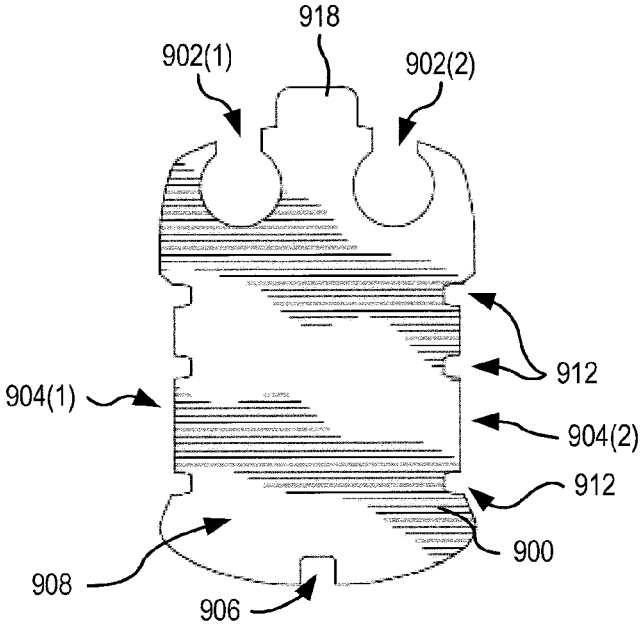
FIGS. 26 and 27 are views of one exemplary earphone retaining clip with two earpiece retaining cutouts, and winding notches, in an embodiment.
Figure 27:
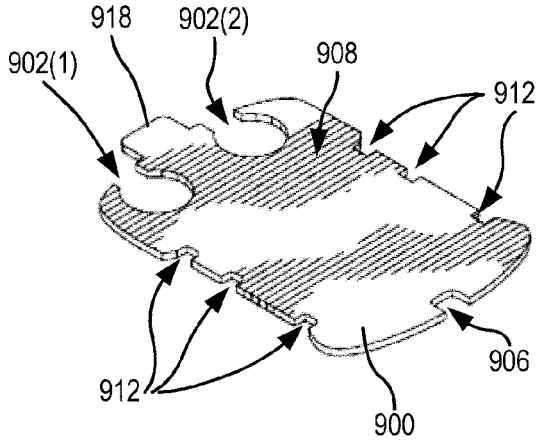
Figure 28:
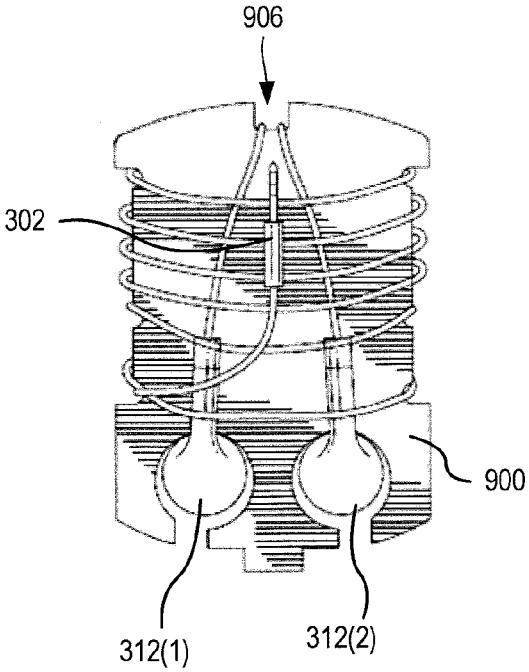
FIG. 28 shows the earphone retaining clip of FIGS. 26 and 27 retaining the earphone set of FIG. 1.

FIGS. 26 and 27 show two views of one exemplary earphone retaining clip 900 with two earpiece retaining cutouts 902(1) and 902(2), an alignment notch 906, and winding notches 904. FIG. 28 shows earphone retaining clip 900 of FIGS. 26 and 27 retaining earphone set 300 of FIG. 1. FIGS. 26, 27 and 28 are best viewed together with the following description.

Earpiece retaining cutouts 902 are shaped and sized to capture ear-bud style earpieces, such as earpieces 312 of FIG. 1. As shown in FIG. 28, earpieces 312 are inserted within cutouts 902 such that stems 314 lie flat on a front surface 908 of clip 900. Clip 900 may include a connector 918 for coupling with a storage case, described in further detail below.

To wind earphone set 300 onto clip 900, first earpieces 312 are positioned within cutouts 902, wires 306 are passed through alignment notch 906, and wires 306 and cable 304 are then wound around winding notches 904(1) and 904(2) such that rigid portions (e.g., junction splitter 308 and remote control and microphone 310) of earphone set 300 are positioned within the periphery of clip 900. Clip 900 includes additional notches 912 that may be used to alter a winding length of one or more turn of wires 306 and/or cable 304 of earphone 300 such that the rigid portions are positioned within the periphery of clip 900. Once cable 304 is wrapped around winding notches 904, jack plug 302 is then tucked behind cable 304 and wires 306. In one embodiment, clip 900 has a thickness of approximately ⅛ inch and is contoured to minimize thickness and provide better fit to components.

Figure 29:
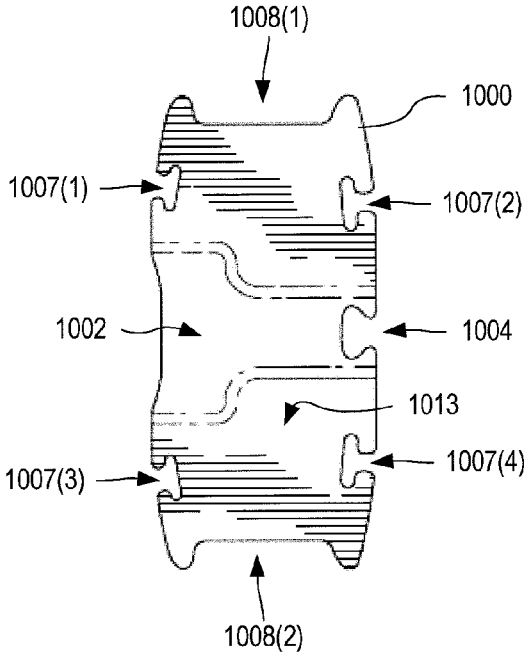
FIGS. 29, 30 and 31 are various views showing one exemplary earphone retaining clip that is shaped and sized for storing in-ear style earphone set, in an embodiment.
Figure 30:
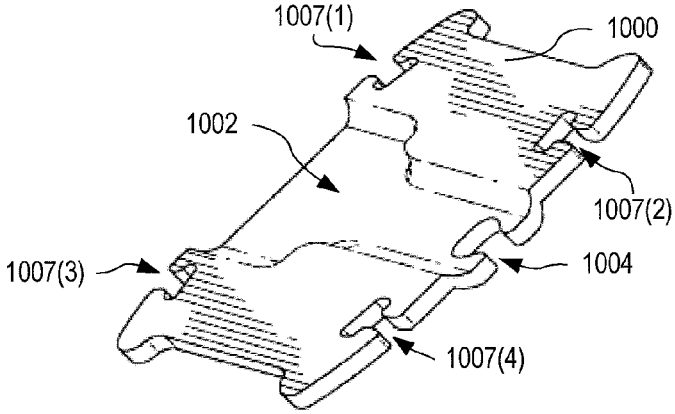
Figure 31:
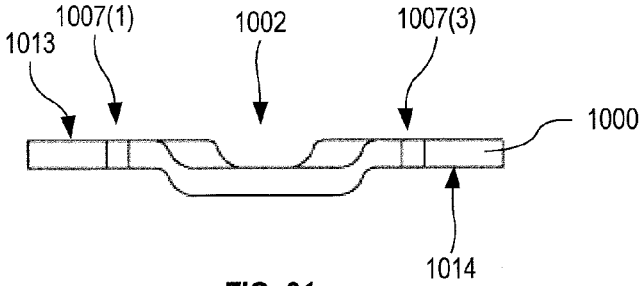
Figure 32:
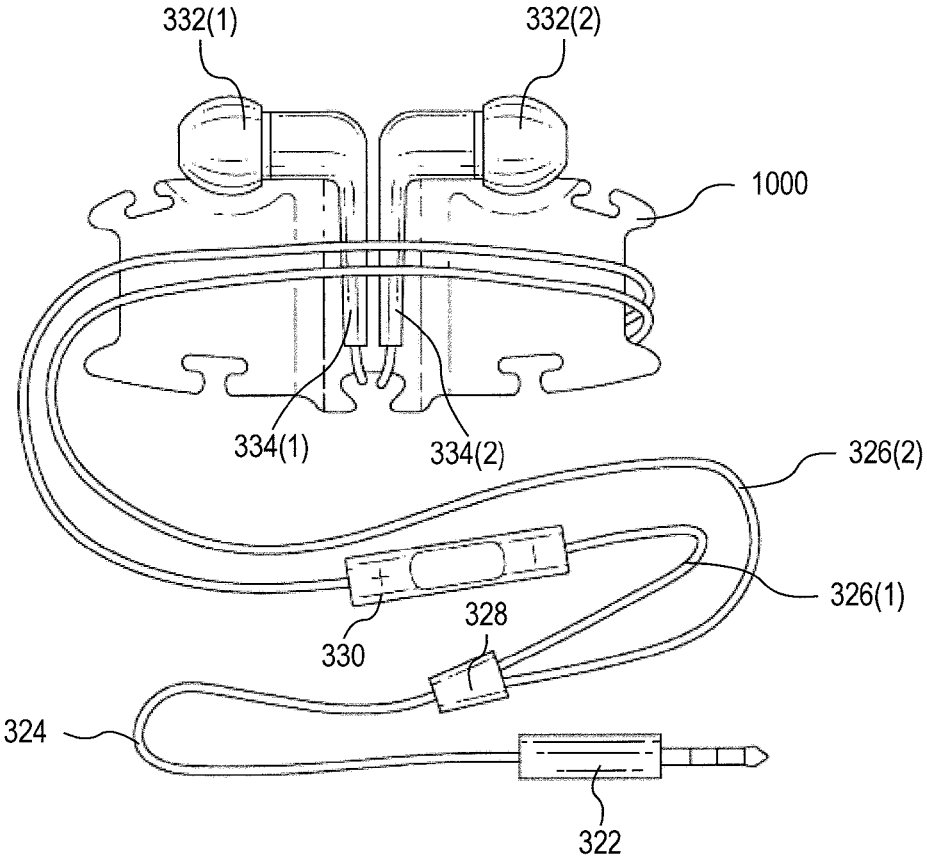
FIGS. 32 and 33 show the earphone retaining clip of FIGS. 29, 30 and 31, retaining the earphone set of FIG. 2.
Figure 33:
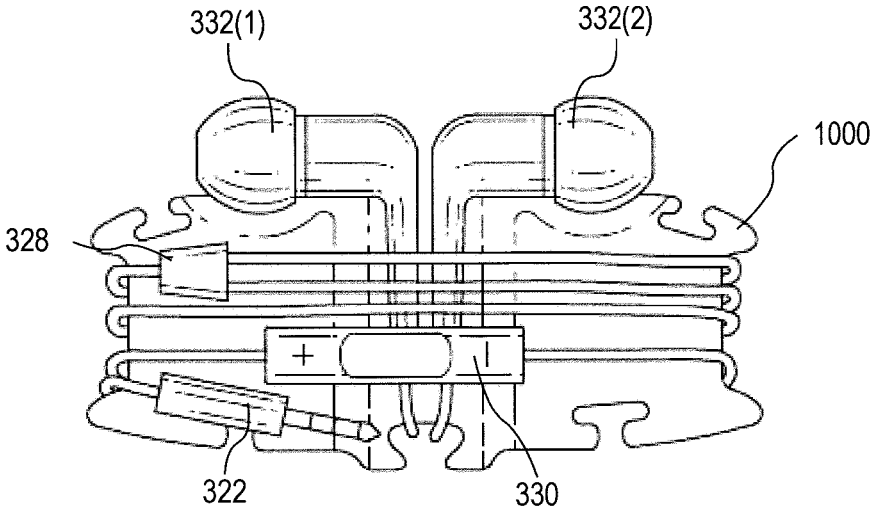

FIGS. 29, 30 and 31 show one exemplary earphone retaining clip 1000 that is shaped and sized for storing in-ear style earphone sets, such as earphone sets 320 and 360 of FIGS. 2 and 4. FIGS. 32 and 33 show earphone retaining clip 1000 of FIGS. 29, 30 and 31, retaining earphone set 320 of FIG. 2. FIGS. 29, 30, 31, 32 and 33 are best viewed together with the following description.

Earphone retaining clip 1000 includes a shaped area 1002 for receiving in-ear style earpieces (e.g., earpieces 332 of earphone set 320), an earpiece alignment notch 1004 for receiving wires 326, winding notches 1008(1) and 1008(2) for winding wires 326 and cable 324, and a plurality of additional notches 1007 that may be used for positioning rigid components 328 and 330 within a periphery of clip 1000.

To wrap earphone set 320 on earphone retaining clip 1000, earpieces 332 are positioned within shaped area 1002 and wires 326 are passed through alignment notch 1004, and then wound around winding notches 1008. Where clip 1000 is correctly dimensioned for earphone set 320, rigid components 322, 328 and 330 of earphone set 320 are positioned within a periphery of clip 1000 and substantially parallel to a top surface 1013 or a bottom surface 1014 of clip 1000. Where one or more rigid components 322, 328 and 330 are not positioned within a periphery of clip 1000, wires 326 and/or cable 324 may be passed through one (or more) of the additional notches 1007 for one or more turns such that the components are positioned within the periphery. That is, additional notches 1007 may be used to adjust the amount of wires and/or cable taken up by one or more turns. Clip 1000 may optionally include an elastic band (not shown) for retaining the earphone set wound onto clip 1000.

Figure 34:
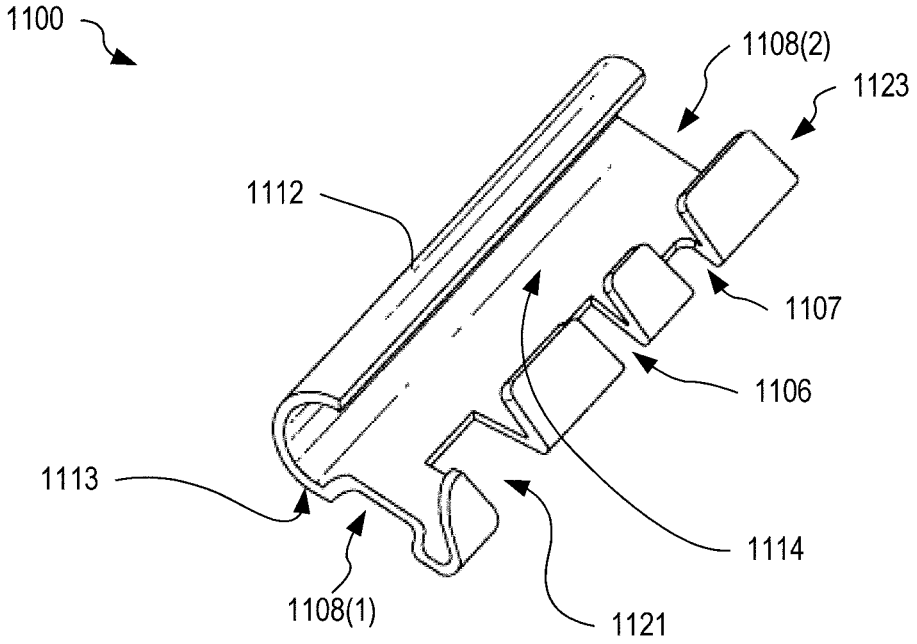
FIG. 34 shows one exemplary in-ear style earphone retaining clip that provides additional protection of the earphone set, in an embodiment.
Figure 35:
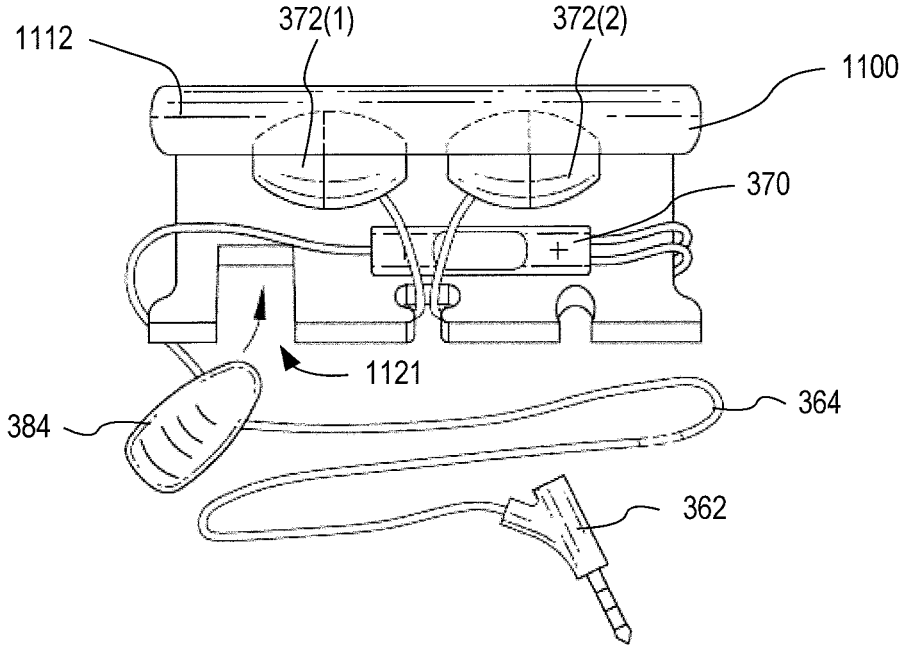
FIGS. 35-41 illustrate exemplary winding of the earphone set of FIG. 4 onto the earphone retaining clip of FIG. 34.
Figure 36:
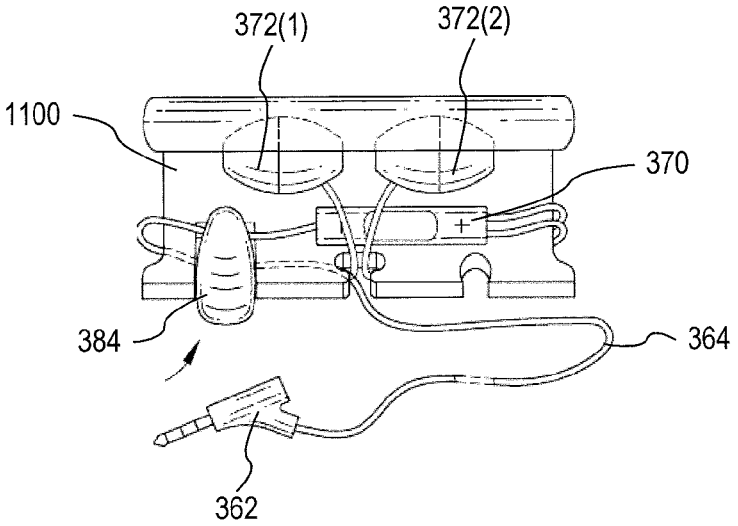
Figure 37:
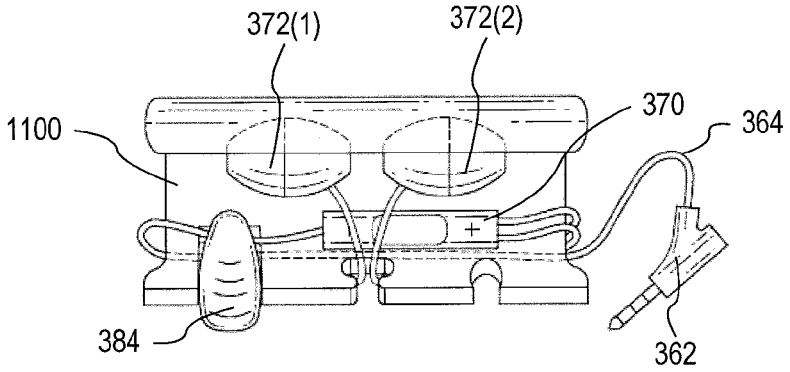
Figure 38:
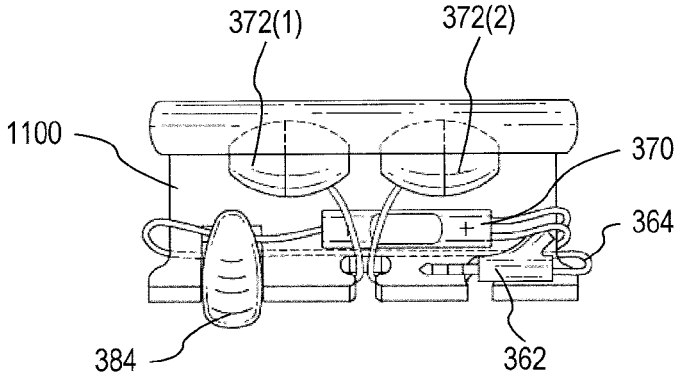
Figure 39:
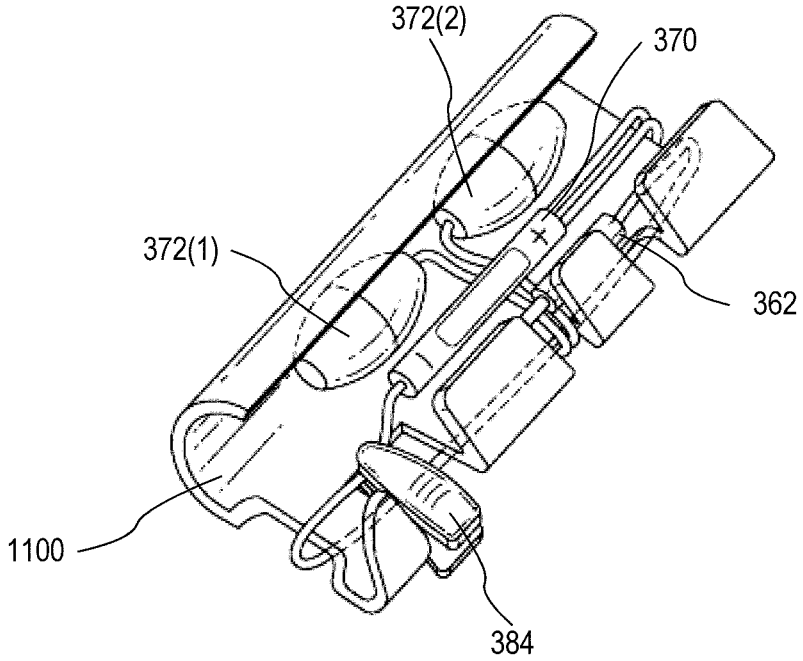
Figure 40:
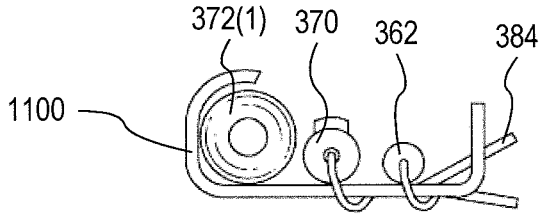
Figure 41:
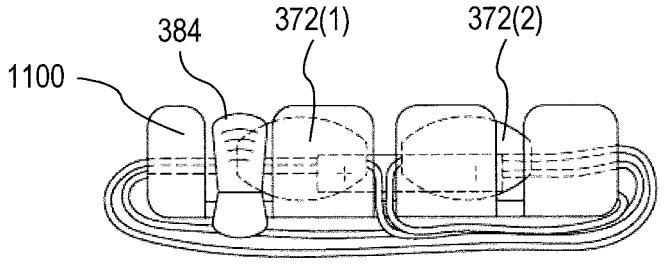

FIG. 34 shows one exemplary in-ear style earphone retaining clip 1100 that provides additional protection of the earphone set. FIGS. 35-41 illustrate exemplary winding of earphone set 360 of FIG. 4 onto earphone retaining clip 1100 of FIG. 34. FIGS. 34-41 are best viewed together with the following description.

Clip 1100 has a substantially flat base 1114 that is approximately rectangular. A curved (substantially "C" shaped) edge 1112 is formed along a first long edge of base 1114 and is sized and shaped to receive in-ear earpieces, such as earpieces 372. Edge 1112 provides additional protection for stored earpieces 372, which may be sensitive and expensive components, as compared to clips 500, 600, 700, 800, 900, and 1000 of FIGS. 5-8, 9-14, 15-22, 23-25, 26-28, and 29-33, respectively. Winding notches 1108(1) and 1108(2) are formed in short edges of base 1114, and opposite to curved edge 1112 is a folded edge 1123 that is substantially at a right-angle to base 1114 and folded in an opposite direction as edge 1112 (for example, folded towards edge 1112). Folded edge 1123 includes an alignment notch 1106 that is substantially central in edge 1123 and a lapel clip notch 1121 that extends into base 1114 for receiving lapel clip 384. Folded edge 1123 also includes an additional notch 1107 that may be used to adjust the length of one or more turns to position rigid components 362, 368, and 370 of earphone 360 within a periphery of clip 1100.

To wind earphone set 360 onto clip 1100, earpieces 372 are positioned within curved edge 1112 and wires 366 are passed through alignment notch 1106. Wires 366 and cable 364 are then wrapped around winding notches 1108(1) and 1108(2) such that rigid components 368 and 370 are positioned substantially parallel to an outside surface 1113 of base 1114 and within the periphery of clip 1100, such that only wires 366 and cable 364 pass across an inside surface of base 1114. Lapel clip 384 is positioned into lapel clip notch 1121 and clipped onto base 1114 therein such that lapel clip 384 is also positioned within the periphery of clip 1100. In one embodiment, surface 1113 of base 1114 is recessed to receive one or more of rigid components 368 and 370 to reduce the profile of clip 1100 when wound with earphone set 360.

Additional notch 1107 may receive one or both of wires 366 and cable 364 to shorten one or more turns if repositioning of rigid components 368 and 370 is required. In one embodiment, clip 1100 wound with earphone set 360 has approximate dimensions of 1¾ inch long, 1½ inch wide and ½ inch thick.

In one embodiment, the longest dimension of clip 1100 is not greater than the length of the positioned earpieces 372 or the length of control and microphone 370, and the width of clip 1100 is sufficient to accommodate earpieces 372 and stems 374. Inner segments of each winding notch 1108(1) and 1108(2) are spaced apart a distance determined from the length of wires 366 and cable 364, and the size and position of rigid components 368 and 310. Jack plug 362 may be tucked into position within the periphery of clip 1100 and beneath wires 366 and cable 364.

In one embodiment, a back side of base 1114 is recessed such that one or more rigid components 362, 368, 370 of earphone set 360 may be positioned against rear surface of clip 1100.

FIGS. 42-48 show one exemplary retaining and protective clip 1200 for retaining in-ear style earphone sets, such as earphone sets 320 and 360 of FIGS. 2, 3 and 4. FIGS. 49-53 shows exemplary winding of earphone set 320 of FIG. 3, configured with lapel clip 342, onto clip 1200 of FIGS. 42-48.

Figure 42:
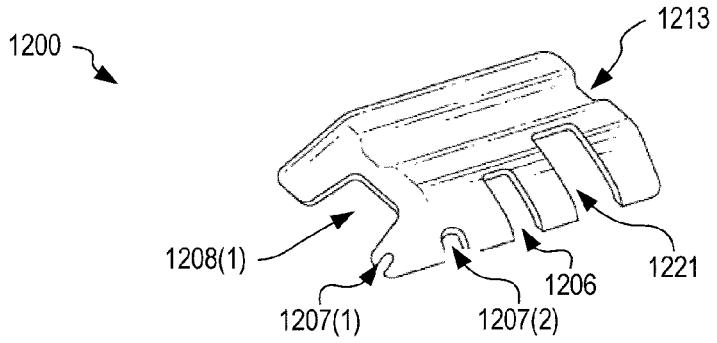
FIGS. 42-48 are various views of one exemplary retaining and protective clip for retaining in-ear style earphone set, in an embodiment.
Figure 43:
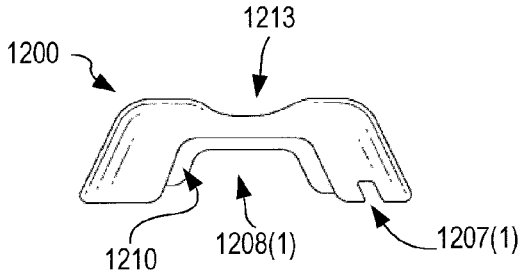
Figure 44:
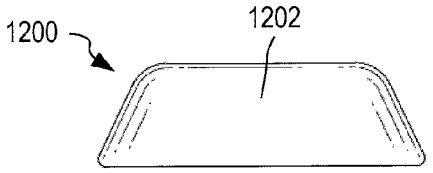
Figure 45:
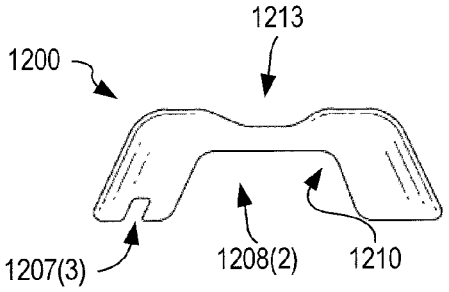
Figure 46:
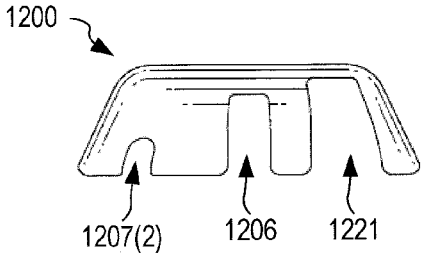
Figure 47:
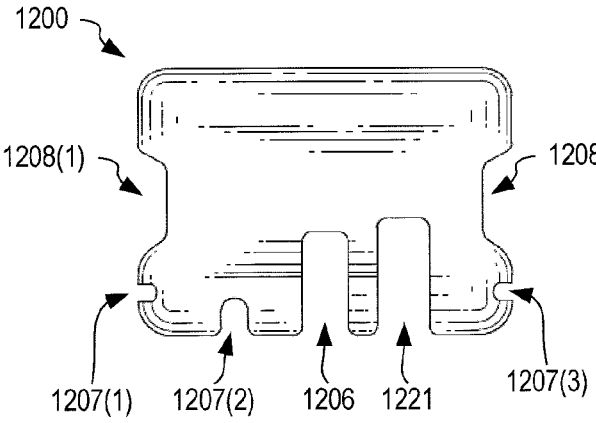
Figure 48:
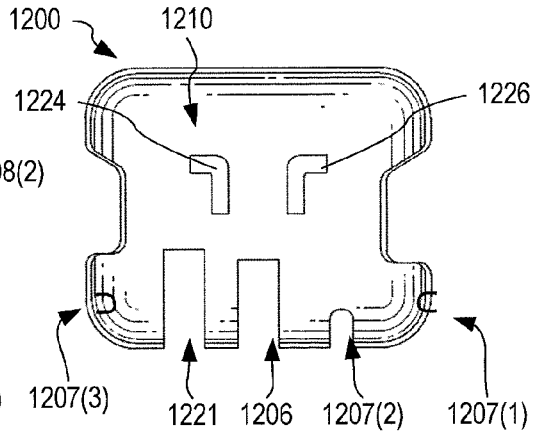

FIG. 42 is a perspective view of clip 1200 illustrating a shaped design for retaining and protecting the earphone set retained therein. Clip 1200 has an alignment notch 1206, a lapel clip notch 1221, and first and second additional notches 1207(1) and 1207(2). FIG. 43 is a side view of a first side of clip 1200 illustrating an earpiece storage area 1210, a top recess 1213 for reducing height of cables and wires (e.g., wires 326 and cable 324) wound onto clip 1200, and a first winding notch 1208(1). FIG. 44 is a back view of clip 1200 illustrating a protective enclosure 1202 that protects and forms earpiece storage area 1210. FIG. 45 is a side view of a second side of clip 1200 illustrating earpiece storage area 1210, top recess 1213, a third additional notch 1207(3), and a second winding notch 1208(2). FIG. 46 is a front view of clip 1200 illustrating second additional notch 1207(2), alignment notch 1206, and lapel clip notch 1221. FIG. 47 is a top view of clip 1200 illustrating additional notches 1207(1), 1207(2), 1207(3), alignment notch 1206, lapel clip notch 1221, winding notches 1208(1) and 1208(2), and top recess 1213. FIG. 48 is a bottom view of clip 1200 showing two internal inserts 1224 and 1226 for positioning earpieces within clip 1200, as shown in FIG. 49.

As shown in FIGS. 42-48, clip 1200 is bowl shaped, thereby having the advantage of providing a more ergonomically pleasing feel when stored within a membrane type container, as described below. In addition, clip 1200 provides a rigid protective housing to protect sensitive components of the earphone set, such as earpieces 332 and remote control and microphone 330.

Figure 49:
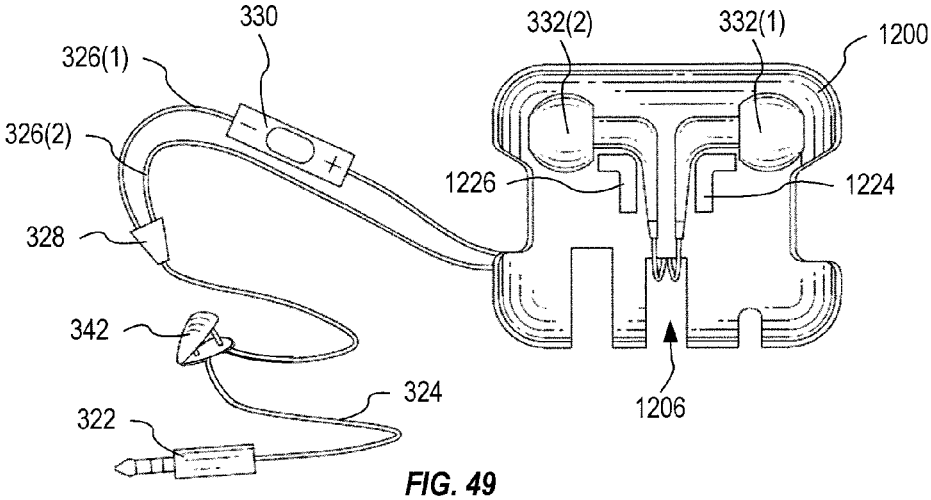
FIGS. 49-53 show exemplary winding of the earphone set of FIG. 3 on the clip of FIGS. 42-48.
Figure 50:
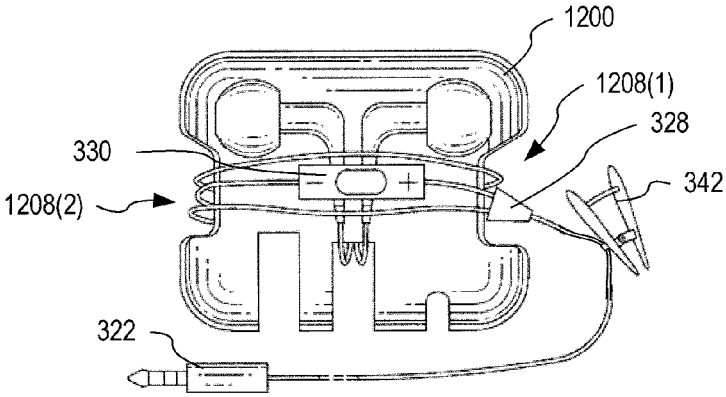
Figure 51:
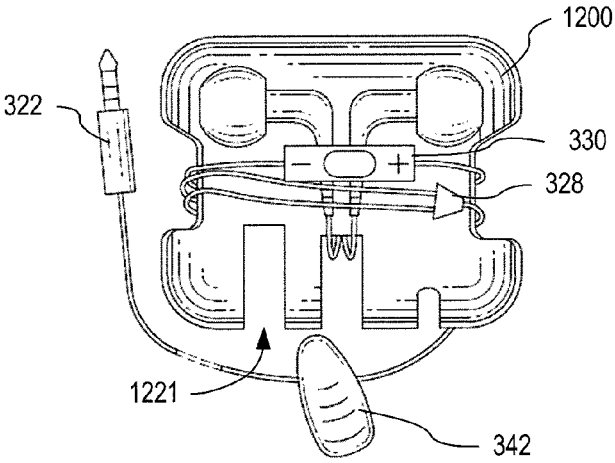
Figure 52:
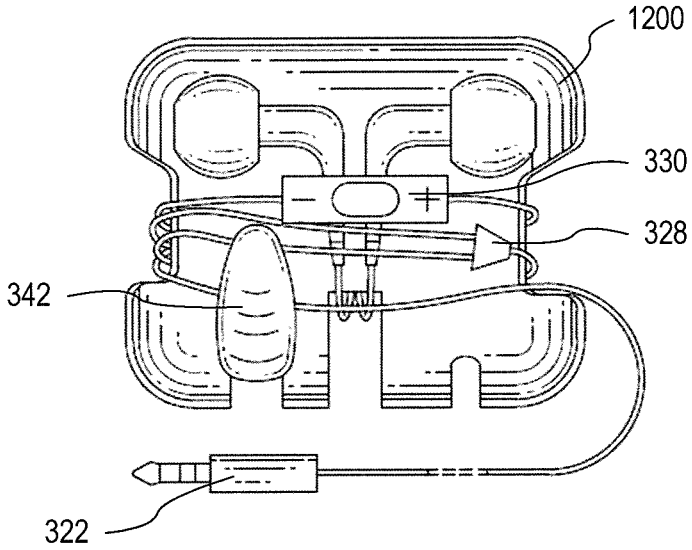
Figure 53:
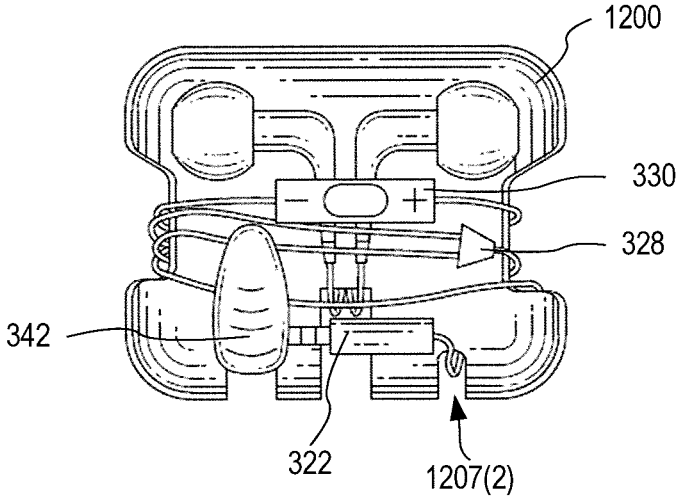
Figure 54:
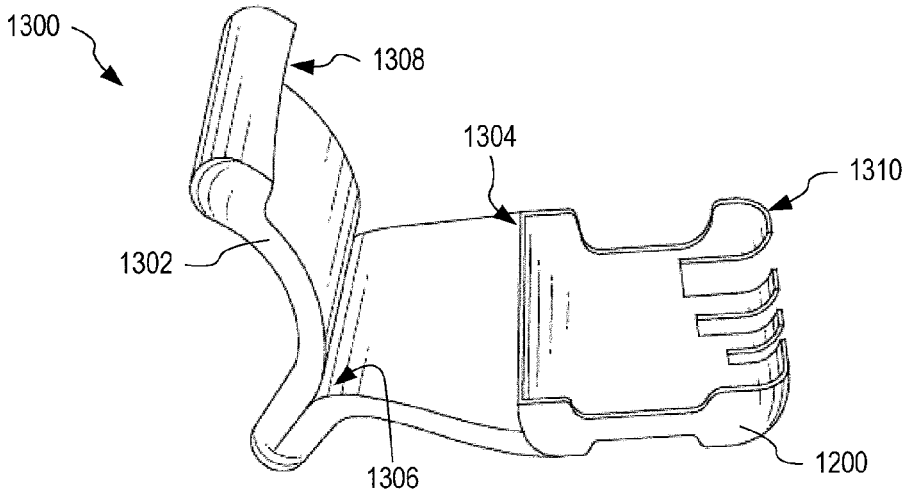
FIGS. 54-57 show an exemplary earphone storage device using the clip of FIGS. 42-53 integrated with a stretchable pouch, in an embodiment.

FIGS. 49-53 show exemplary winding of earphone set 320 of FIG. 3 onto clip 1200. Earpieces 332 are inserted into clip 1200 and wires 326 are passed through alignment notch 1206, as shown in FIG. 49. Wires 326 and cable 324 are wound around winding notches 1208 such that rigid components 328 and 330 are positioned within a periphery of clip 1200 and lapel clip 342 is clipped into lapel clip notch 1221, as shown in FIGS. 51-52. Cable 324 may then pass through one of notches 1207 such that jack plug 322 is also positioned within the periphery of clip 1200, as shown in FIG. 53.

Figure 55:
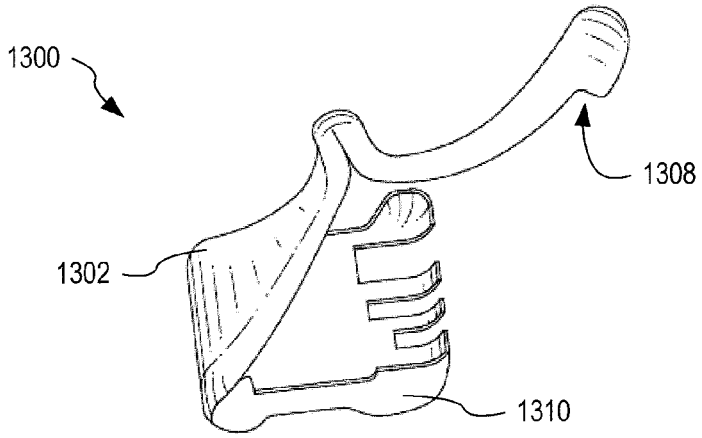
Figure 56:
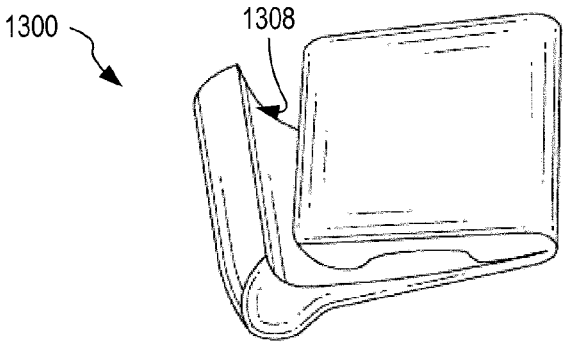
Figure 57:
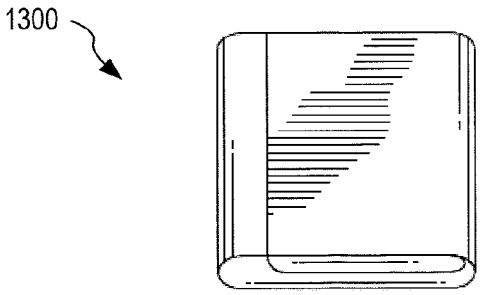

FIGS. 54-57 show an exemplary earphone storage device 1300 formed with clip 1200 of FIGS. 42-53 and a stretchable pouch 1302. Pouch 1302 is attached to an external surface 1304 of earpiece storage area 1210 and is formed with shaped pockets 1306 and 1308 that fit edges 1310 and 1304 of clip 1200 when pouch 1302 is wrapped around clip 1200, as shown in FIGS. 55-57. Pouch 1302 thereby secures the earphone set within clip 1200 and provides additional protection of the earphone set against damage, such as when carried in a pocket, purse, handbag, briefcase, and so on.

Figure 58:
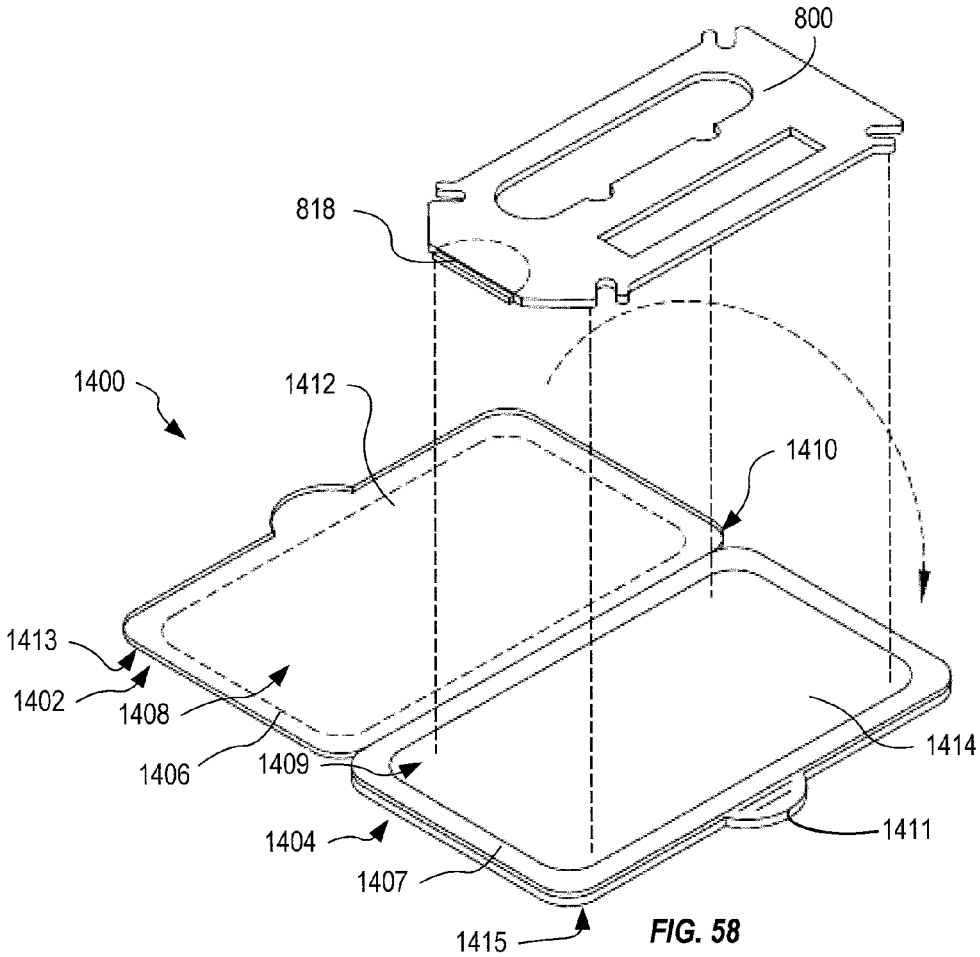
FIGS. 58-60 show an exemplary carrying case for storing an earphone set wound onto the retaining clip of FIGS. 23 and 24, in an embodiment.
Figure 59:
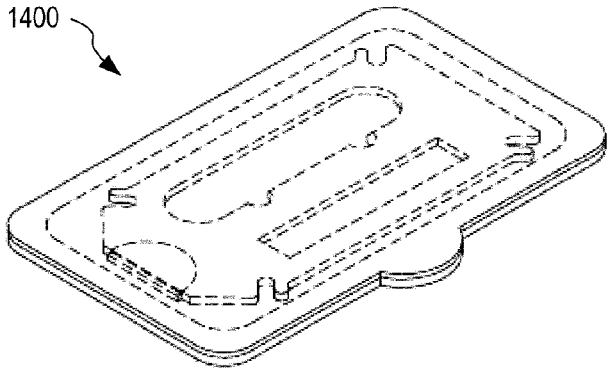
Figure 60:
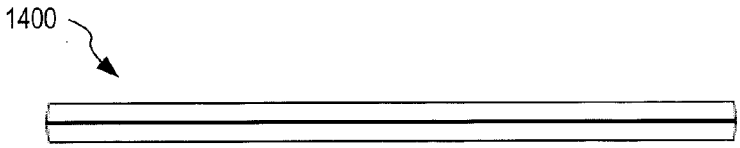

FIGS. 58-60 show an exemplary carrying case 1400 for storing an earphone set (e.g., one of earphone sets 300, 320, 360) wound onto retaining clip 800 of FIGS. 23 and 24. Carrying case 1400 is formed with a lid component 1402 and a base component 1404 that couple together to form carrying case 1400. Although shown with clip 800, carrying case 1400 may be used to store any of clips 500, 600, 700, 800, 900, 1000, 1100, 1200 of FIGS. 5-8, 9-14, 15-22, 23-25, 26-28, 29-33, 34-41 and 42-53, respectively, and may also be used to store other items, such as batteries, note pads, and so on. Carrying case 1400 may also store storage device 1300 of FIG. 13.

Lid component 1402 includes a rectangular former 1406 that has a cutout 1408, and a stretchable material 1412 attached to an outside 1413 of former 1406, wherein former 1406 provides mechanical strength at a periphery of lid component 1402. Similarly, base component 1404 includes a rectangular former 1407 that has a cutout 1409 and a stretchable material 1414 attached along an outside 1415 of former 1407, wherein former 1407 provides mechanical strength to a periphery of base component 1404. Lid component 1402 and base component 1404 are substantially the same shape and size. Lid component 1402 and base component 1404 may each also include one or more protrusions to aid a user in opening carrying case 1400. Stretchable materials 1412 and 1414 are for example made from one or more of Neoprene, Yamamoto Neoprene, "limestone" based neoprenes, woven fabric, pleated fabric, rubber, and other such stretchable materials or materials.

A hinge 1410 joins components 1402 and 1404 along a long edge of each former 1406, 1407 such that lid and base components 1402, 1404 hinge together to form a carrying case, as shown in FIGS. 59 and 60. Carrying case 1400 may latch closed, using any known latching method that is appropriate for its size, including but not limited to one or more of: a spring and hinge combination, a mechanical catch built into one or both of formers 1406 and 1407, hook and loop fasteners (e.g., Velcro™), and a magnetic fastener coupled with formers 1406 and 1407. Carrying case 1400 may be opened via a catch 1411. (Further references herein to Velcro™ should be understood to designate equivalent hook and loop fasteners or materials.)

FIG. 59 is a perspective view of carrying case 1400 containing clip 800 and FIG. 60 is a side view of carrying case 1400 containing clip 800. When containing only clip 800, carrying case 1400 is substantially flat, as shown.

Figure 61:
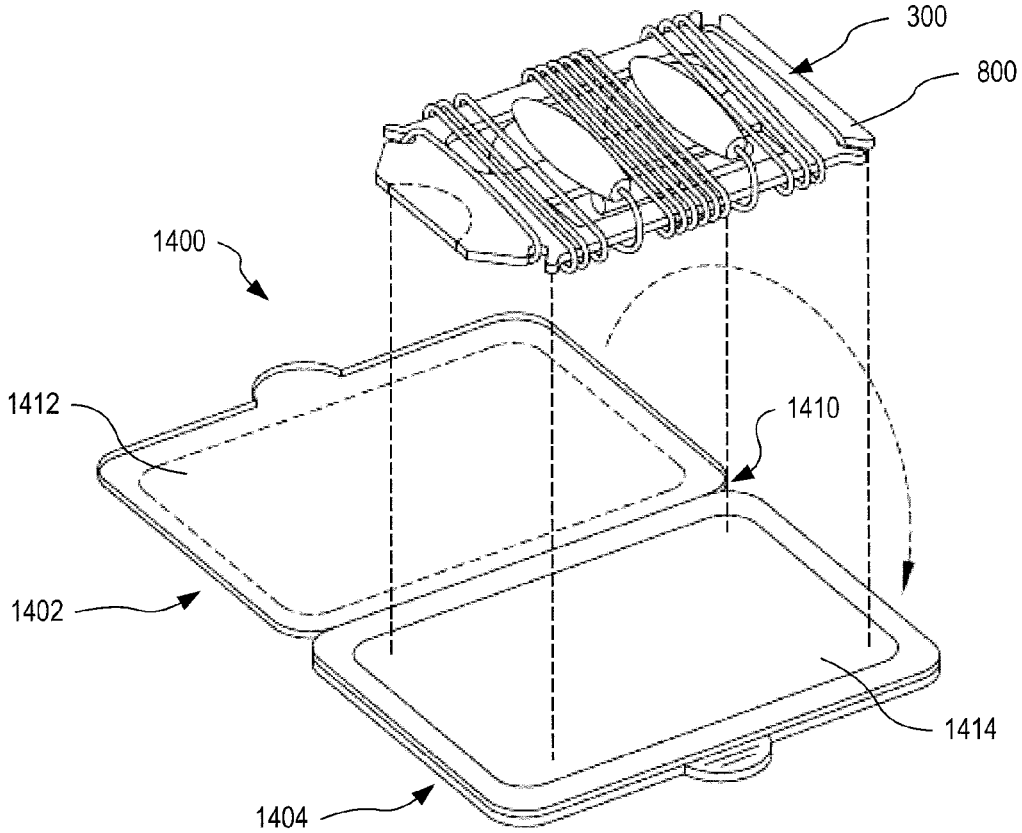
FIGS. 61-63 show use of the carrying case of FIGS. 58-60 for storing the earphone set of FIG. 1 wrapped onto the earphone retaining clip of FIGS. 23-25, in an embodiment.
Figure 62:
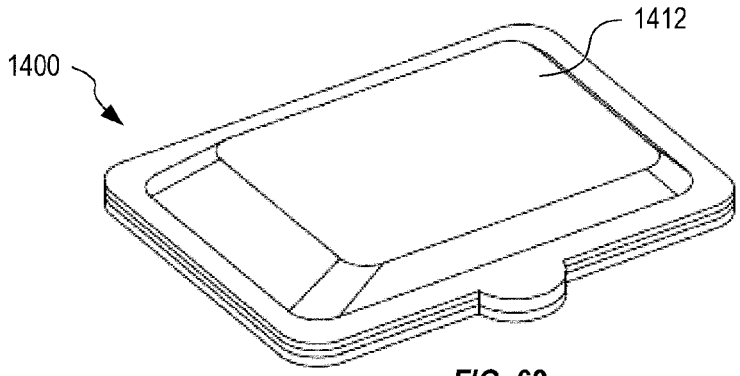
Figure 63:
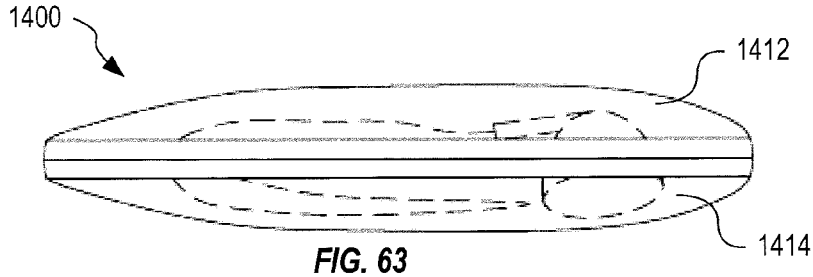

FIGS. 61-63 show use of carrying case 1400 of FIGS. 58-60 for storing earphone set 300 of FIG. 1 wrapped onto earphone retaining clip 800 of FIGS. 23-25, in an embodiment. As shown in FIG. 61, clip 800 wound with earphone set 300 is placed into opened carrying case 1400, which is then closed, as shown in FIGS. 62 and 63, wherein stretchable materials 1412 and 1414 are deformed by clip 800 and wound earphone set 300 and clip 800 and earphone set 300 are retained and protected by carrying case 1400.

Figure 64:
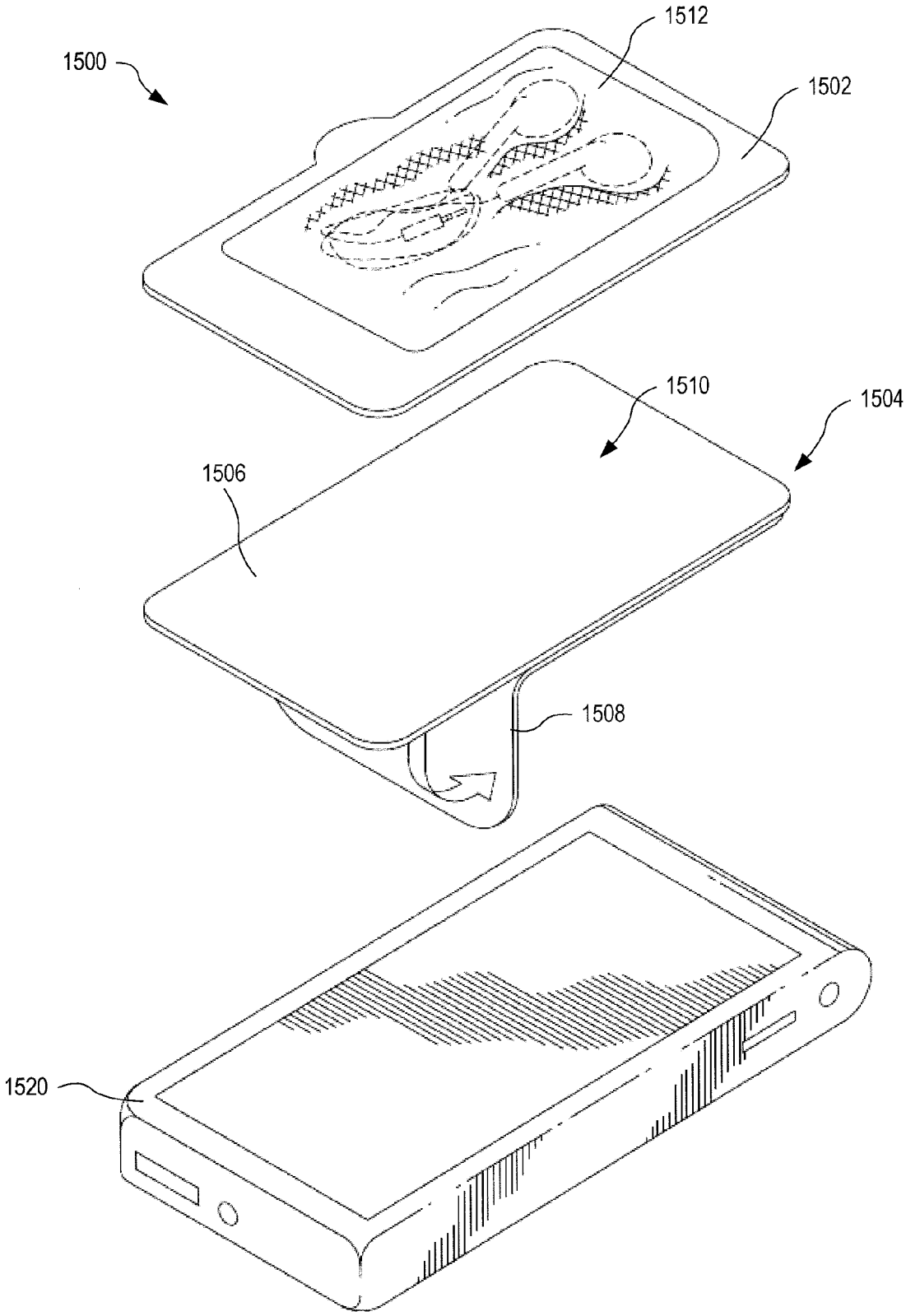
FIG. 64 shows one exemplary storage case, similar to the carrying case of FIGS. 58-63, that attaches to a digital media device (DMD) for storing an earphone set (or other items) together with the DMD, in an embodiment.

FIG. 64 shows one exemplary storage case 1500, similar to carrying case 1400 of FIGS. 58-63, that attaches to a digital media device (DMD) 1520 for storing an earphone set (or other items) together with the DMD. Storage case 1500 includes a lid component 1502 that is substantially the same as lid component 1402 of carrying case 1400 and a base component 1504 that is formed of a substantially rigid sheet 1506 that couples with lid component 1502 to form storage area 1510.

A first side of a double sided adhesive tape 1508 attaches to a bottom side of sheet 1506, and a second side of double sided adhesive tape 1508 may attach directly to a surface (for example, a back surface) of DMD 1520 or to a protective case of DMD 1520. Since sheet 1506 (and the surface of DMD 1520) is substantially rigid, items (e.g., earphone set 300 wrapped onto retaining clip 800) stored within storage case 1500 deform stretchable material 1512 of lid component 1502 when case 1500 is closed around the item.

In one embodiment, hook and loop fasteners are used to couple sheet 1506 with lid component 1502, such that lid component 1502 may be removed from sheet 1506. In another embodiment, a hinge (not shown) couples sheet 1506 to lid component 1502, wherein lid component 1502 includes a clasp mechanism for keeping lid component 1502 closed over sheet 1506.

Figure 65:
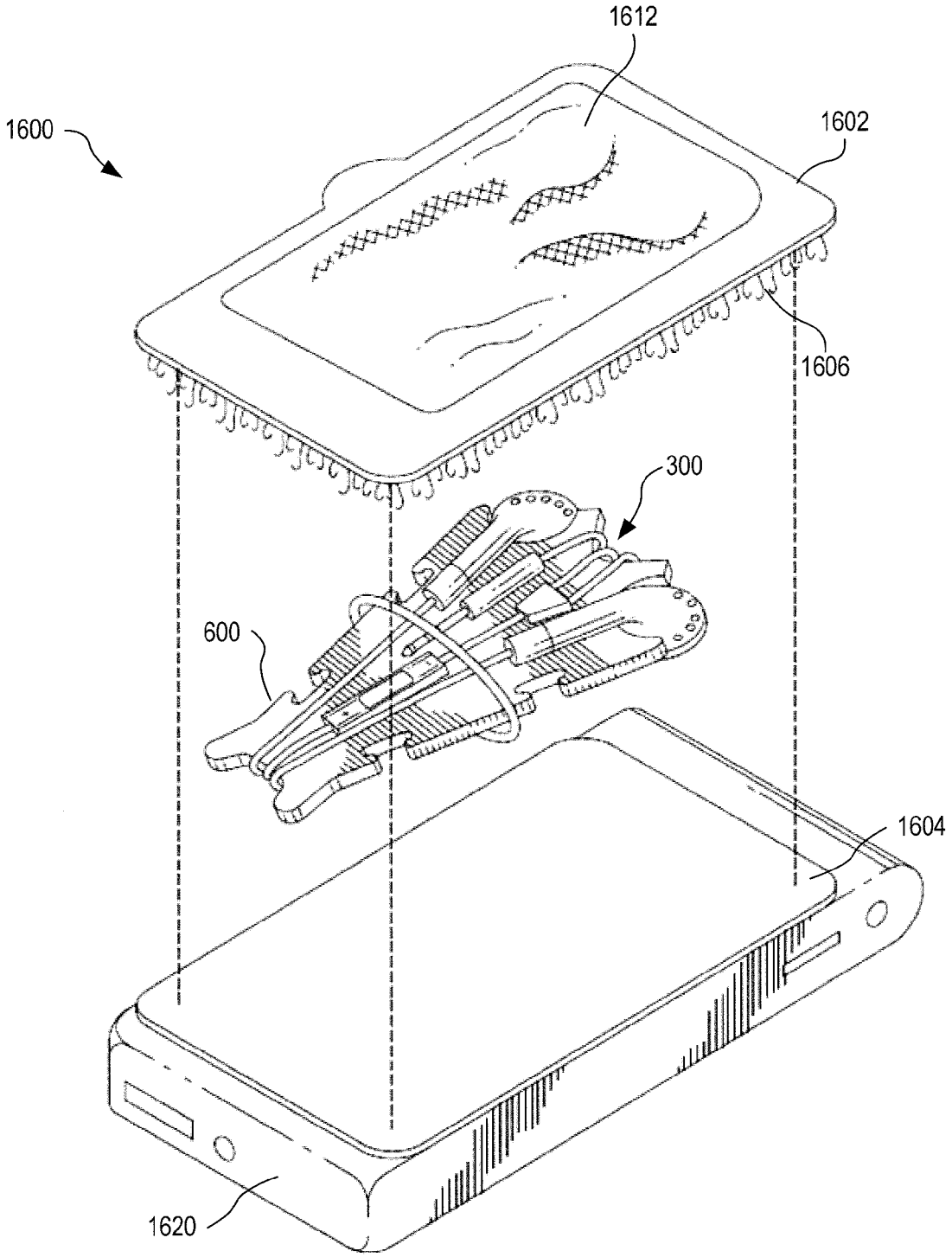
FIG. 65 shows one exemplary storage case attached to a DMD by a hook and loop method for storing an earphone set and a retaining clip such as the clip of FIGS. 9-11, together with the DMD, in an embodiment.
Figure 66:
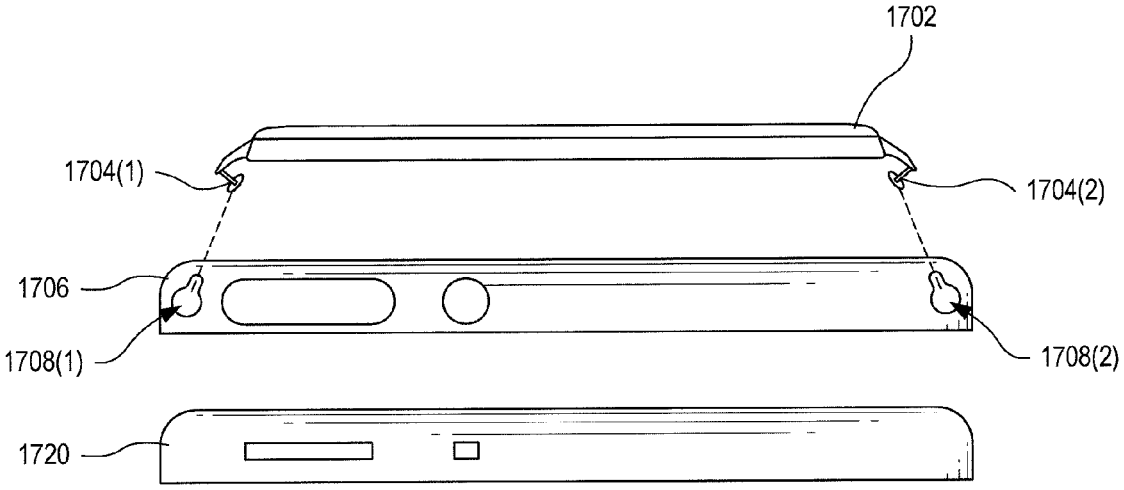
FIGS. 66-69 are various views of one exemplary system for attaching the storage case of FIG. 64 or FIG. 65 to a DMD, in an embodiment.

FIG. 65 shows one exemplary storage case 1600 attached to a DMD 1620 by a hook and loop method for storing an earphone set together with the DMD, in an embodiment. Storage case 1600 includes a lid component 1602 that is similar to lid components 1402 of FIGS. 58-63, and lid component 1502 of FIG. 64, with a hook portion 1606 of a hook and loop fastener attached to the underside (e.g., to an underside of a former similar to former 1406, described above with respect to FIGS. 58-63). A loop portion 1604 of the hook and loop fastener forms a base component of storage case 1600 and is attached (e.g., by adhesive) to a surface of DMD 1620 (or to a case protecting DMD 1620), as shown.

In one example of use, earphone set 300 of FIG. 1 are wound onto retaining clip 600 and positioned on the base component (e.g., loop portion 1604). Lid component 1602 is then positioned over the earphone set and clip and pressed down such that hook portion 1606 mates with loop portion 1604, where stretchable material 1612 of lid component 1602 is deformed by the earphone set and clip and retained within storage case 1600. To open storage case 1600, the user pulls lid component 1602 away from DMD 1620 such that hook portion 1606 separates from loop portion 1604. Storage case 1600 may be used with other styles of earphone and with other retaining clips without departing from the scope hereof. Further, storage case 1600 may store other items, such as batteries, notebooks, and so on. Storage case 1600 may also store retaining clip 600 when the earphone set is in use.

In one embodiment, loop portion 1604 may be integrated with a protective case of DMD 1620.

Figure 67:
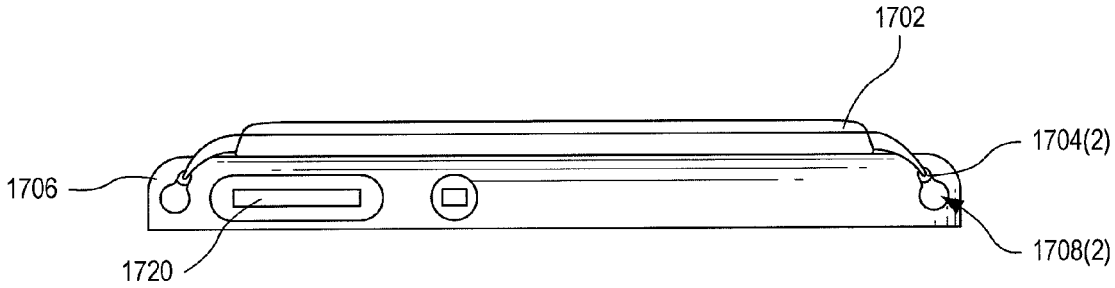

FIGS. 66-69 show one exemplary method of attaching a storage case 1702 to a DMD 1720. Storage case 1702 attaches to a protective DMD case 1706 and may represent any one of storage cases 1500 and 1600 of FIGS. 64 and 65, respectively. That is, storage case 1702 may include features of storage cases 1500 and 1600. Storage case 1702 is configured with a hook 1704 at each of four corners. A protective DMD case 1706 has receptacles 1708, one positioned at each corner of the case, such that when coupled with an associated hook 1704, each storage case 1702 is under tension and hooks 1704 remains within their associated receptacles 1708. Each hook 1704 is formed as a ball or disc at a distal end of a narrower neck. Each receptacle 1708 is formed as a slot with a first end that is sized to allow the ball or disc of hook 1704 to pass and a second end that is smaller than the ball and disc but greater or equal in size to a diameter of the neck of the hook 1704. Each receptacle 1708 is oriented with the second (narrow) end towards the back of protective case 1706 as shown. The neck and/or portions of storage case 1702 may stretch such that hooks 1704 may be inserted into the wide end of their associated receptacles. Storage case 1702 may thereby be easily and securely attached to protective case 1706, as shown in FIG. 67. Storage case 1702 may also be removed if not needed.

Figure 68:
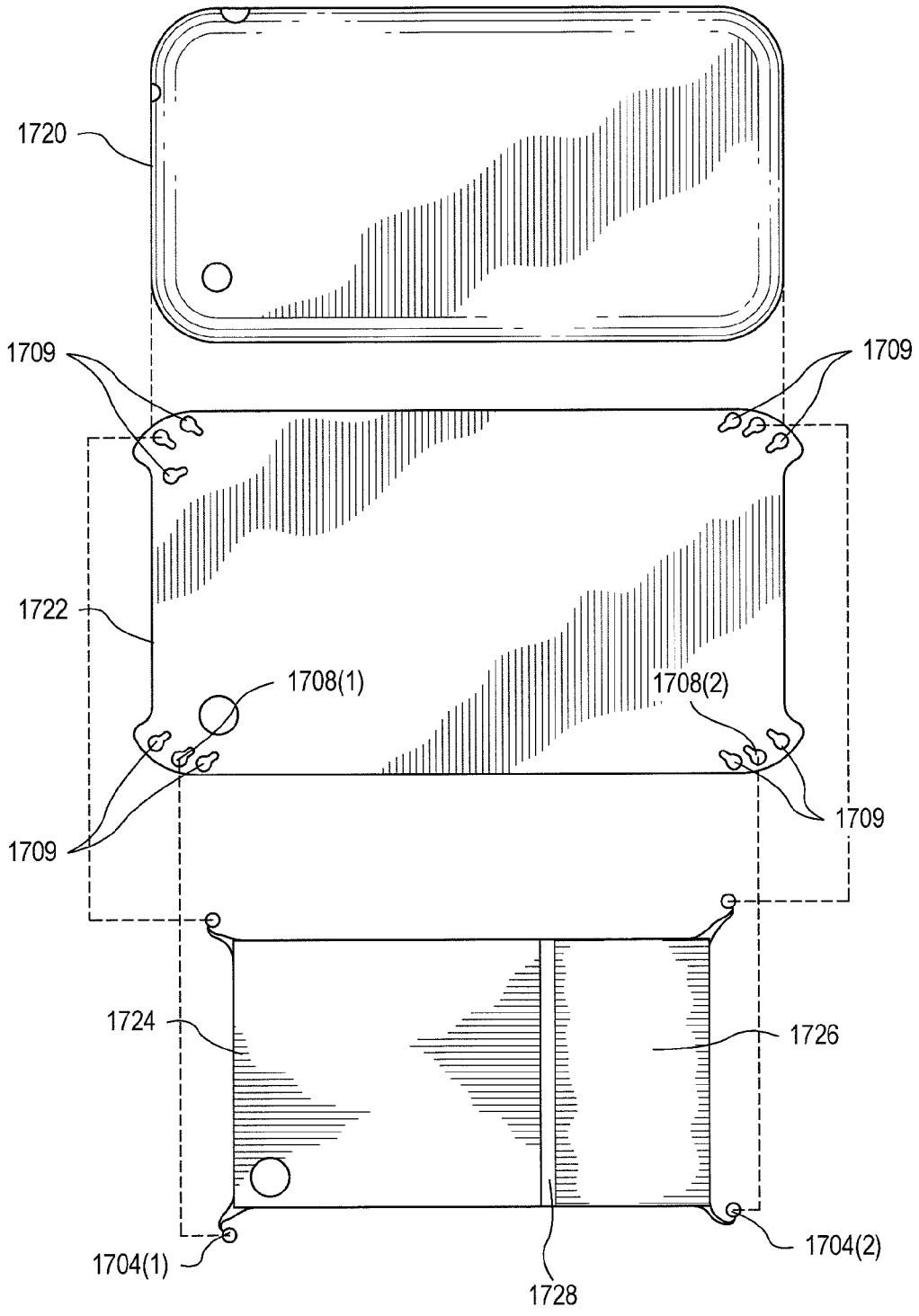

FIG. 68 shows DMD 1720 and a protective case 1722 that is similar to protective case 1706, but is formed with additional receptacles 1709 that allow adjustment of tension on a storage case 1724. Storage case 1724 is formed as a pocket of stretchable material 1726 that has an overlapping opening 1728, as shown. Although opening 1728 is shown vertical across a narrow width dimension of storage case 1724, opening 1728 may have other positions without departing from the scope hereof. Storage case 1724 may include cutouts that allow operation of DMD 1720 without removal of storage case 1724.

Figure 69:
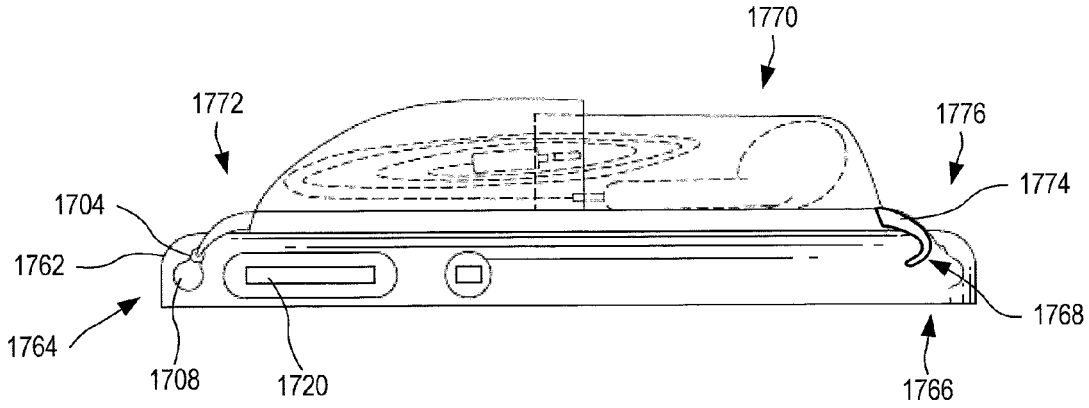

FIG. 69 shows an alternate embodiment wherein a first end 1764 of a protective case 1762 is formed with receptacles 1708 as described above, and a second end 1766 formed with a retention slot 1768. A storage case 1770, similar to storage case 1724 of FIG. 68, is formed with hooks 1704 at a first end 1772, and a retention clip 1774 at a second end 1776. Retention slot 1768 couples with retention clip 1774, for example by lateral sliding, and hooks 1704 couples with receptacles 1708 to removably secure storage case 1770 to protective case 1762.

In the example of FIG. 69, storage case 1770 is shown as a pocket formed of stretchable material, however, storage case 1770 may represent other storage cases such as storage cases 1500 and 1600, without departing from the scope hereof.

FIGS. 70-73 show one exemplary hard shell carrying case 1800 formed as an earphone storage case 1801 and DMD protection case 1802 that couple together. FIGS. 70-73 are best viewed together with the following description.

Figure 70:
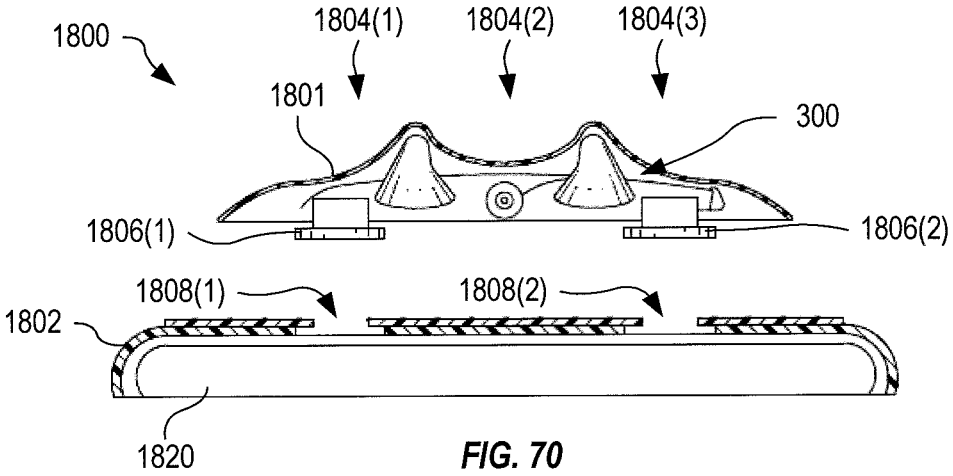
FIGS. 70-73 are various views showing one exemplary hard shell carrying case formed as an earphone storage case and DMD protection case that couple together, in an embodiment.
Figure 71:
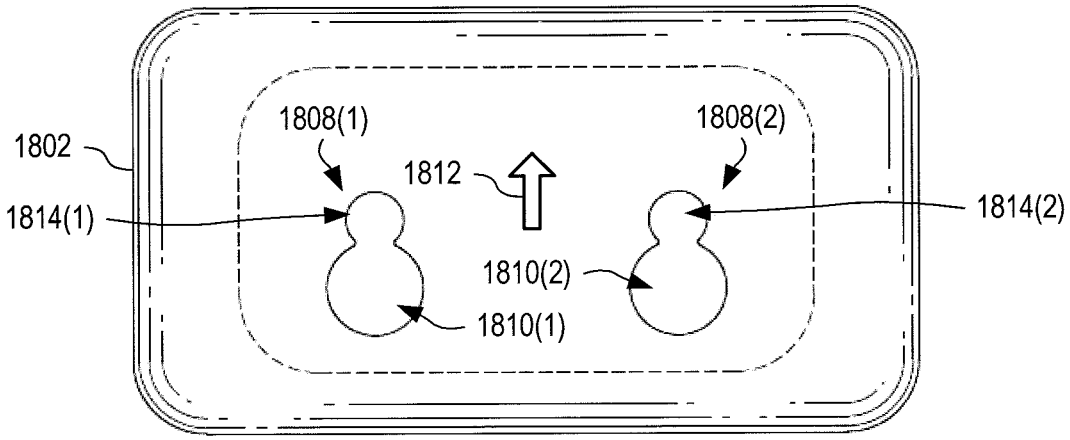
Figure 73:
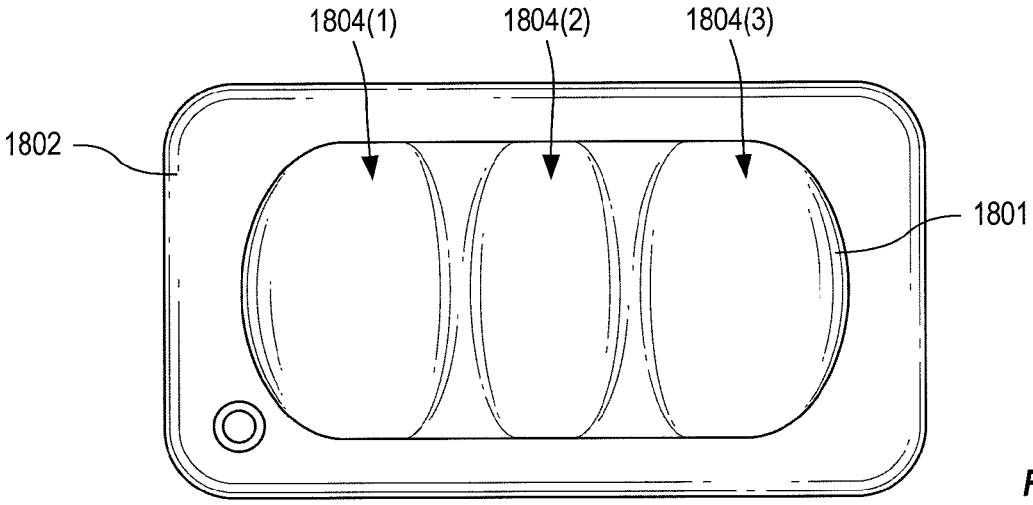

Storage case 1801 is substantially hollow and an earphone set (e.g., earphone set 300 of FIG. 3) may be stored therein. The example of FIG. 70 shows earphone set 300 stored within storage case 1801. Storage case 1801 includes two retention posts 1806(1) and 1806(2) that couple with retention slots 1808(1) and 1808(2) of case 1802, respectively. To couple storage case 1801 to case 1802, retention posts 1806 are inserted into receiving areas 1810 of retention slots 1808, and then storage case 1801 is slid laterally in the direction of arrow 1812 such that retention posts 1806 are retained by locking areas 1814 of retention slots 1808. To remove storage case 1801 from case 1802, this process is reversed.

Figure 72:
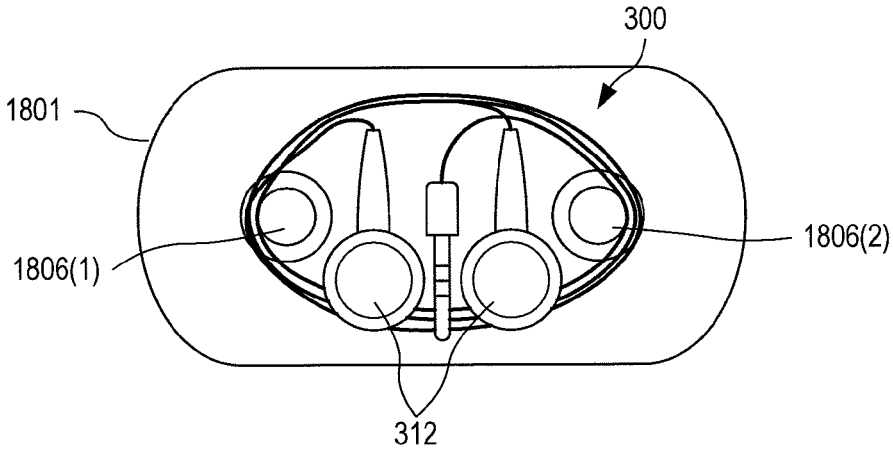
Figure 74:
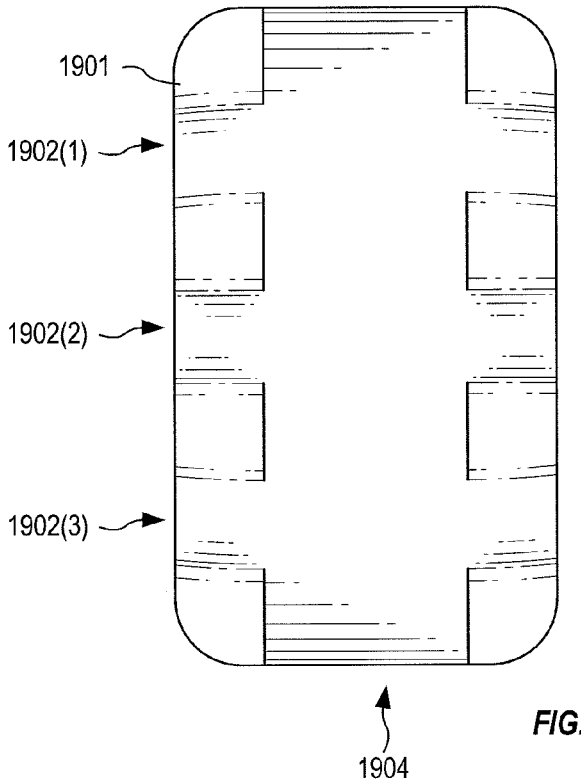
FIGS. 74-77 show one exemplary hard shell carrying case that is similar to the earphone storage case of FIGS. 70-73 but formed with a flat slot across the finger grips to accommodate a hand strap used with DMD, in an embodiment.
Figure 75:
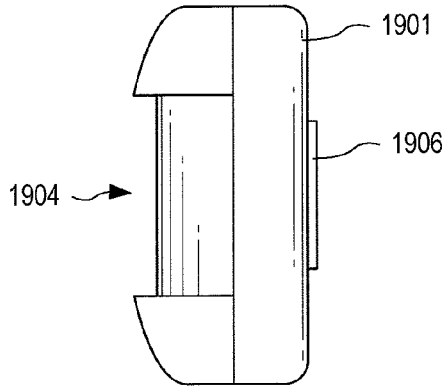

FIG. 72 is a bottom view of storage case 1801 illustrating winding of earphone set 300 around retention posts 1806 such that earphone set 300 are stored within storage case 1801.

Storage case 1801 is ergonomically shaped such that when attached to protection case 1802, DMD 1820 within case 1802 may still be held and operated comfortably by a user. Storage case 1801 has finger grips 1804(1-3) that allow the user to grip DMD 1820, case 1802 and storage case 1801 when combined, with or without an earphone set stored within storage case 1801.

Figure 76:
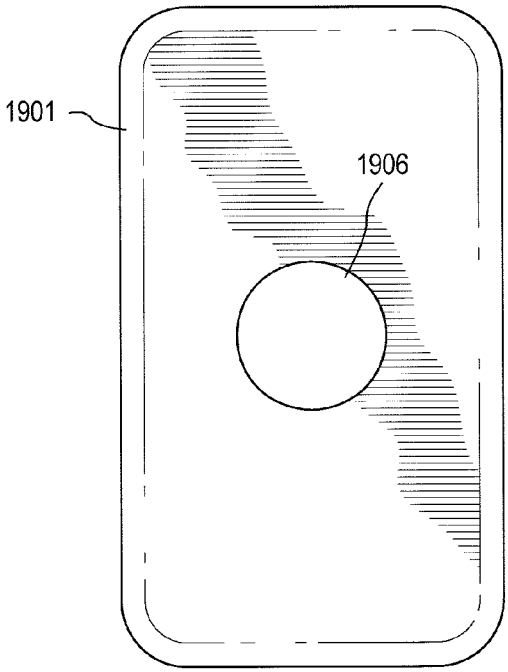
Figure 77:
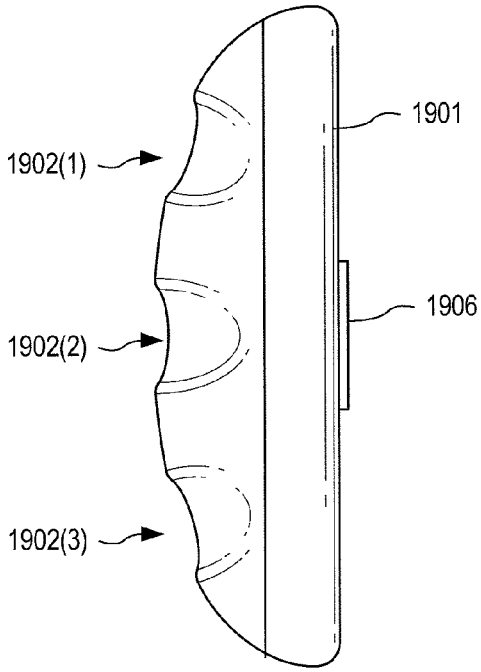

FIGS. 74-77 show one exemplary hard shell carrying case 1901 that is similar to earphone storage case 1801 of FIGS. 70-73, including finger grips 1902, but formed with a flat slot 1904 across finger grips 1902 to accommodate a hand strap (not shown) as may be used with DMDs (e.g., DMD 1820). Case 1901 may couple with a DMD, or a protective case of the DMD, using coupling means known in the art. In the example of FIG. 76, case 1901 includes a coupling post 1906 that slots into a receptacle formed on the back of a protective case (not shown) of the DMD.

Figure 78:
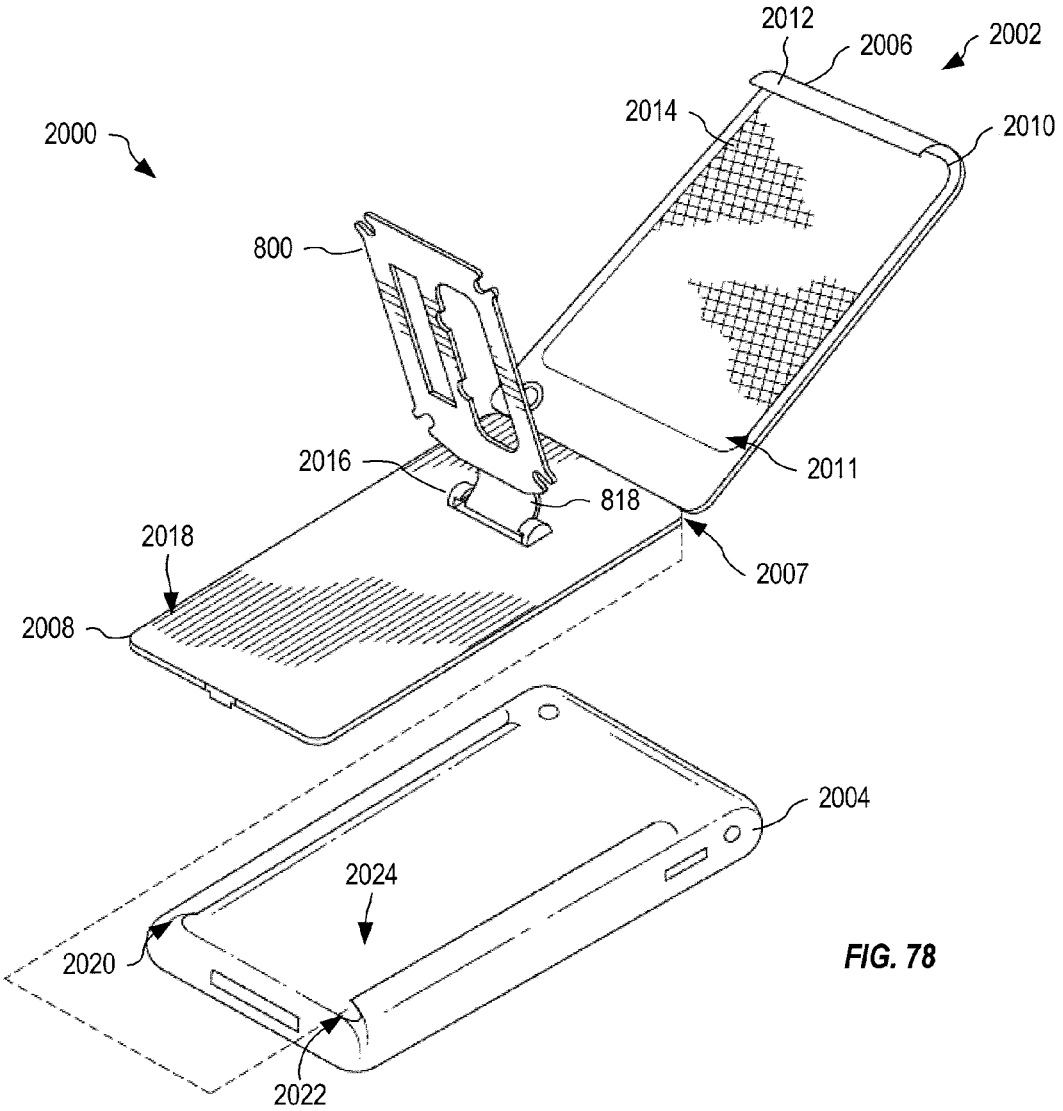
FIG. 78 is a perspective assembly view showing one exemplary earphone storage and DMD protection case with a slide coupling between a storage compartment and a protective DMD case, in an embodiment.
Figure 79:
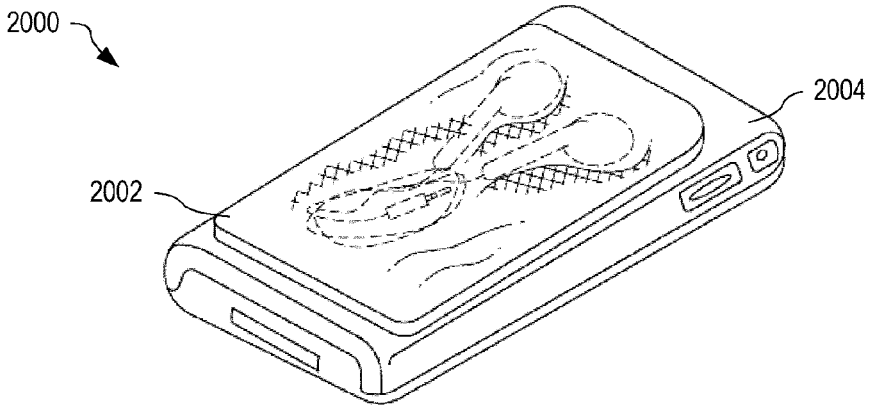
FIG. 79 shows a complete and final assembly of the earphone storage and DMD protection case shown in FIG. 78.
Figure 80:
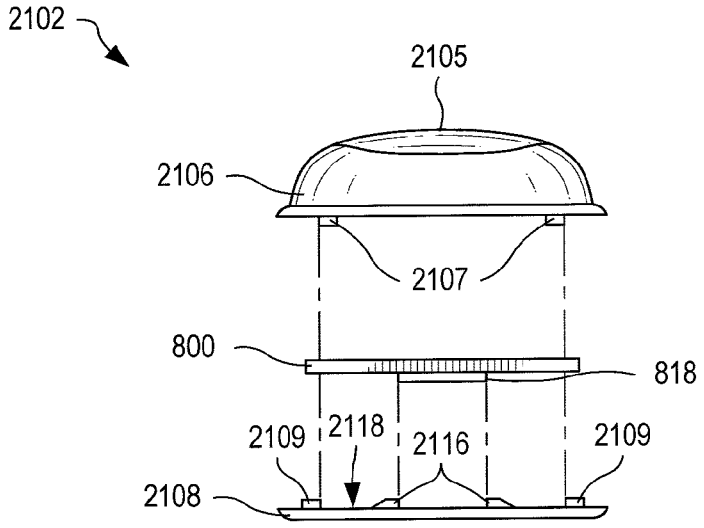
FIGS. 80-82 and 83 are end and bottom views, respectively, showing one exemplary hard shell earphone storage and DMD protection case with a slide coupling between a storage compartment and a protective DMD case, in an embodiment.

FIGS. 78 and 79 show one exemplary earphone storage and DMD protection case 2000 with a slide coupling between a storage compartment 2002 and a protective DMD case 2004, and are best viewed together with the following description.

Storage compartment 2002 is formed with a lid component 2006 and a base component 2008. Base component 2008 is a substantially flat and rigid rectangular sheet. Lid component 2006 includes a substantially flat and rigid rectangular former 2010 that may include a latch mechanism 2012. Former 2010 has a cutout 2011 that is covered by a stretchable material 2014. Former 2010 is attached along a short edge to base component 2008 by a hinge 2007. Base component 2008 includes a hinge attachment 2016 on an inside surface 2018 of storage compartment 2002 for attaching to connector 818 of earphone retaining clip 800, FIGS. 23-25, for example, such that clip 800 is retained within storage compartment 2002. In one embodiment, hinge 2016 is slotted such that clip 800 may detach to facilitate winding of an earphone set onto clip 800.

Protective DMD case 2004 is similar to other protective cases for DMDs, known in the art, but includes two additional slots 2020 and 2022 formed on a back surface 2024. Slots 2020 and 2022 are configured to allow base component 2008 to slide into slots 2020 and 2022 such that storage compartment 2002 removably couples with case 2004, as shown in FIG. 79.

FIGS. 80-83 show one exemplary hard shell earphone storage and DMD protection case 2100 with a slide coupling between a storage compartment 2102 and a protective DMD case 2104.

Figure 81:
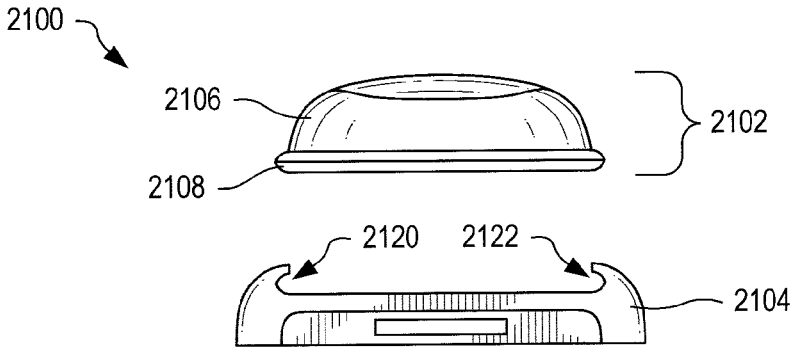

Storage compartment 2102 is formed with a lid component 2106 and a base component 2108. Base component 2108 is a substantially flat and rigid rectangular sheet. Lid component 2106 is formed as a rigid shell with a plurality of keying features 2107. Lid component 2106 may be formed of two or more pieces that are combined, for example to include a transparent portion 2105 that allows a user to see contents of case 2100 when closed. Base component 2108 includes a plurality of keying features 2109 that mate with keying features 2107 of lid component 2106 as shown in FIG. 81. Base component 2108 may include a hinge attachment 2116 on an inside surface 2118 of storage compartment 2102 for attaching to connector 818 of earphone retaining clip 800 of FIGS. 23-25 for example, such that clip 800 is retained within storage compartment 2102. In one embodiment, hinge 2116 is slotted such that clip 800 may detach to facilitate winding of the earphone set onto clip 800.

Figure 82:
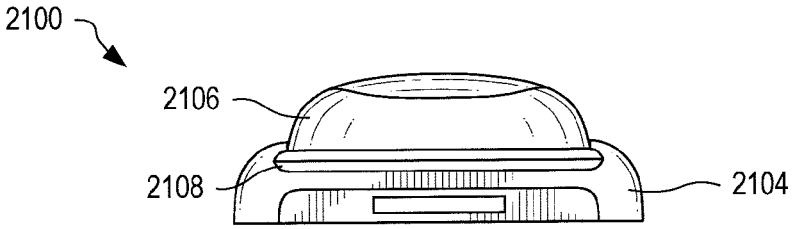

Protective DMD case 2104 is similar to protective DMD case 2004 of FIGS. 78-79 and includes slots 2120 and 2122 configured to allow storage compartment 2102 (i.e., lid component 2106 and base component 2108 couples together) to slide into slots 2120 and 2122 such that storage compartment 2102 removably couples with case 2104, as shown in FIG. 82. When coupled with case 2104, lid component and base component 2108 are also secured together by slots 2120 and 2122.

Figure 83:
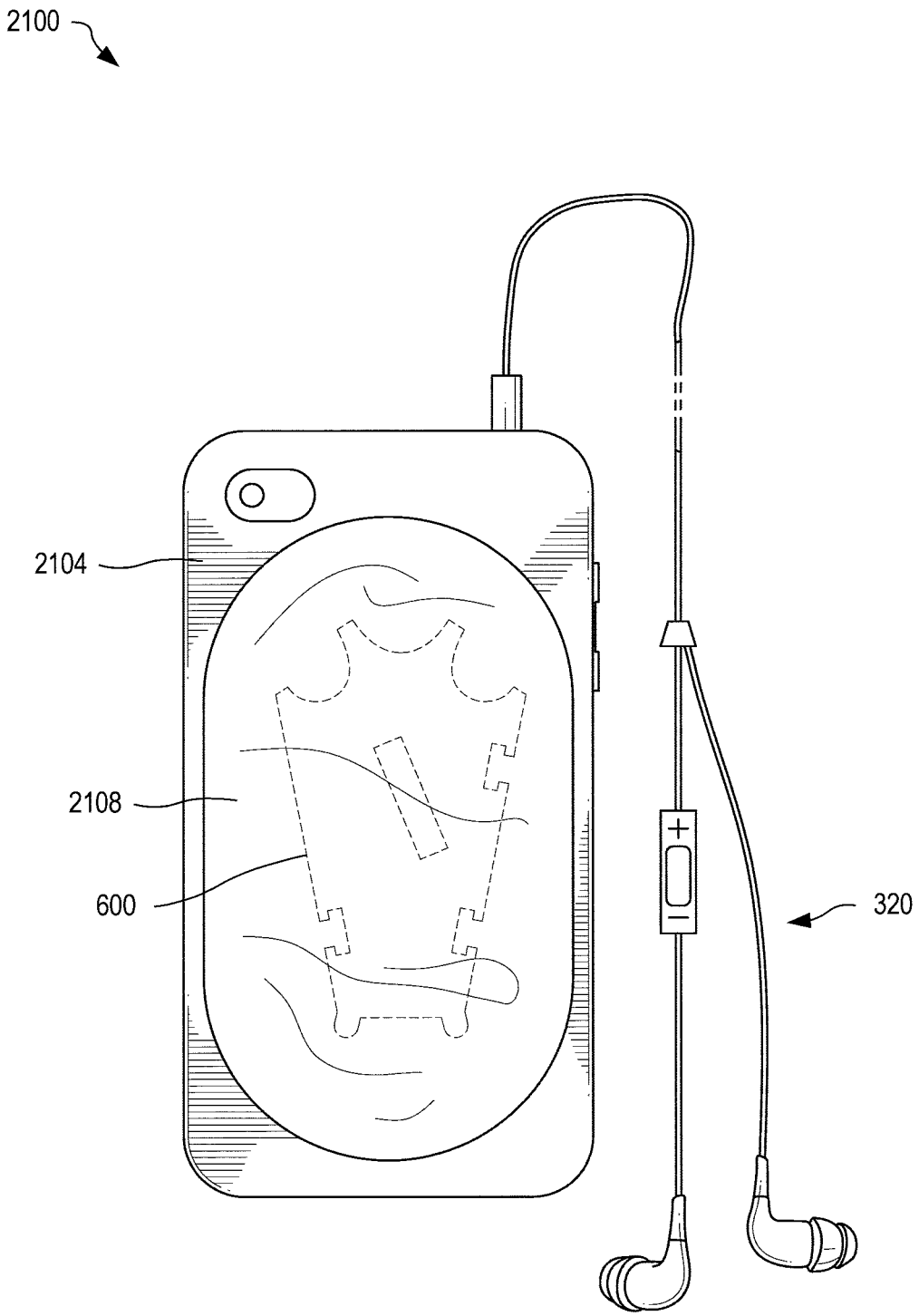

FIG. 83 shows hard shell earphone storage and DMD protection case 2100 storing earphone retaining clip 600 of FIGS. 9-14 wherein earphone set 300 are connected to the DMD and ready for use.

Figure 84:
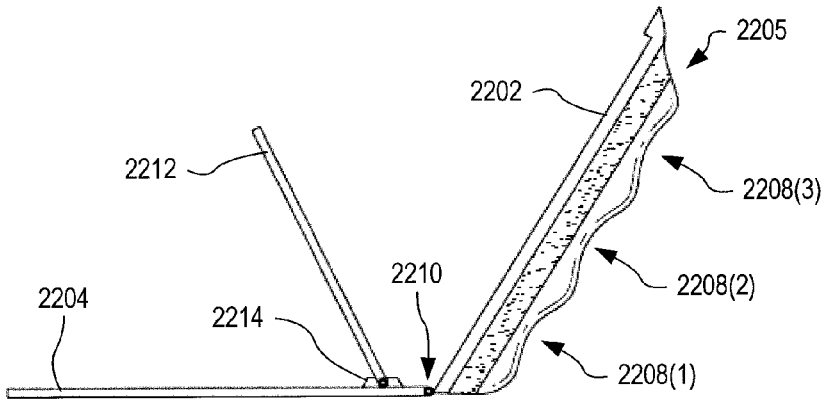
FIGS. 84-86 are various views of one exemplary hard shell earphone storage and DMD protection case with a slide coupling between a storage compartment and a protective DMD case, in an embodiment.
Figure 85:
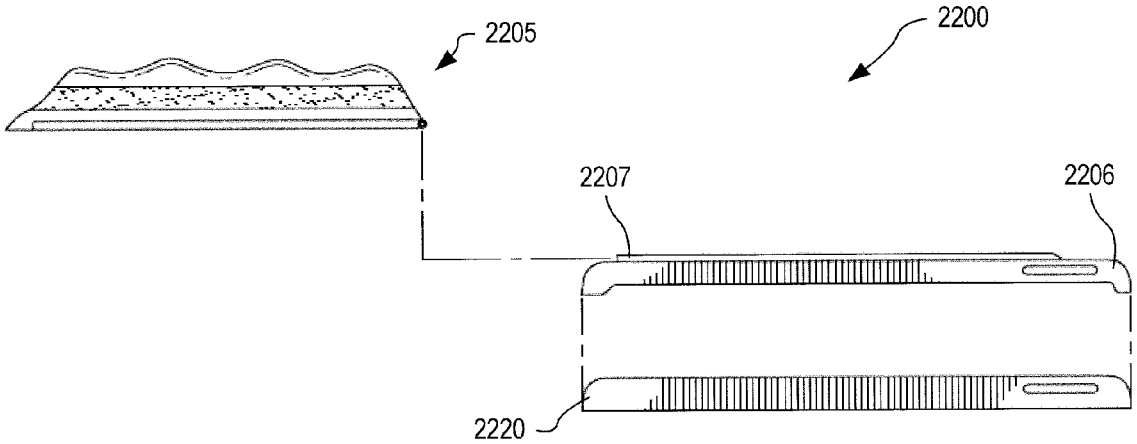
Figure 86:
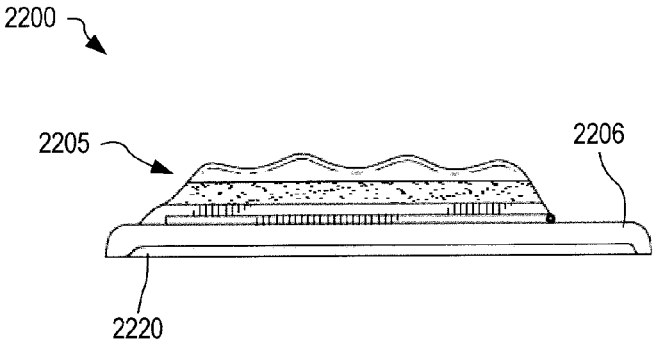

FIGS. 84-86 show one exemplary hard shell earphone storage and DMD protection case 2200 with a slide coupling 2207 between a storage compartment 2205 and a protective DMD case 2206 of a DMD 2220. FIGS. 84-86 are best viewed together with the following description. Storage compartment 2205 includes a lid component 2202 and a base component 2204 that are coupled by a hinge 2210, and a retaining clip 2212 that is coupled with base component 2204 by a hinge 2214. Base component 2204 slides into slide coupling 2207 of protective case 2206 such that storage compartment 2205 removably couples with protective case 2206 and thereby to DMD 2220.

The embodiment of FIGS. 84-86 is similar to the embodiments of FIGS. 78-82, except that lid component 2202 is a hard shell formed with finger grips 2208(1-3) that facilitate holding of case 2200, protective case 2206, and DMD 2220, in one hand when coupled together.

Figure 87:
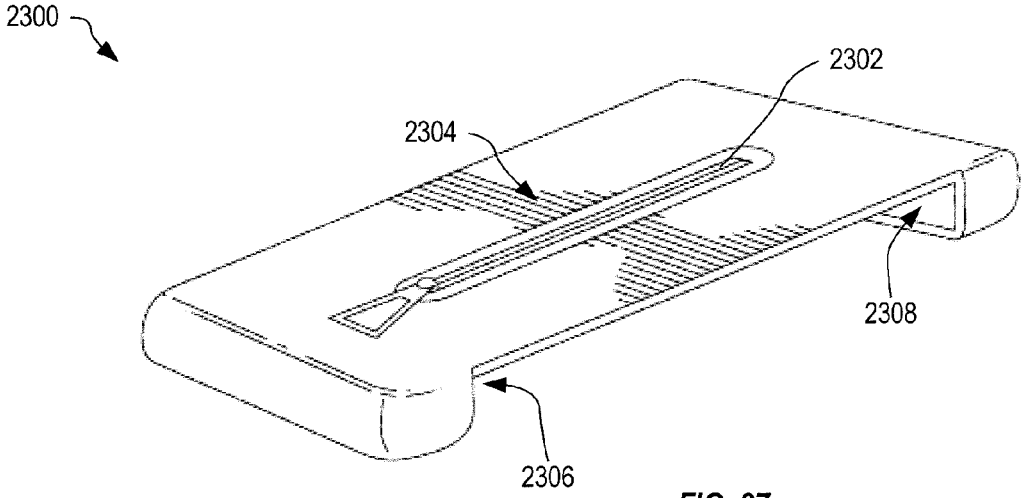
FIGS. 87-89 are various views of one exemplary zippered storage case for protecting a DMD and storing accessories, in an embodiment.
Figure 88:
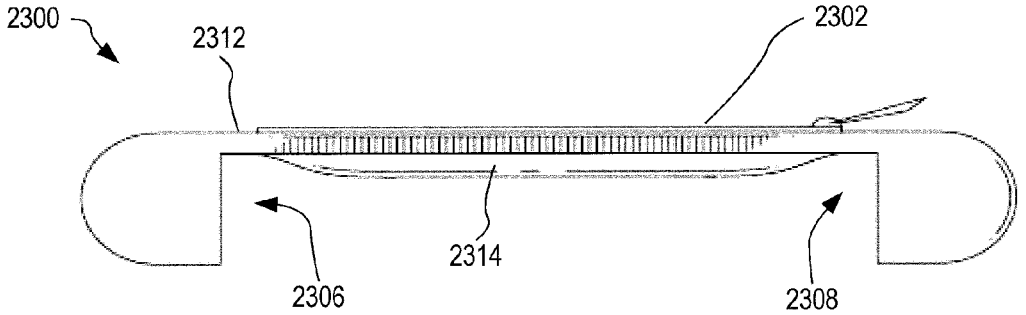
Figure 89:
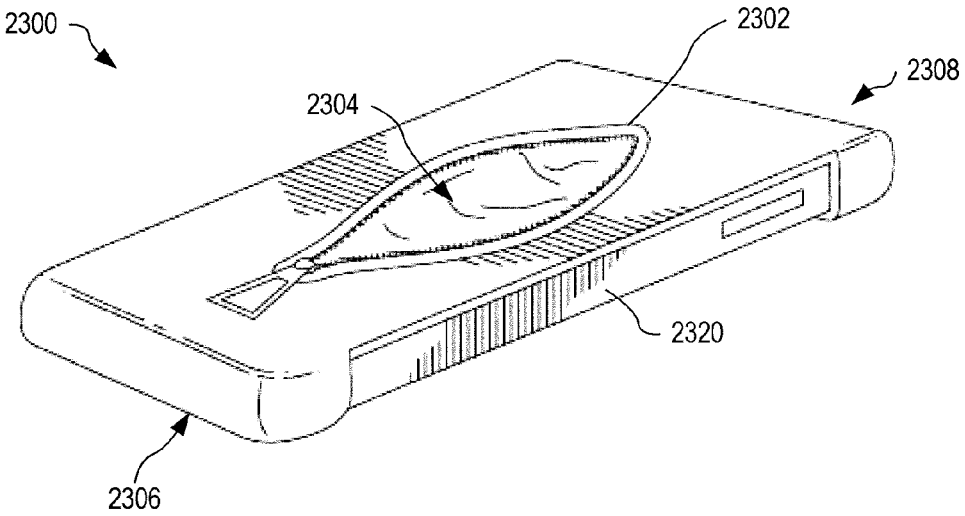

FIGS. 87-89 shows one exemplary zippered storage case 2300 for protecting a DMD and storing accessories, in an embodiment. FIGS. 87-89 are best viewed together with the following description. Storage case 2300 includes a zipper 2302 that provides an opening into a storage area 2304 between a top stretchable material 2312 and a bottom stretchable material 2314 that couple together to form case 2300.

Stretchable material of storage case 2300 is selected from the group including neoprene, Yamamoto neoprene "limestone based", rubber, elastic, pleated material, and so on. Case 2300 includes first and second external pockets 2306 and 2308 that allow case 2300 to attach to a DMD 2320, as shown in FIG. 89. In particular, first pocket 2306 and second pocket 2308 may be stretched to fit over opposite ends of DMD 2320 such that DMD 2320 is protected by case 2300. Case 2300 may be easily attached and detached to and from DMD 2320. In one embodiment, storage case 2300 is formed from a single folded sheet of stretchable material that is shaped to form storage area 2304 and pockets 2306 and 2308. In another embodiment, pockets 2306 and 2308 are formed of a more rigid material and conform to the shape of corresponding ends of DMD 2320. In one embodiment, pockets may be split midline, with mid-lengths removed and thus not continuous so as to couple with the DMD at the corners. In another embodiment, corners may be omitted, leaving only a mid-length portion to capture a DMD at the sides and top and bottom, using spring retention built-in to the mid-length or relying on the elasticity of the attached storage compartment to maintain grip of the DMD.

Zipper 2302 allows items to be stored securely within case 2300, whether attached to DMD 2320 or not. Specifically, since case 2300 is fabricated from a stretchable material, storage area 2304 stretches to fit items stored therein. For example, storage area 2304 may be used to store an earphone set (e.g., one of earphone sets 300, 320, 360 of FIGS. 1-4) wound onto one of clips 500, 600, 700, 800, 900, 1000, 1100, 1200, and 2900 of FIGS. 5-53, and 116-121, respectively. In one example, clips 1000, 1100 and 1200 may be used with case 2300 to provide additional protection for the earphone set wound thereon and stored within storage area 2304. When the earphone set is in use, these clips may be stored within storage area 2304 that remains substantially flat, thereby allowing unimpeded use of DMD 2320.

In one embodiment, zipper 2302 is omitted and an opening is instead formed on an underside 2310 of storage area 2304. At least one of pockets 2306, 2308 is removed from DMD 2320 to access this opening, however when coupled with DMD 2320 (i.e., pockets 2306 and 2308 are positioned on opposite ends of DMD 2320), items are securely stored within storage area 2304.

Figure 90:
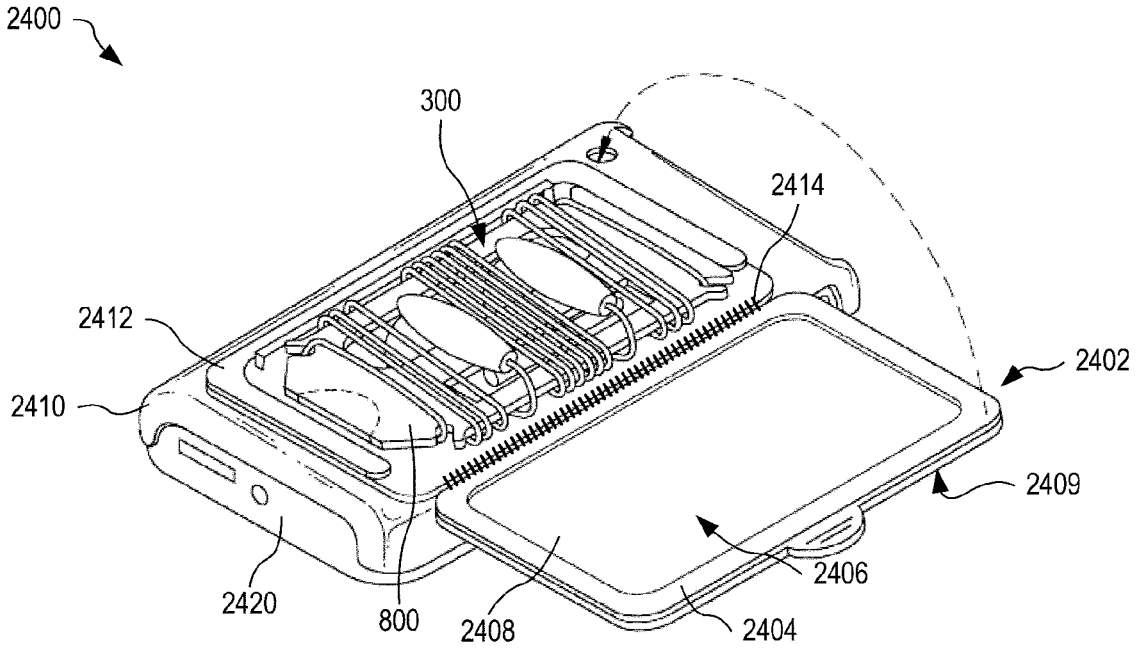
FIGS. 90 and 91 are perspective views of one exemplary combined earphone storage and DMD protection case coupled with a bottom surface of a DMD, in an embodiment.
Figure 91:
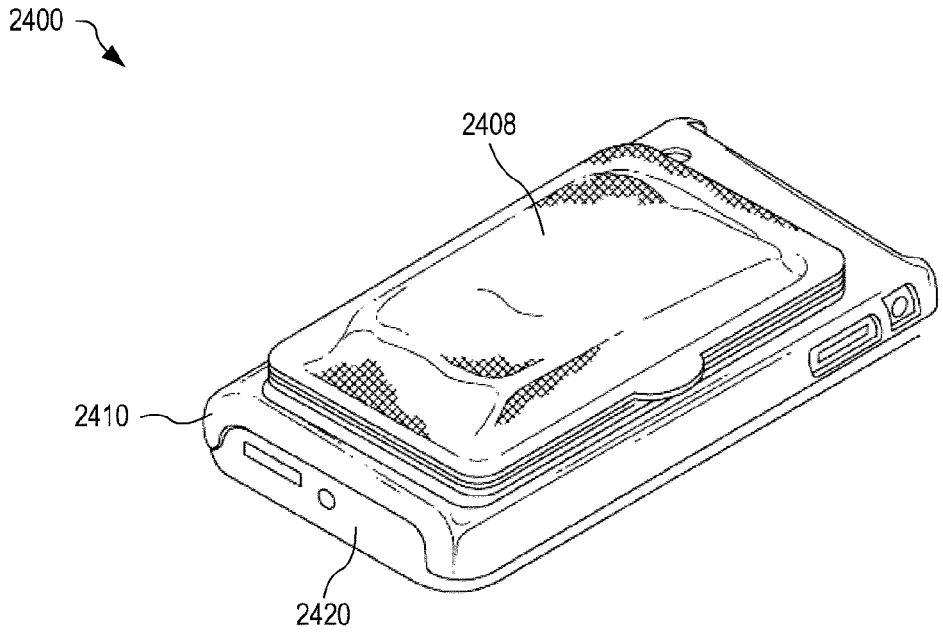
Figure 92:
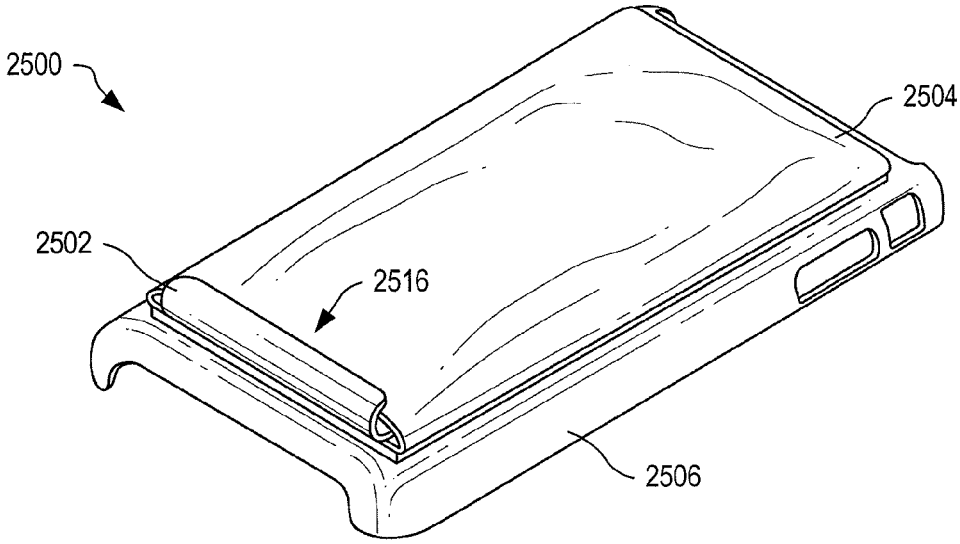
FIGS. 92-95 are perspective views of one exemplary earphone retaining clip for use with a stretchable cover integrated with a DMD protective case, in an embodiment.

FIGS. 90 and 91 show one exemplary combined earphone storage and DMD protection case 2400. Case 2400 includes a lid component 2402 that is substantially the same as lid component 1402 of FIG. 58; lid component 2402 includes a rectangular former 2404 with a cutout 2406 that is covered by a stretchable material 2408 attached to an external surface 2409 of former 2404. A base component 2410 is formed as a rigid DMD protective case (base component 2410 is shown coupled with a DMD 2420) and includes a seating area 2412 that mates with former 2404 of lid component 2402 when the lid component is closed. Lid component 2402 is attached to base component 2410 by a hinge 2414 that runs along a long edge of former 2404 and base component 2410 as shown. Lid component 2402 and/or base component 2410 may include one or more latching mechanisms, such as a spring and hinge combination, a mechanical catch built into one or both of former 2404 and base component 2410, hook and loop fasteners (e.g., Velcro™) formed on former 2404 and seating area 2412, and a magnetic fastener coupled with former 2404 and seating area 2412, that operates to keep case 2400 closed.

When storing an earphone set wound onto a retaining clip (e.g., earphone set 300 of FIG. 1 wound onto clip 800 of FIG. 24 as shown in FIG. 90), stretchable material 2408 is deformed when lid component 2402 is closed, as shown in FIG. 91.

On one embodiment, base component 2410 is molded to receive the earphone set and the earphone retaining clip to facilitate storage of the earphone set and reduce height of the case 2400 when the earphone set is stored therein.

Figure 93:
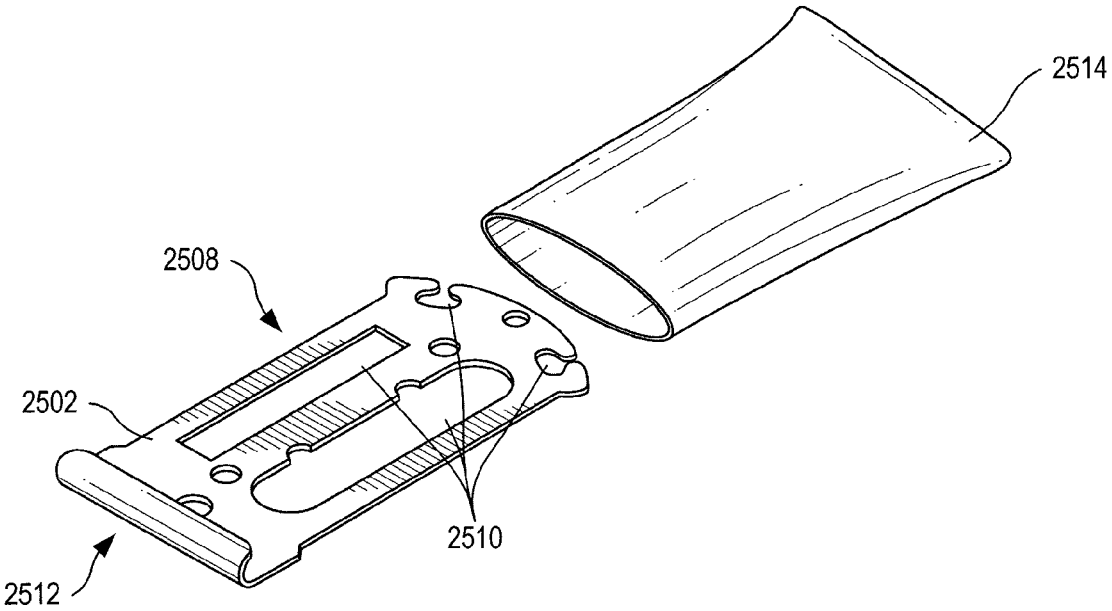
Figure 94:
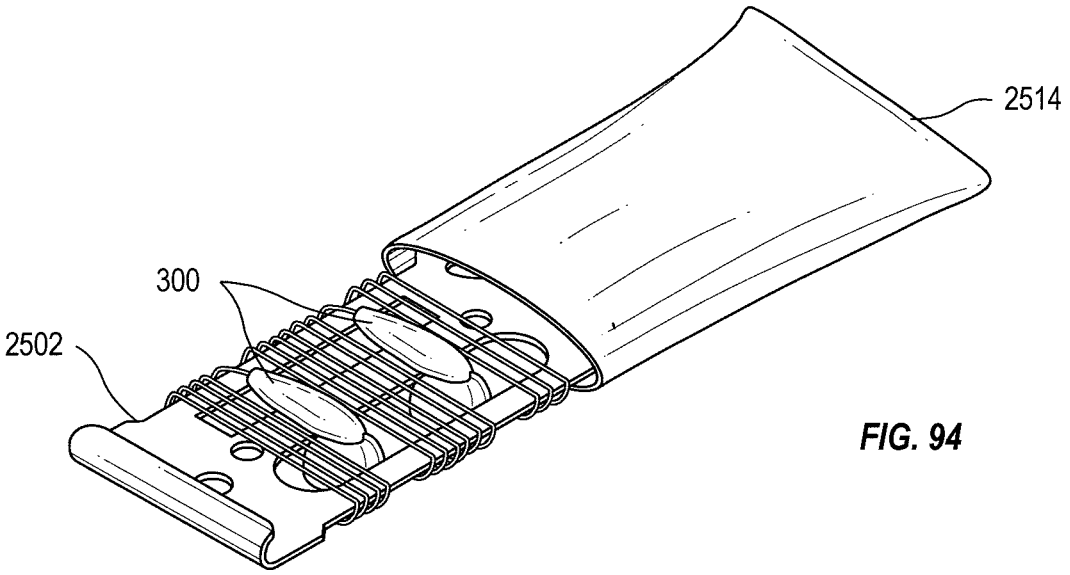
Figure 95:
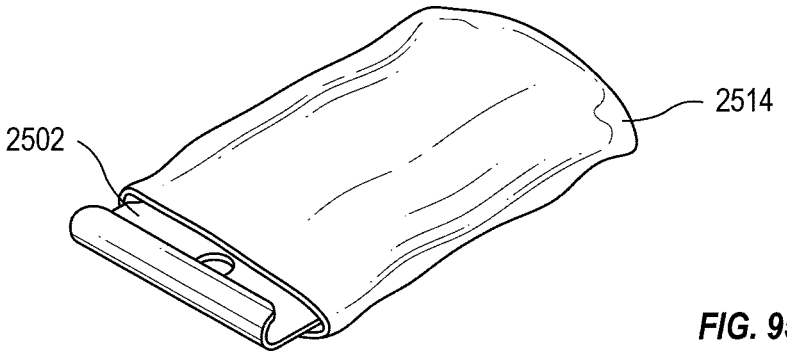
Figure 96:
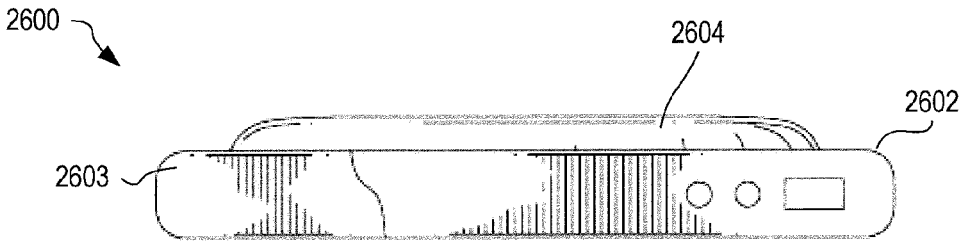
FIGS. 96-104 and 105 are side views and a perspective view, respectively, of one exemplary split storage and protective case 2600 that protects a DMD and provides storage for an earphone set, in an embodiment.
Figure 97:
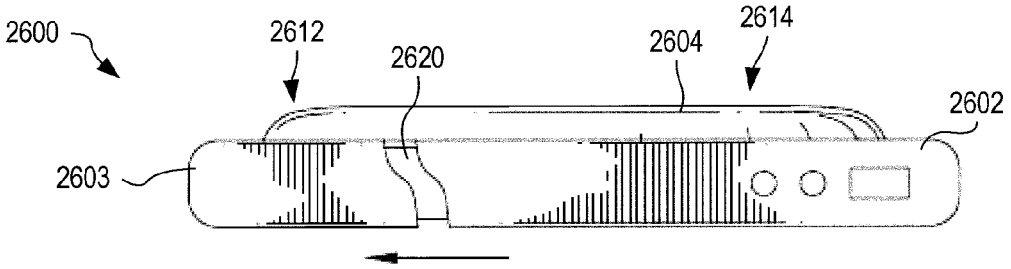
Figure 98:
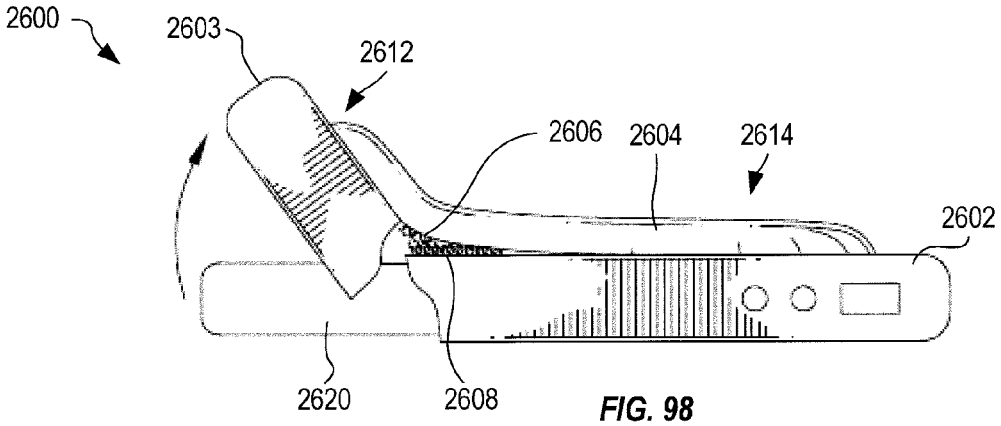
Figure 99:
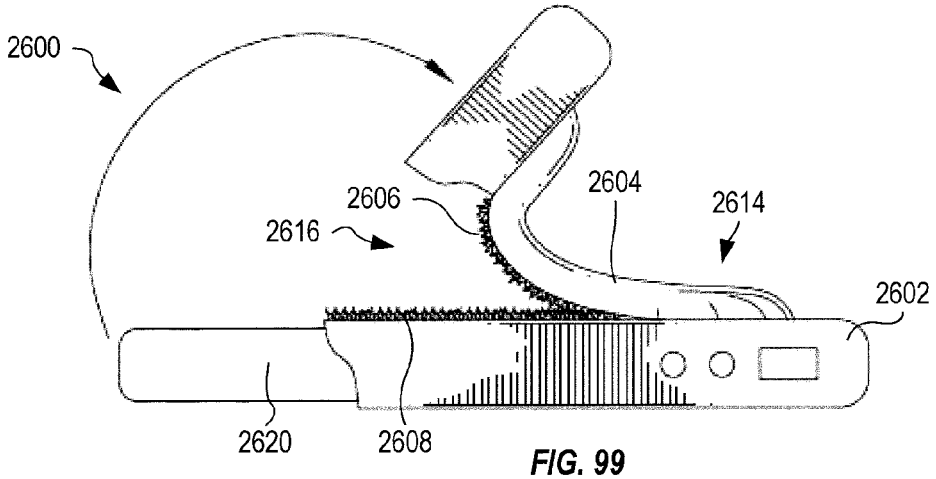

FIGS. 92-95 show one exemplary earphone retaining clip 2502 for use with a stretchable cover 2504 integrated with a DMD protective case 2506. As shown in FIG. 93, clip 2502 includes a winding area 2508 and a plurality of cutouts and notches 2510 that are similar to features of clip 800 of FIGS. 23-25. Clip 2502 may include other features without departing from the scope hereof. For example, clip 2502 may include an elastic band for retaining pouch 2514 and/or a wound earphone set. Clip 2502 also includes a handle 2512 that facilitate insertion and removal of clip 2502 from a pouch 2514. FIG. 94 shows clip 2502 wound with earphone set 300 of FIG. 1 and partially inserted into pouch 2514. FIG. 95 shows clip 2502 wound with earphone set 300 and fully inserted into pouch 2514. Pouch 2514 may be used together with cover 2504 to facilitate insertion and removal of clip 2502 when wound with an earphone set and to protect the earphone set from friction and abrasion during insertion and extraction. Clip 2502 may also be used with pouch 2514 when not inserted within cover 2504.

Cover 2504 is integrated with case 2506 and has one open end 2516 for insertion of clip 2502 and the stretchable material of cover 2504 securely retains clip 2502 when fully inserted. Cover 2504 is substantially flat when no items are stored within cover 2504 and conforms to a shape of the items when stored. Case 2506 is a rigid structure that is shapes and sized to fit a DMD and provide protection thereto.

FIGS. 96-105 show one exemplary split storage and DMD protective case 2600 that protects a DMD 2620 and provides storage for an earphone set (e.g., one of earphone sets 300, 320 and 360 of FIGS. 1-4). FIGS. 96-105 are best viewed together with the following description. Case 2600 includes a DMD protective portion 2602 and a stretchable material 2604 that forms a storage area when case 2600 is coupled with DMD 2620. Material 2604 is fixedly attached to protective portion 2602 at bottom location 2612 and at top location 2614, but not fixedly attached to protective portion 2602 at other locations. In one embodiment, material 2604 is co-molded into protective portion 2602 at locations 2612 and 2614.

As shown in FIGS. 96-99, protective portion 2602 has a detachable lower portion 2603 that may detach from DMD 2620 without requiring the entire protective portion 2602 to detach. Sides of material 2604 that are not fixedly attached to protective portion 2602 may include other non-permanent attachment means, such as hook 2606 and loop 2608 fastening (as shown), and magnetic fastening. When lower portion 2603 is detached from DMD 2620 and pulled back, as shown in 99, hook 2606 detaches from loop 2608 as shown. Material 2604 thereby acts as a hinge between lower portion 2603 and the remaining part of protective portion 2602.

Figure 100:
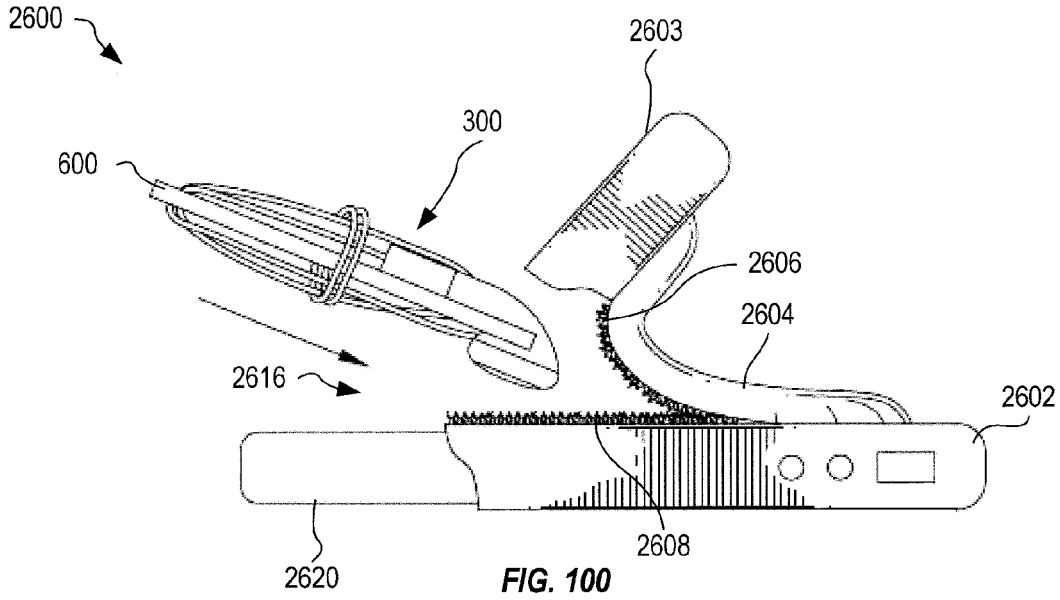
Figure 101:
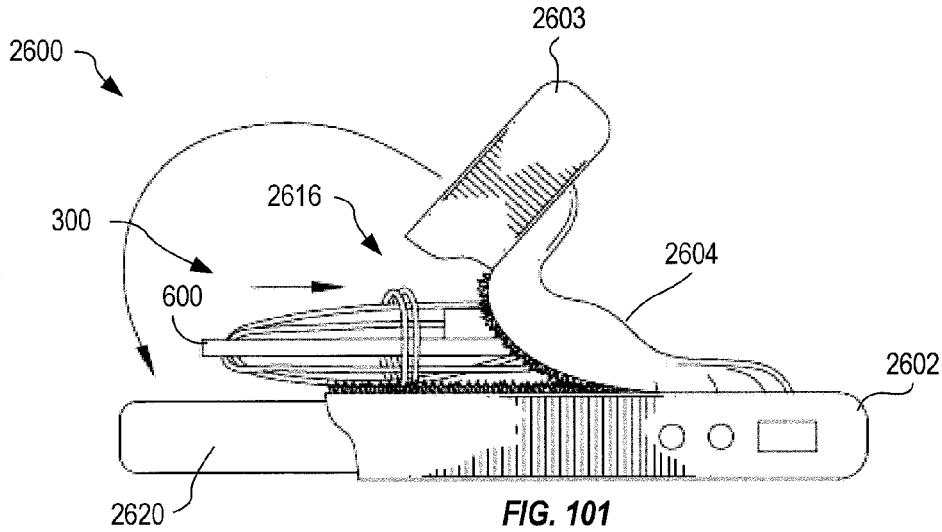
Figure 102:
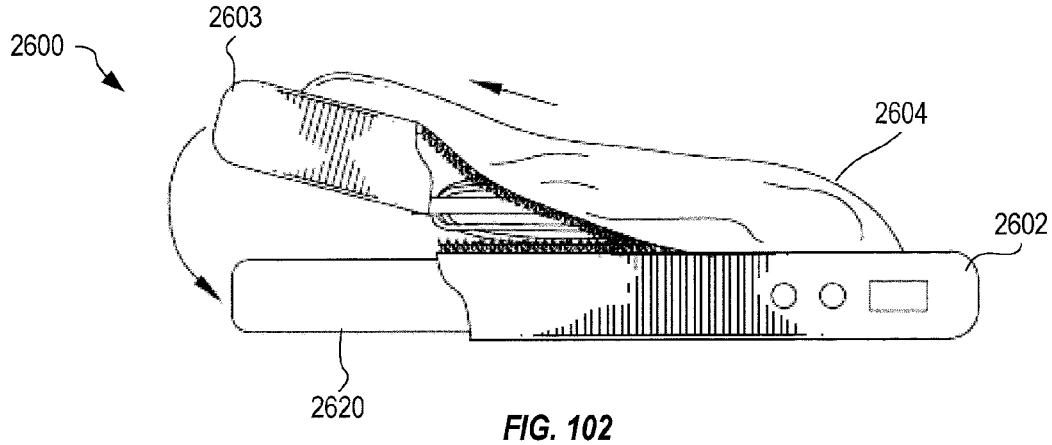
Figure 103:
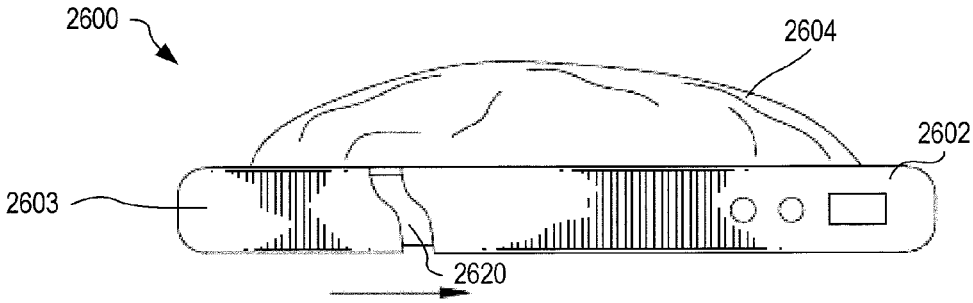

With lower portion 2603 removed from DMD 2620, earphone set 300 wound onto retaining clip 600 of FIGS. 96-105 may be inserted into a storage area 2616 of case 2600, as shown in FIGS. 100 and 101. Once the earphone set is inserted into storage area 2616, lower portion 2603 may be refitted to DMD 2620, wherein material 2604 is stretched over earphone set 300 and clip 600 as shown in FIGS. 102-105. Material 2604 also operates to retain protective portion 2602 onto DMD 2620.

Figure 104:
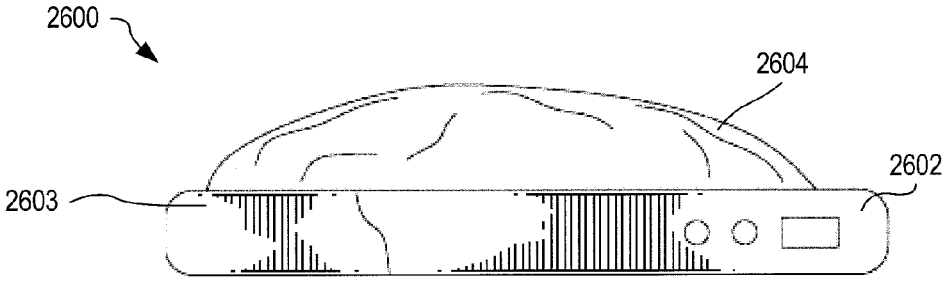
Figure 105:
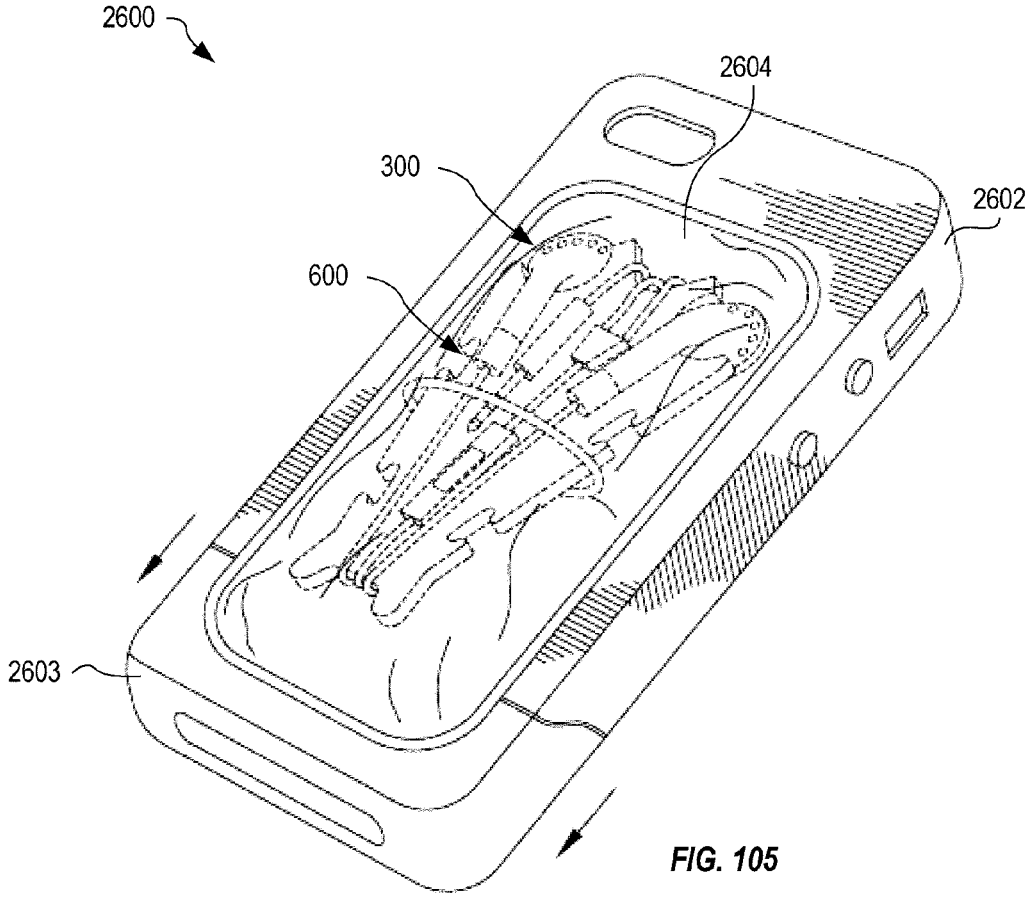

As shown in FIG. 104, stored earphone set 300 and retaining clip 600 results in a rounded shape 2618 that fits ergonomically within the palm of a hand holding DMD 2620, and does not inhibit operation of DMD 2620. FIG. 105 is a perspective view showing storage of earphone set 300 and clip 600 within case 2600.

Figure 106:
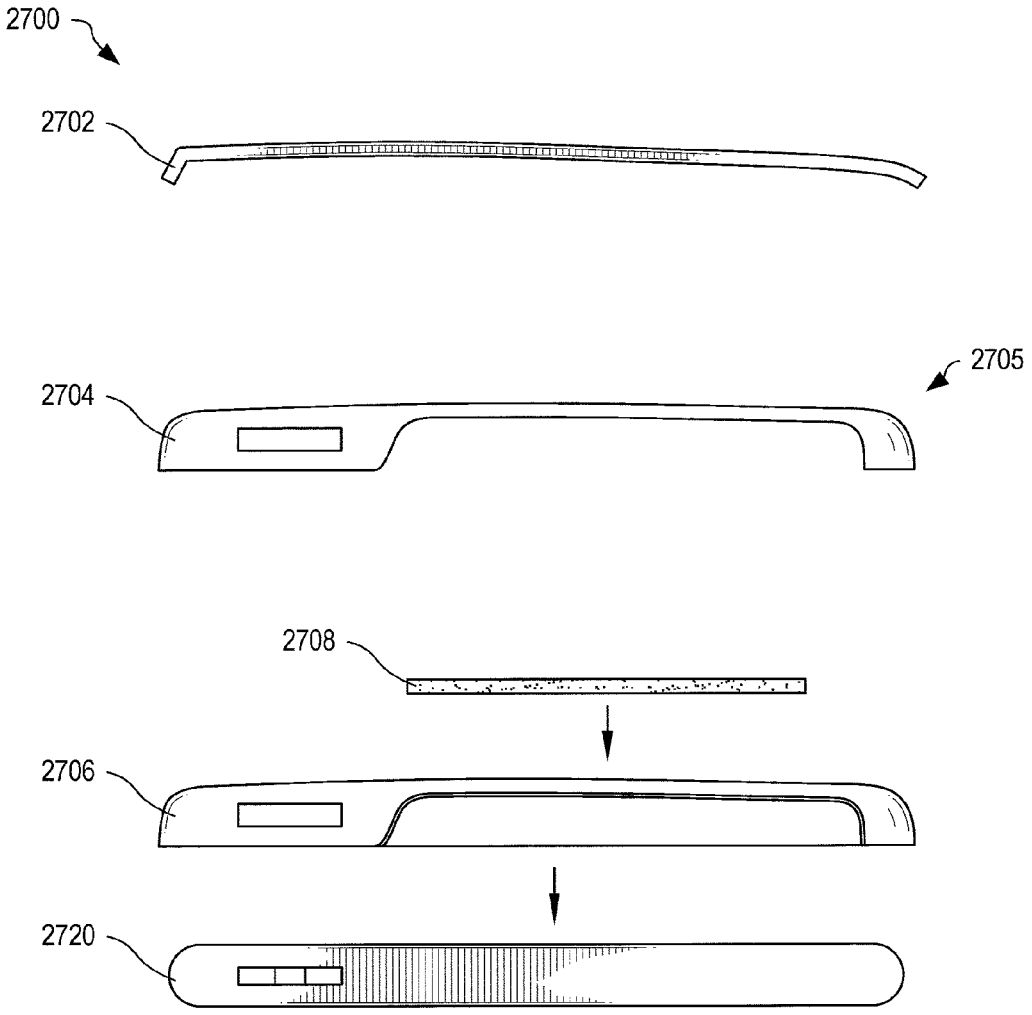
FIGS. 106-110 illustrate one exemplary sprung storage and protective case for a DMD, in an embodiment.
Figure 107:
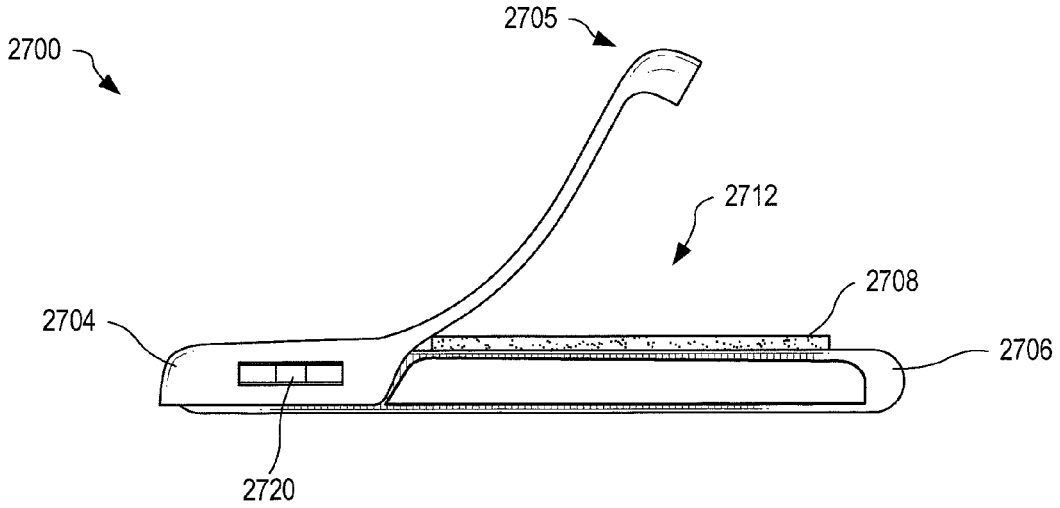

FIGS. 106-110 show one exemplary sprung storage and protective case 2700 for a DMD, in an embodiment. FIG. 106 is an exploded view showing a stretchable material 2702, a spring portion 2704, a base portion 2706, and an optional foam bed 2708 that couple together to form case 2700 that protects a DMD 2720, as shown in FIG. 107. Stretchable material 2702 fixedly attaches to an inside surface of spring portion 2704 and is for example made from one of oil based neoprene or limestone based neoprene such as Yamamoto neoprene, or other elastic material. In one embodiment, material 2702 covers an outer surface of spring portion 2704. In another embodiment, material 2702 is co-molded with spring portion 2704.

Spring portion 2704 is made from a semi-rigid spring like material that allows a first end 2705 to be pulled back as shown in FIG. 107. First end 2705 may also include a latch mechanism that latches end 2705 of spring portion 2704 to base portion 2706. Spring portion 2704 is fixedly attached to base portion 2706 at a second end 2707.

Figure 108:
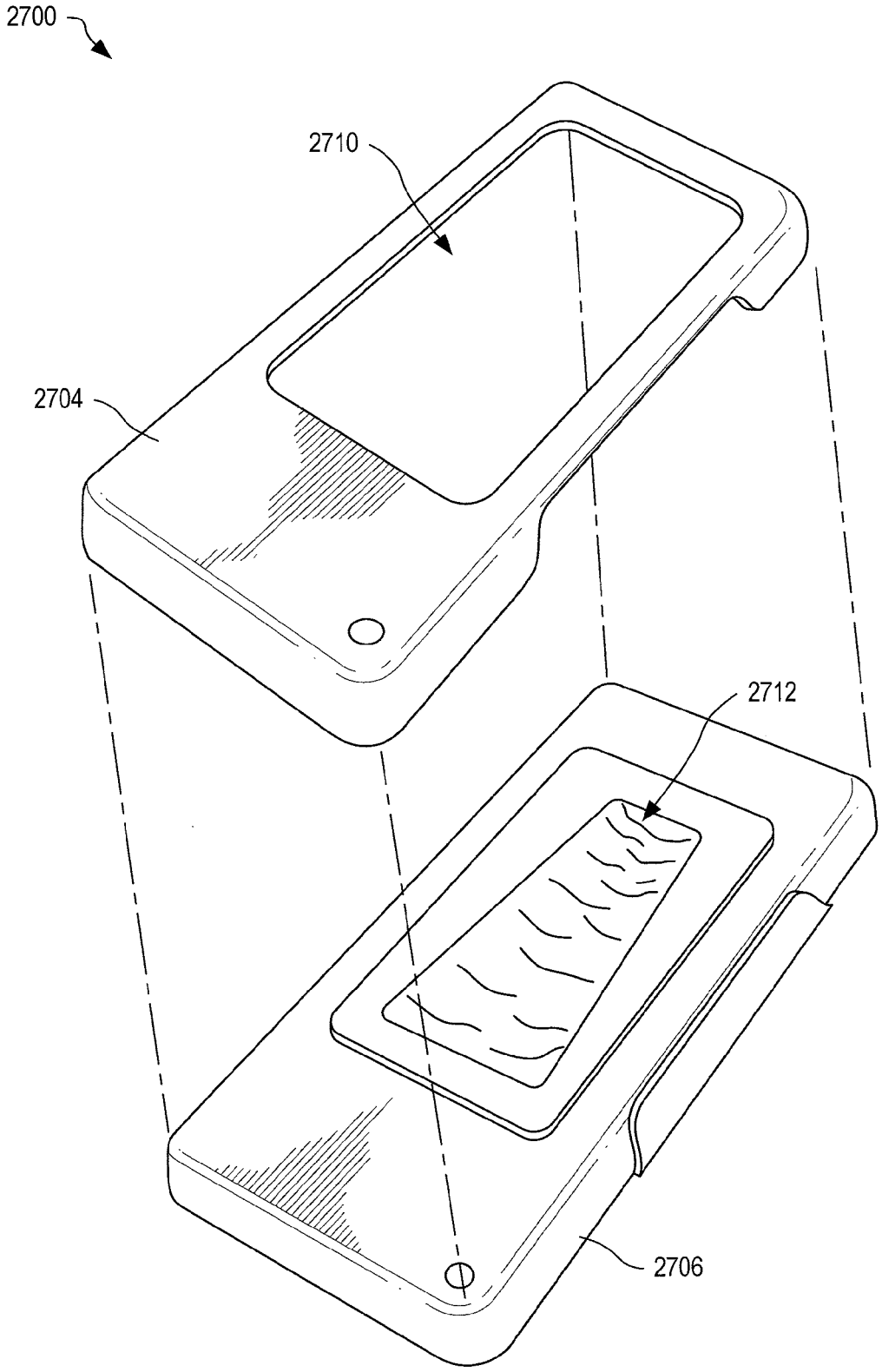
Figure 109:
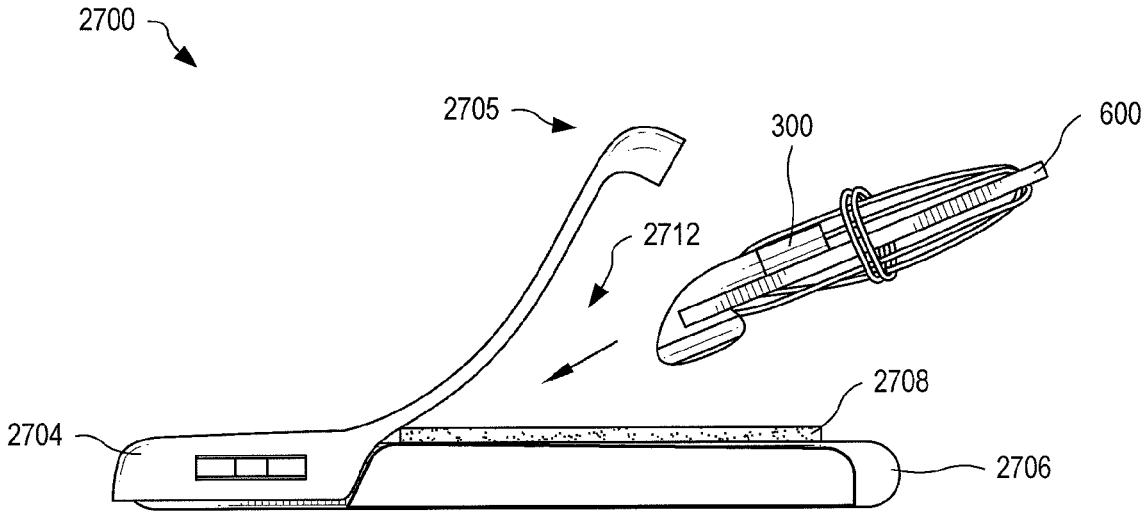
Figure 110:
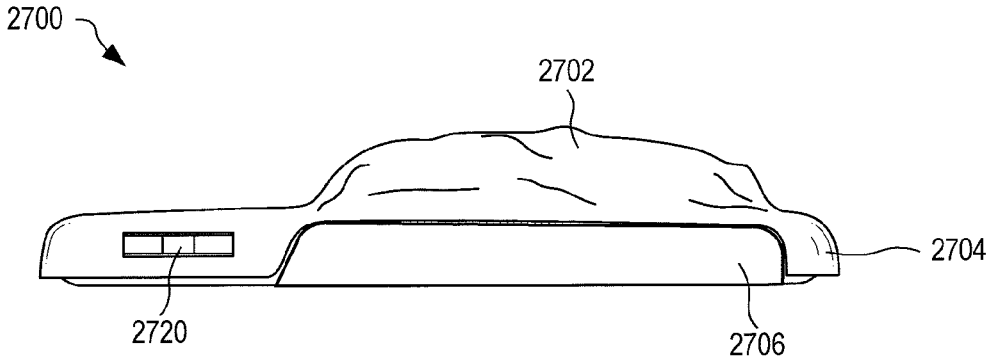

FIG. 108 is a perspective view showing spring portion 2704 positioned to couple with base portion 2706. Although not shown for clarity of illustration, material 2702 is located within an aperture 2710 within spring portion 2704. FIG. 109 shows exemplary earphone set 300 of FIG. 1 and retaining clip 600 of FIGS. 9-14 being inserted into storage area 2712. Once items are inserted into storage area 2712, end 2705 of spring portion 2704 is closed (and optionally latched) with base portion 2706, wherein material 2702 is deformed by earphone set 300 and clip 600, as shown in FIG. 110.

Items of any reasonable size may be stored within storage area 2712, wherein material 2702 extends only as much as needed to accommodate the stored item. Further, material 2702 and storage area 2712 are ergonomically positioned such that DMD 2720 may still be comfortably used when storing earphone set 300 and clip 600 for example. In particular, items within storage area 2712 are positioned within a palm of a hand when DMD 2720 is held for normal operation, and thereby do not restrict operation of DMD 2720.

In one embodiment, foam bed 2708 is shaped to receive earphone set 300 and clip 600 thereby providing a more secure and protective storage environment.

Figure 111:
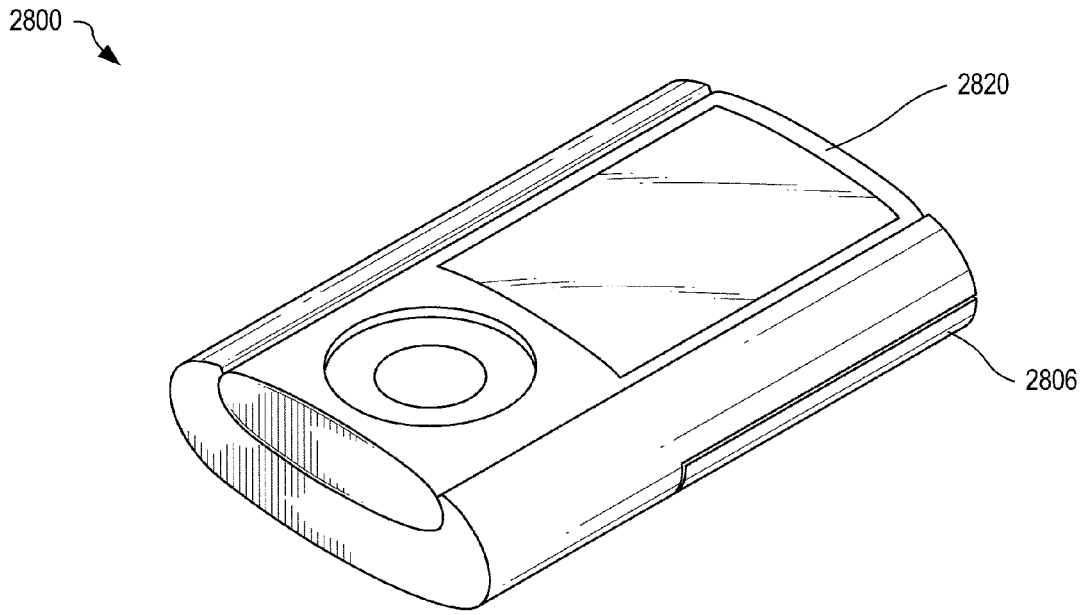
FIGS. 111-115 are various views of one exemplary integrated hard storage and protective case, in an embodiment.
Figure 112:
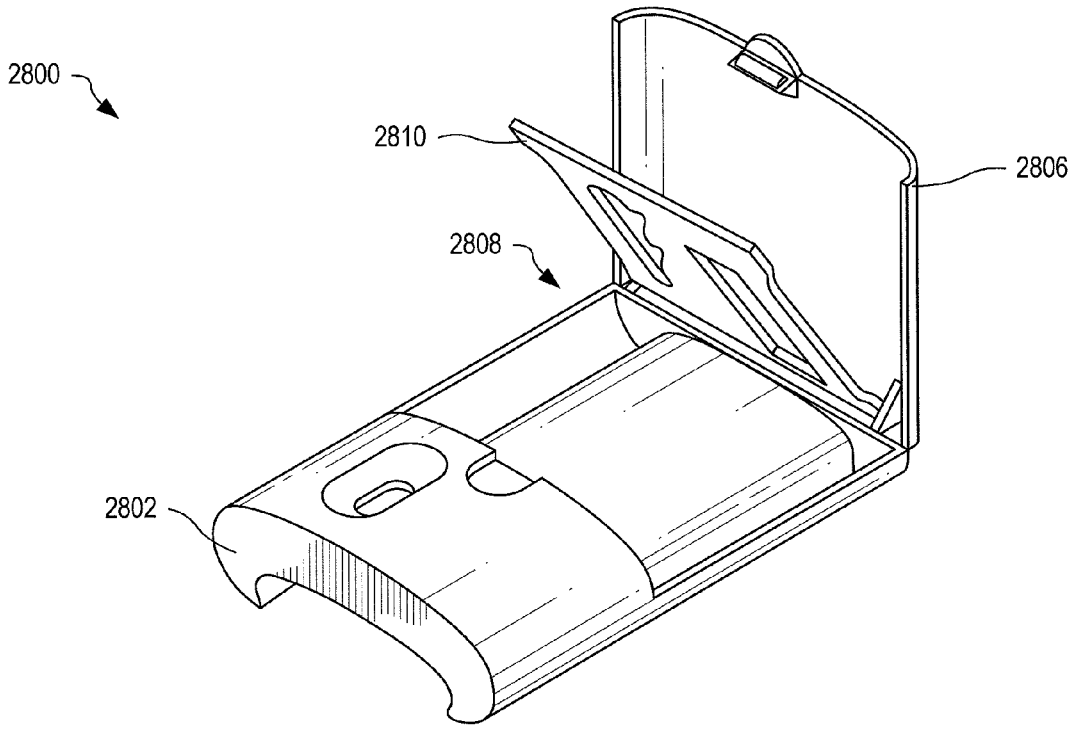
Figure 113:
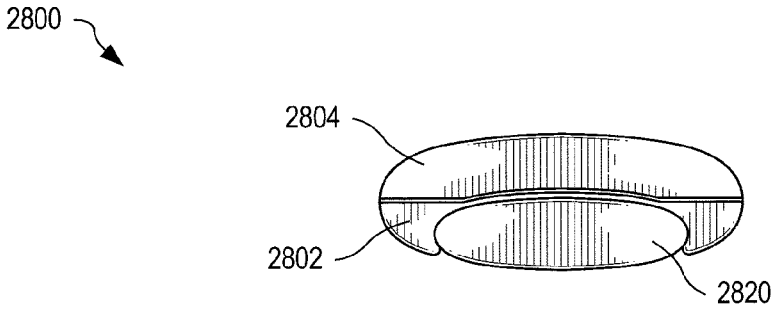
Figure 114:
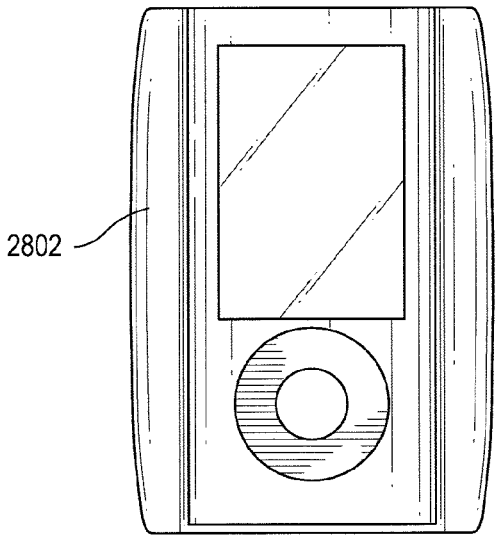
Figure 115:
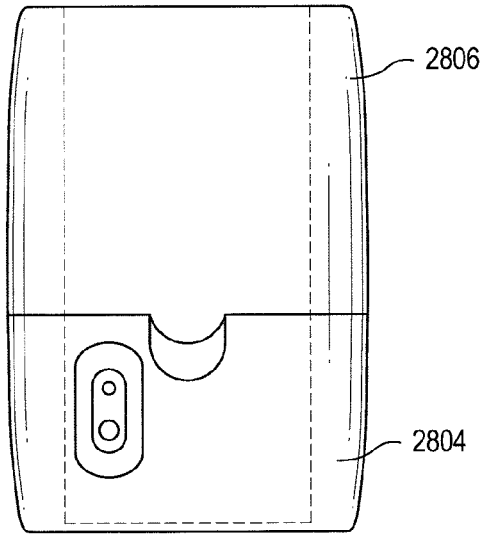

FIGS. 111-115 show one exemplary integrated hard storage and protective case 2800. FIGS. 111 and 113 show a DMD 2820 inserted into case 2800 that is shaped and sized to receive DMD 2820. As shown in FIGS. 111-115, case 2800 is formed with a front section 2802 that couples with DMD 2820 and a storage section 2804 that includes a door 2806 that provides access to a storage area 2808. Storage area 2808 includes a retaining clip 2810 that is similar to clips 500, 600, 700, 800, 900 of FIGS. 5-28, respectively, and further includes a hinge point for pivotally attaching within storage area 2808. In one embodiment, retaining clip 2810 is removable to facilitate winding of an earphone set (e.g., one of earphone sets 300, 320, and 360 of FIGS. 1-4). Although storage area 2808 may be used to store the earphone set without using clip 2810, clip 2810 allows the earphone set to be tidily wound and inserted into storage area 2808 without damage, as may result when door 2806 is closed with one or both of wires 306 and cable 304 not fully inserted. Further, the use of clip 2810 prevents movement of the earphone set within storage area 2808 when case 2800 is transported (e.g., within a pocket or bag).

Case 2800 is ergonomically designed to position itself within a palm of the user's hand during use. By combining storage with DMD protection, case 2800 proves enhanced utility.

Figure 116:
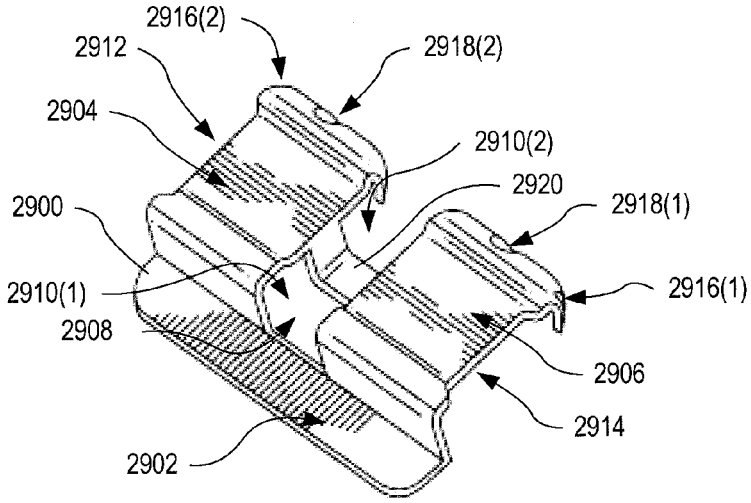
FIGS. 116-118 are various views of one exemplary shaped earphone retaining clip for retaining an in-ear style earphone set using reduced height, in an embodiment.
Figure 117:
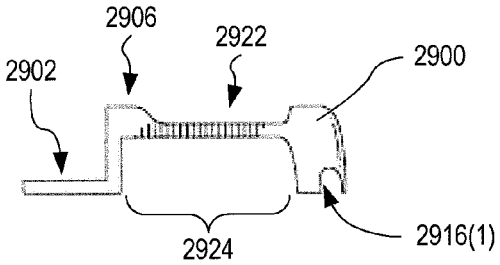
Figure 118:
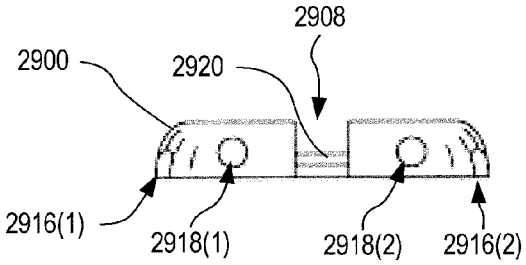
Figure 119:
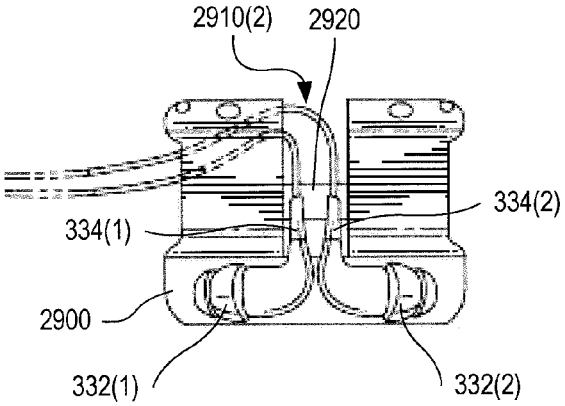
FIGS. 119-121 show exemplary winding of the earphone set of FIG. 2 onto the earphone retaining clip of FIGS. 116-118.
Figure 120:
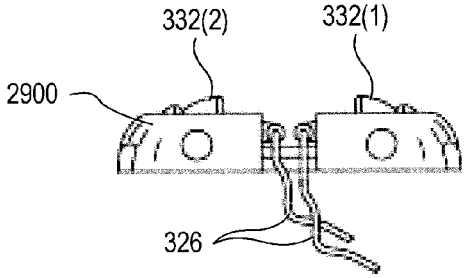
Figure 121:
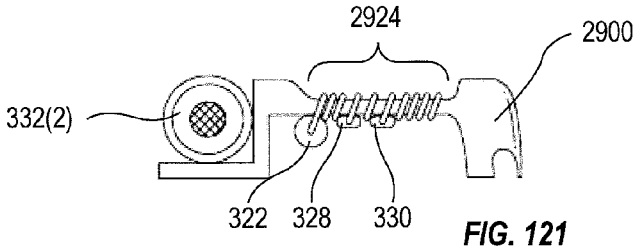

FIGS. 116-118 show one exemplary shaped earphone retaining clip 2900 for retaining an in-ear style earphone set using reduced height. FIGS. 119-121 show exemplary winding of earphone set 320 of FIG. 2 onto clip 2900 of FIGS. 116-118. FIGS. 116-121 are best viewed together with the following description.

Clip 2900 has a flat area for receiving earpieces 332 of earphone set 300, as shown in FIG. 119. Clip 2900 has a first raised portion 2904 and a second raised portion 2906 with a valley 2908 therebetween. Valley 2908 has first and second cutouts 2910(1) and 2910(2) leaving a stem support 2920. First raised portion 2904 has a cutout 2912 and second raised portion 2906 has a cutout 2914 that together form a winding area 2924. Optionally, clip 2900 may have one or more additional notches 2916 for changing a winding length of cable 324 and wires 326 around winding area 2924 to position rigid components of earphone set 320 beneath raised portions 2904 and 2906. Optionally, clip 2900 may have one or more holes 2918 for securing jack plug 322.

As shown in FIGS. 119-121, earphone set 320 may be retained by clip 2900 such that rigid components 322, 328, 330, and 332 and stored within a periphery of the clip, and such that space utilized by clip 2900, when retaining earphone set 320 for example, is minimal. Clip 2900 may be used with one or more of storage cases 1400, 1500, 1600, 2000, 2100, 2200, 2300, 2400, 2500, 2600, 2700, and 3200 of FIGS. 58-63,64, 65, 78-79, 80-83 84-86, 87-89, 90-91, 92-95, 96-105, 106-110, 131-132 respectively.

FIGS. 122-127 shows a retractable earphone set in one exemplary storage case 3000 that attaches to a protective case (not shown) of a DMD. FIGS. 122-127 are best viewed together with the following description.

Figure 125:
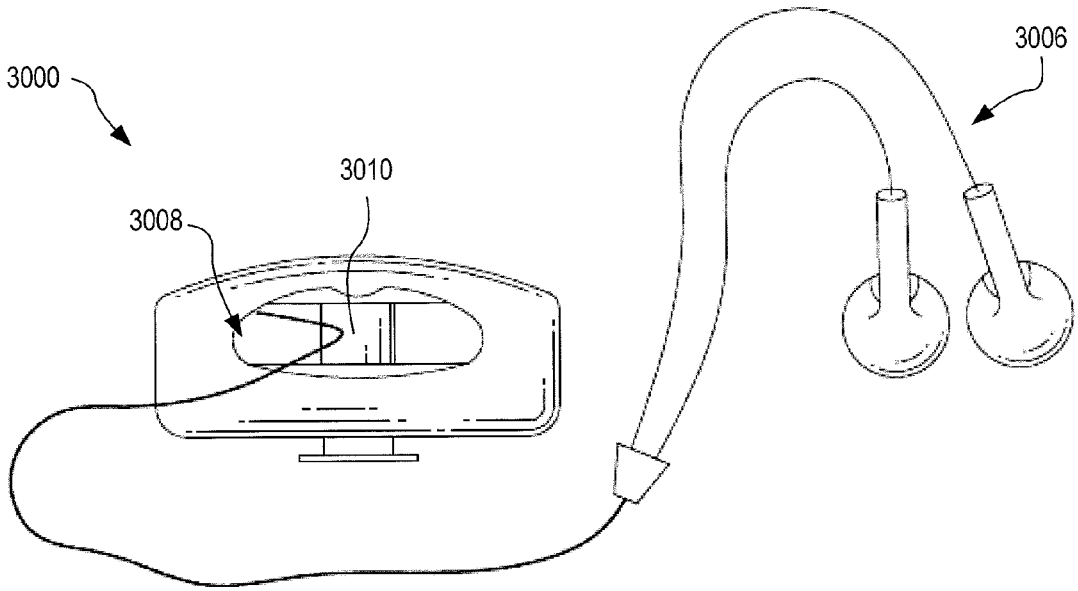

Storage case 3000 has a hard shell 3002 that is ergonomically styled with finger grips 3004(1-3) for protecting earphone set 3006 when wound onto a retractable mechanism 3010. Case 3000 has an opening 3008 within which earpieces 3007 are stored when earphone set 3006 are retracted, and from which earpieces and wires of earphone set 3006 may be withdrawn. In one embodiment, a cable 3012 and a jack plug 3014 of earphone set 3006 extend through a hole 3016 of case 3000 such that jack plug 3014 may be inserted into a jack socket of a DMD to which case 3000 is attached. In another embodiment, cable 3012 and jack plug 3014 are stored within case 3000 and may extend through opening 3008 as shown in FIG. 125. Case 3000 provides convenient storage of earphone set 3006 proximate the DMD to which case 3000 is attached.

Figure 122:
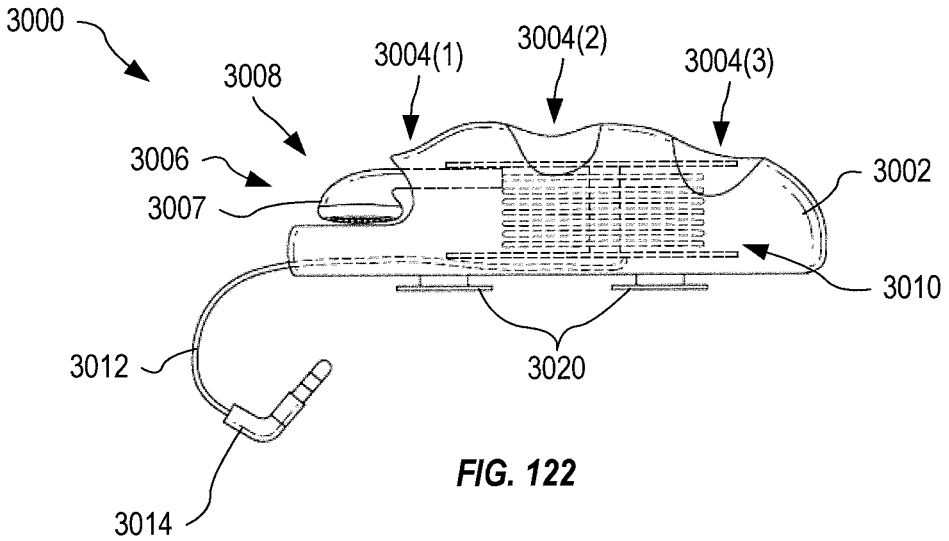
FIGS. 122-127 show a retractable earphone set in one exemplary storage case that attaches to a protective case of a DMD, in an embodiment.
Figure 123:
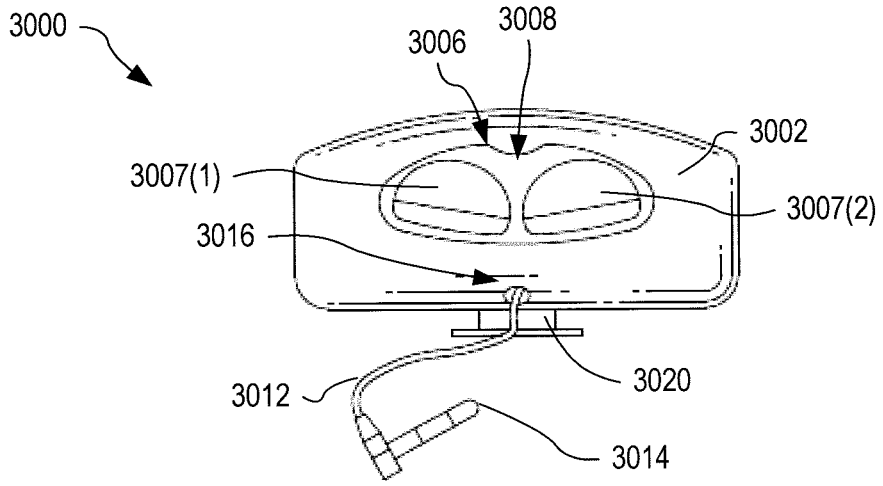
Figure 124:
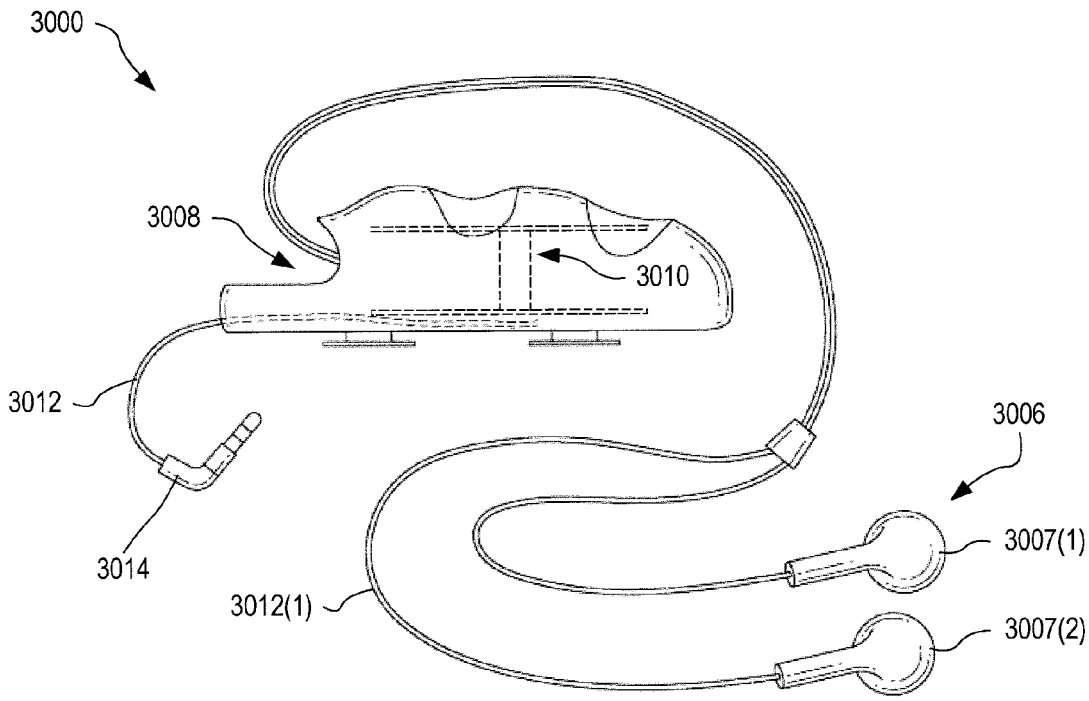
Figure 126:
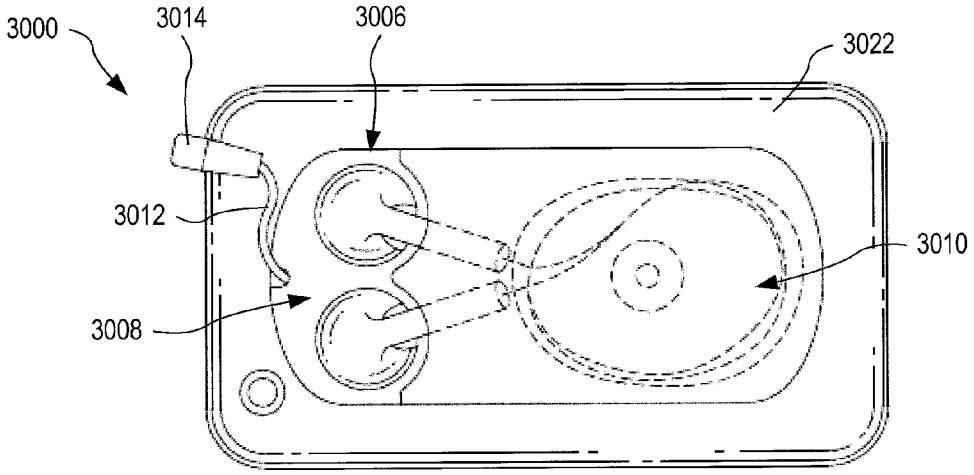

FIG. 126 shows case 3000 coupled with a protective DMD case 3022, with earphone set 3006 retracted and jack plug 3014 coupled with a DMD within protective DMD case 3022. In particular, jack plug 3014 may be shaped to plug into the DMD without unnecessary protrusion from case 300 and without unnecessary slack in cable 3012. Case 3000 has two exemplary coupling posts 3020, as shown in FIGS. 122 and 123, for coupling with retaining slots of protective DMD case 3022. However, other means of coupling (e.g., hook and loop, magnetic, double sided adhesive tape, and so on) may be used to attach case 3000 to the protective DMD case, or to the DMD itself, without departing from the scope hereof.

Figure 127:
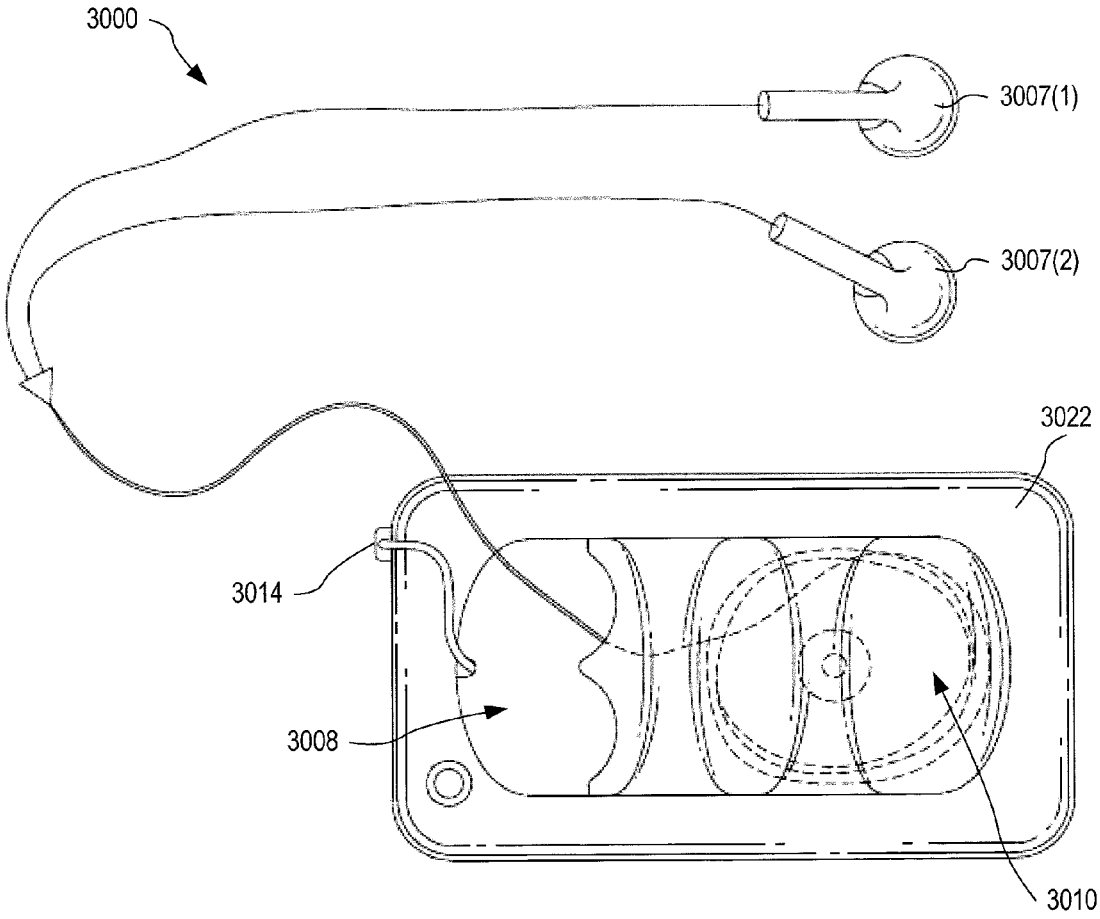

FIG. 127 shows case 3000 coupled with protective DMD case 3022, with jack plug 3014 couples with a DMD within protective DMD case 3022, and with earphone set 3006 extracted and ready for use.

Figure 128:
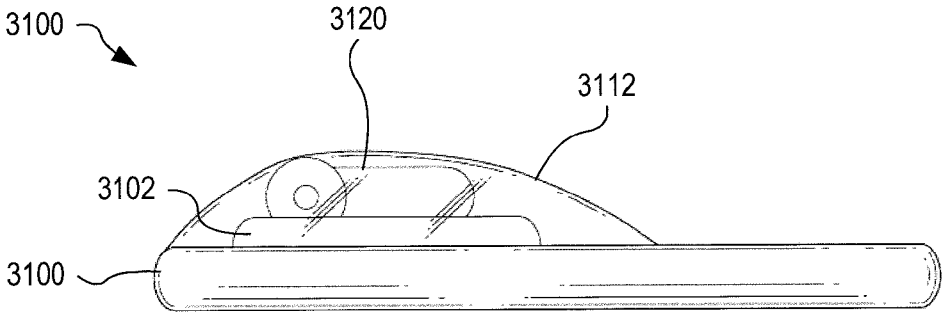
FIGS. 128 and 129 are side views of one exemplary storage case for storing a Bluetooth earpiece with a DMD, in an embodiment.
Figure 129:
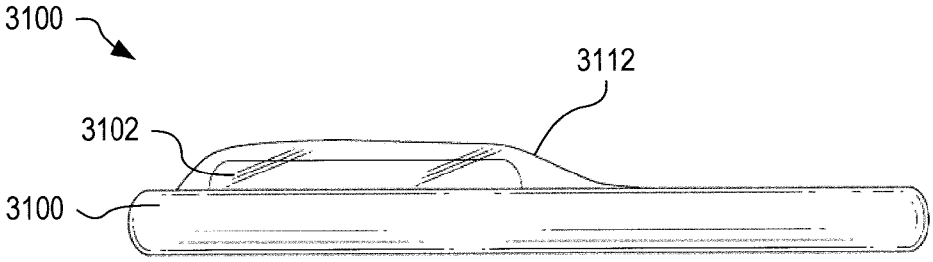
Figure 130:
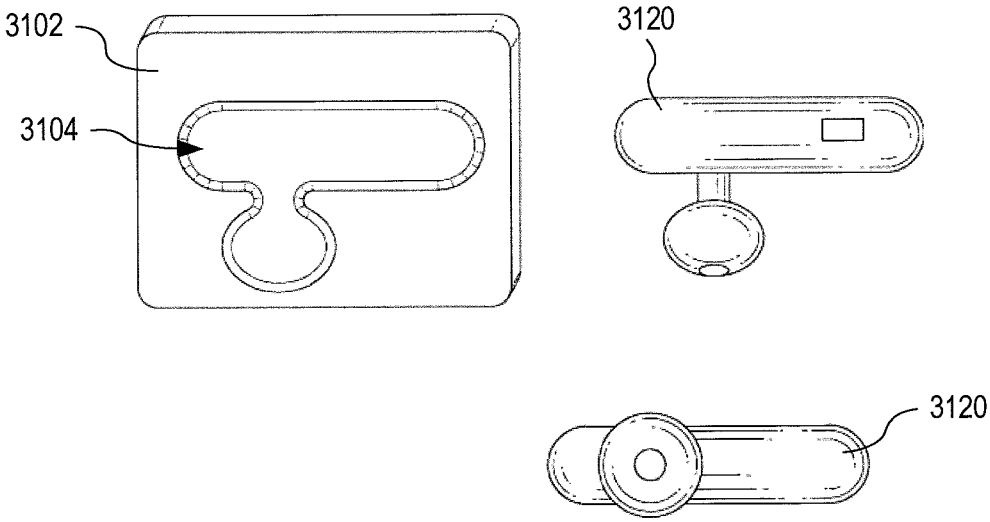
FIG. 130 shows a foam former of the storage case of FIGS. 128 and 129.

FIGS. 128 and 129 show one exemplary storage case 3100 for storing a Bluetooth earpiece 3120. Case 3100 may represent any one of cases 1500, 1600, 2300, 2400, and 2600, of FIGS. 64, 65, 87-89, 90-91, and 96-105, respectively, and further includes a foam former 3102 that is positioned within storage case 3100 and shaped to receive and protect Bluetooth earpiece 3120. Earpiece 3120 is held in place by a stretchable material 3112 of case 3100. Foam former 3102 may remain within storage case 3100 when earpiece 3120 is removed. FIG. 130 shows foam former 3102 of storage case 3100 of FIGS. 128 and 129 with a cutout 3104 shaped to receive earpiece 3120.

Figure 131:
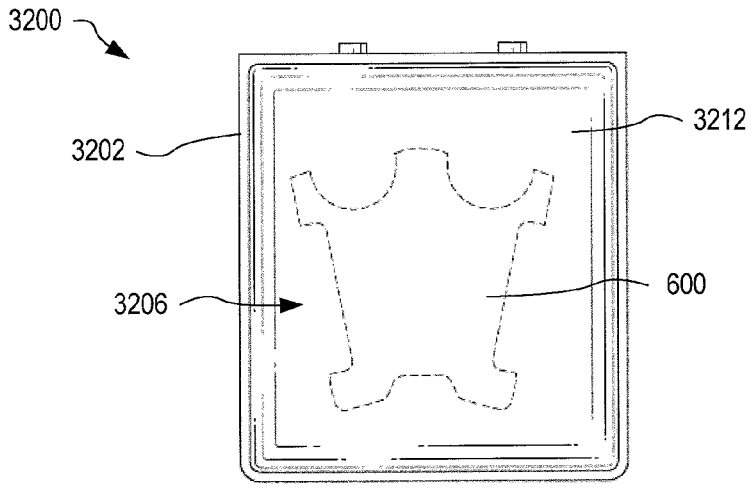
FIGS. 131 and 132 show one exemplary storage case configured to replace a battery compartment cover for a DMD, in an embodiment.
Figure 132:
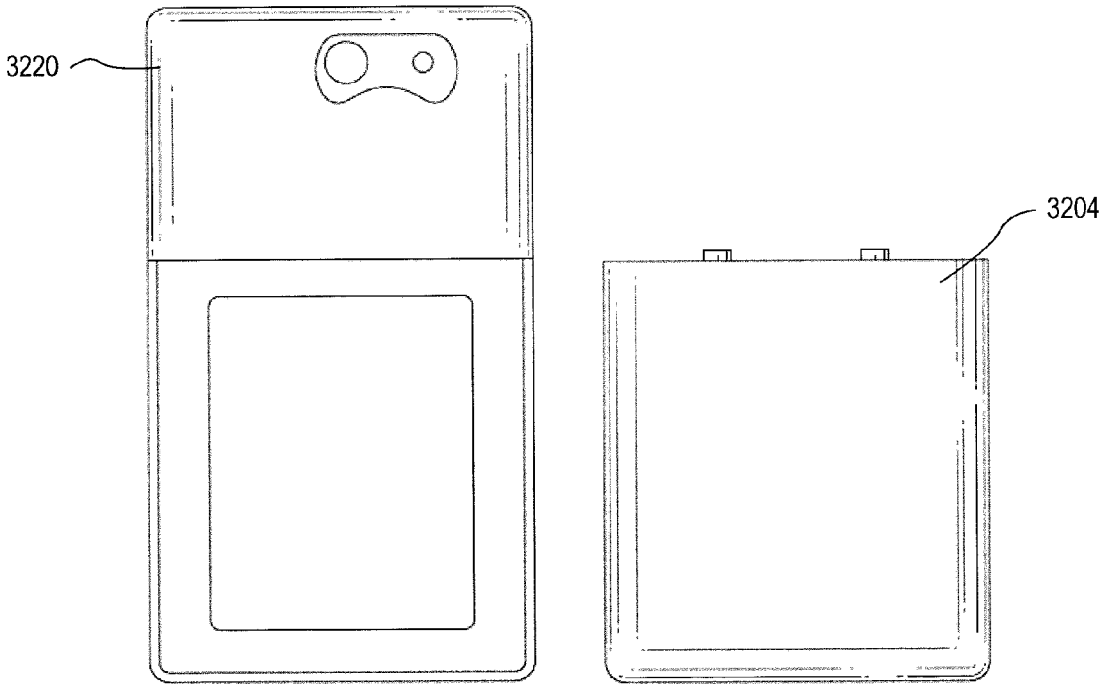

FIGS. 131 and 132 show one exemplary storage case 3200 configured to replace a battery compartment cover 3204 of a DMD 3220. Case 3200 includes a base portion 3202 that is shaped and sized substantially the same as original battery compartment cover 3204 of a DMD 3220, and a stretchable material cover 3212 that together with base portion 3202 forms a storage area 3206 between base portion 3202 and material 3212. Material 3212 may be removably attached to base portion 3202 by one or more of hook and loop fasteners, magnets, hooks, and so on, or may include an opening, to allow access to storage area 3206. Case 3200 is shown storing clip 600 of FIG. 6, but may store other items including earphone set 300 of FIG. 1 wound onto one of clips 700, 800, 900, of FIGS. 7, 8, and 9, and earphone set 320 or 360 wound onto one of clips 500, 1000, 1100, and 1200 of FIGS. 5-8, 29-33, 34-41, and 42-53, respectively, and may store storage device 1300 of FIG. 13.

Figure 133:
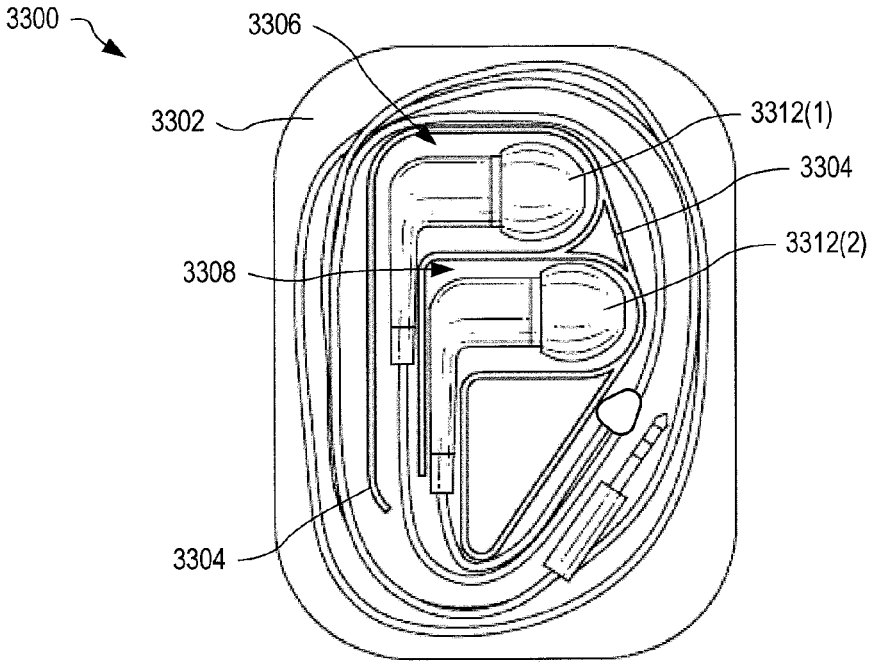
FIG. 133 is a top view of one exemplary earphone set storage clip formed with a base portion that is substantially flat with a raised former that has recesses sized and shaped to receive earpieces of an earphone set, in an embodiment.

FIG. 133 is a top view of one exemplary earphone set storage clip 3300 formed with a base portion 3302 that is substantially flat and a raised former 3304 that has recesses 3306 and 3308 that are sized and shaped to receive earpieces 3312(1) and 3312(2) of an earphone set. Earpieces 3312 may represent any of earpieces 312, 332, and 372 of earphone sets 300, 320 and 360 of FIGS. 1, 2 and 4, respectively. Clip 3300 may be used where space available for storing the earphone set is not restricted in size, such as with larger DMDs.

Storage cases 1400, 1500, 1600, 2000, 2100, 2200, 2300, 2400, 2500, 2600, 2700, and 3200 of FIGS. 58-63, 64, 65, 78-79, 80-83 84-86, 87-89, 90-91, 92-95, 96-105, 106-110, 131-132, may include one or more cutouts that allow operation of features (e.g., camera) of the DMD without requiring decoupling of the storage case from the DMD.

Figure 134:
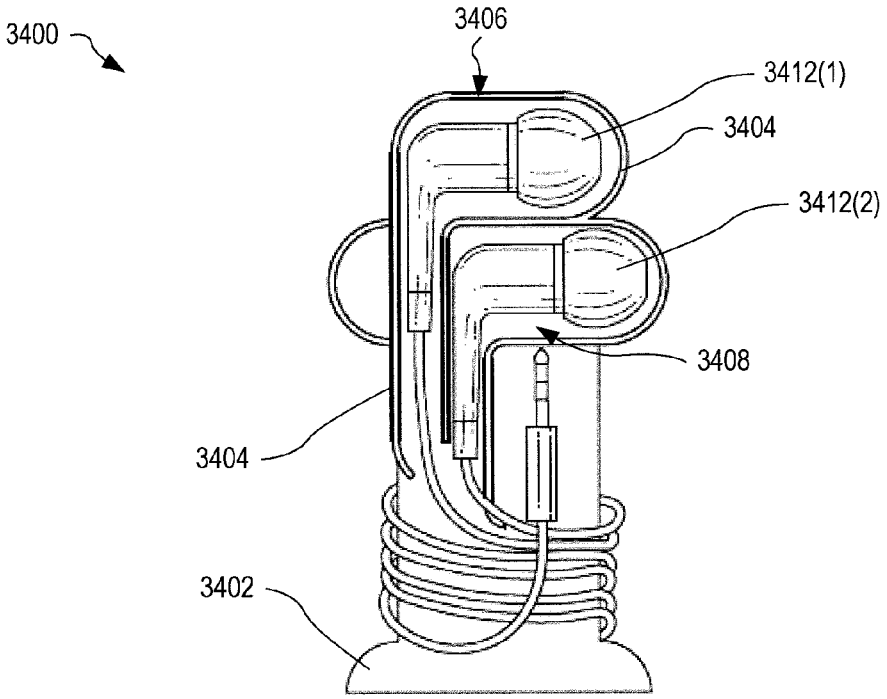
FIG. 134 is a top view of one exemplary earphone set storage clip formed with a base portion that is substantially flat, narrow, and has a raised former with recesses sized and shaped to receive earpieces of an earphone set, in an embodiment.

FIG. 134 is a top view of one exemplary earphone set storage clip 3400 formed with a base portion 3402 that is substantially flat and a raised former 3404 that has recesses 3406 and 3408 that are sized and shaped to receive earpieces 3412(1) and 3412(2) of an earphone set. Earpieces 3412 may represent any of earpieces 312, 332, and 372 of earphone sets 300, 320 and 360 of FIGS. 1, 2 and 4, respectively. Clip 3400 may be used where space available for storing the earphone set is restricted in width, such as with narrow DMDs.

In one embodiment, a retaining clip securely captures and stores an earphone set including two ear-pieces, a length of cable divided into two wires at a junction splitter, each wire coupled with a different one of the ear-pieces, one of the wires having an inline control panel, an undivided end of the cable coupled to a jack plug. The retaining clip has a ring shaped (open center) that is sized to securely capture the earphone set, the ring has at least one bend, undulation, or indentation sized to receive the two ear-pieces, and a pair of winding notches configured with a distance between inner segments that allow for winding the two wires such that the inline control panel and the junction are positioned within a periphery of the retaining clip. The jack plug is retained within the periphery by one or both of the wires and the cable.

Figure 135:
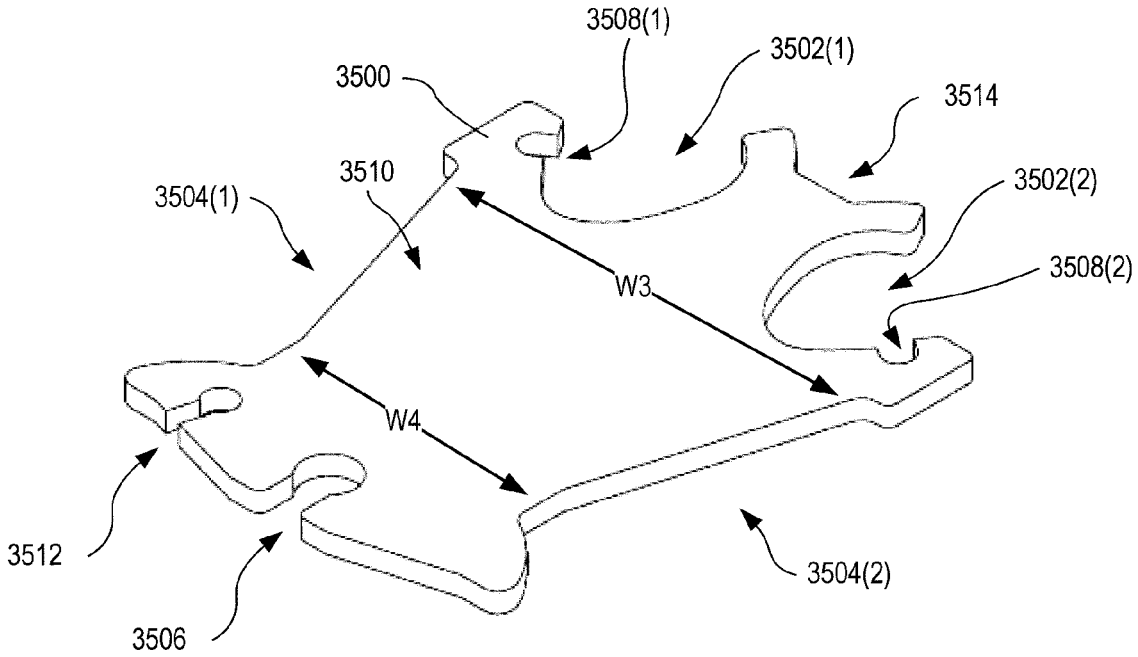
FIG. 135 shows a perspective view of one exemplary earphone retaining clip with two earpiece retaining cutouts, two winding notches that form a winding area that has a varying winding width for compact storage of an earphone set, in an embodiment.

FIG. 135 shows a perspective view of one exemplary earphone retaining clip 3500 comprising a substantially flat plate with two earpiece retaining cutouts 3502(1) and 3502(2), two winding notches 3504(1) and 3504(2) that form a winding area that has a varying winding width between W3 and W4, and an earpiece alignment notch 3506 for compact storage of an earphone set (e.g., earphone set 300 of FIG. 1). Cutouts 3502(1) and 3502(2) are partially open to allow easy insertion of earpieces 312(1) and 312(2) (FIG. 1), respectively. Cutouts 3502(1) and 3502(2) are also shaped (e.g., rounded) based upon the shape of earpieces 312 and are sized slightly smaller than the largest diameter D of earpieces 312.

The varying length of the winding path between notches 3504 may be based upon dimensions (e.g., lengths 307 and 319) of earphone set 300 (FIG. 1), such that as wires 306 and cable 304, when wound around winding notches 3504, retain earpieces 312 within cutouts 3502, and position junction splitter 308, remote control and microphone 310 and jack plug 302 to lay adjacent a front surface 3510, and within a periphery, of clip 3500 and without any substantial slack in cable 304 and wires 306.

Retaining clip 3500 also includes a securing notch 3512 that may be used to secure cable 304, proximate jack plug 302 for example, to prevent loosening of cable 304 and wires 306 once wound onto clip 3500. Securing notch 3512 is shaped and sized to retain cable 304 by friction. Retaining clip 3500 also has a second winding notch 3514 formed between cutouts 3502 that may be used for winding wires 306 after they pass through earpiece alignment notch 3506. Auxiliary notches 3508(1) and 3508(2) are formed within cutouts 3502 (1) and 3502(2), respectively, and may also be used to capture wires 306. Auxilliary notches 3508 may also be used for receiving elastic bands that secure the earphone set to clip 3500. See for example FIGS. 9 through 20 that illustrate the use of an elastic band to retain earphone set on the clip.

Figure 136:
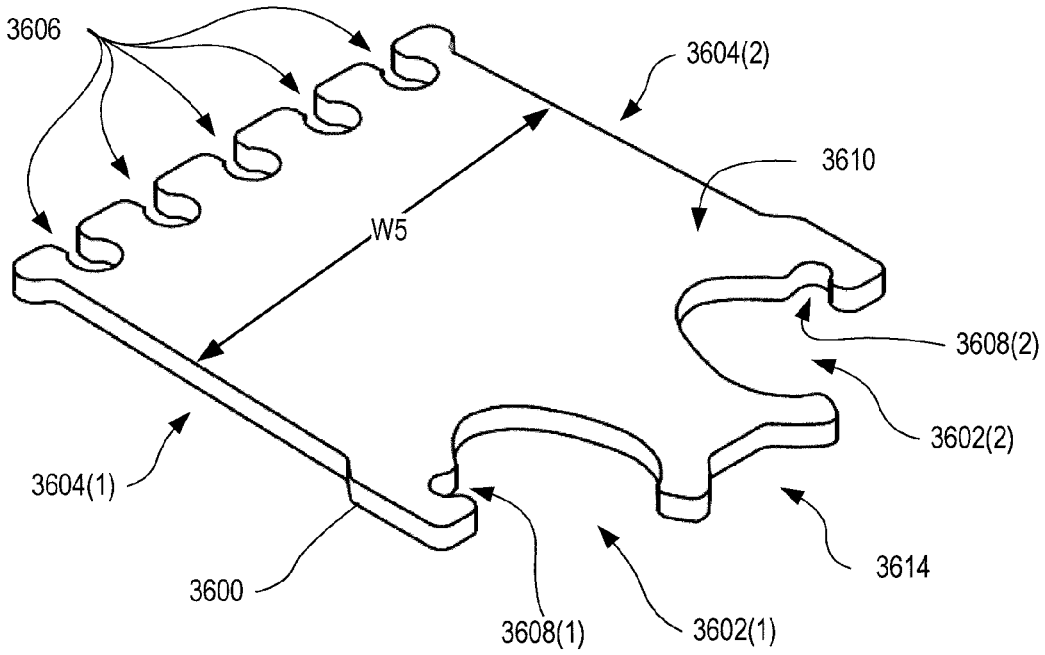
FIG. 136 shows a perspective view of one exemplary earphone retaining clip with two earpiece retaining cutouts, two winding notches that form a winding area, and a plurality of alignment notches for compact storage of an earphone set, in an embodiment.

FIG. 136 shows a perspective view of one exemplary earphone retaining clip 3600 comprising a substantially flat plate with two earpiece retaining cutouts 3602(1) and 3602(2), two winding notches 3604(1) and 3604(2) that form a winding area with a winding width W5, and a plurality of alignment notches 3606 for compact storage of an earphone set (e.g., earphone set 300 of FIG. 1). Cutouts 3602(1) and 3602(2) are partially open to allow easy insertion of earpieces 312(1) and 312(2), respectively. Cutouts 3602(1) and 3602(2) are also shaped (e.g., rounded) based upon the shape of earpieces 312 and are sized slightly smaller than the largest diameter D of earpieces 312.

The length of the winding path around notches 3604 is based upon width W5 that is determined based upon dimensions of earphone set 300, such that as wires 306 and cable 304 are wound around winding notches 3604, earpieces 312 are retained in position in cutouts 3602 by cable 304 and/or wires 306, and junction splitter 308, remote control and microphone 310, and jack plug 302 are positioned adjacent to a front surface 3610, and within a periphery, of clip 3600 without any substantial slack in cable 304 and wires 306.

Retaining clip 3600 also has a second winding notch 3614 formed between cutouts 3602 that may be used for winding wires 306 after they pass through one of alignment notches 3606. Auxiliary notches 3608(1) and 3608(2) are formed within cutouts 3602(1) and 3602(2), respectively, and may also be used to capture wires 306.

Figure 137:
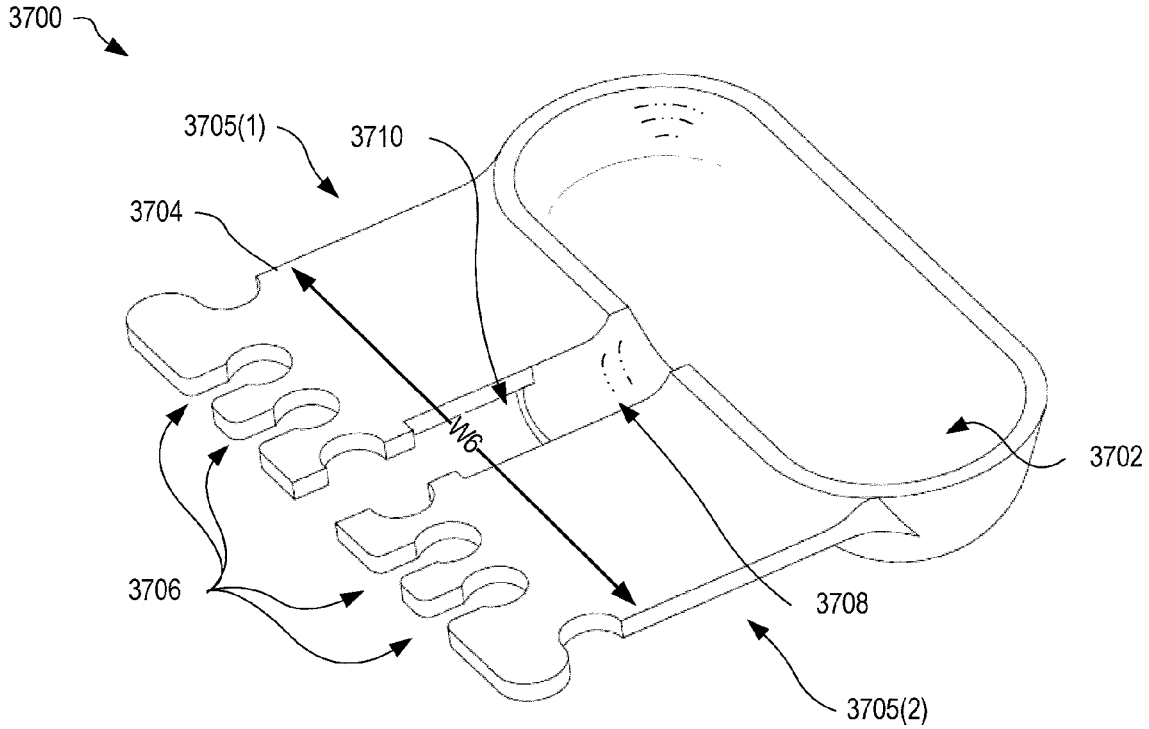
FIG. 137 shows a perspective view of one exemplary in-ear style earphone retaining clip that provides additional protection of the earphone set, in an embodiment.

FIG. 137 shows a perspective view of one exemplary in-ear style earphone retaining clip 3700 that provides additional protection of the earphone set. Clip 3700 has a concave portion 3702 that is sized and shaped to receive in-ear earpieces, such as earpieces 372 of earphone set 360, FIG. 4, and has a substantially flat winding portion 3704 that is approximately rectangular and extends from one side of concave portion 3702. Concave portion 3702 provides additional protection for stored earpieces 372, which may be sensitive and expensive components, as compared to clips 500, 600, 700, 800, 900, 1000, 3500, and 3600 of FIGS. 5-8, 9-14, 15-22, 23-25, 26-28, 29-33, 135, and 136, respectively.

Winding notches 3705(1) and 3705(2) are formed in short edges of winding portion 3704 for receiving wires 366 and cable 364 as they are wound around winding portion 3704. A plurality of notches 3706 are formed in a distal edge (opposite to concave portion 3702) of winding portion 3704 for receiving wires 366 and/or cable 364. A recess 3708 is centrally formed in winding portion 3704 and extends into concave portion 3702, for receiving stems 374 of earphones 360 when earpieces 372 are positioned within concave portion 3702.

A cutout 3710 within winding portion 3704 is aligned with recess 3708 and extends from recess 3708 to the opposing edge. Earphone set 360 is wound onto clip 3700 using a method similar to that described for clip 1100 of FIG. 34.

Figure 138:
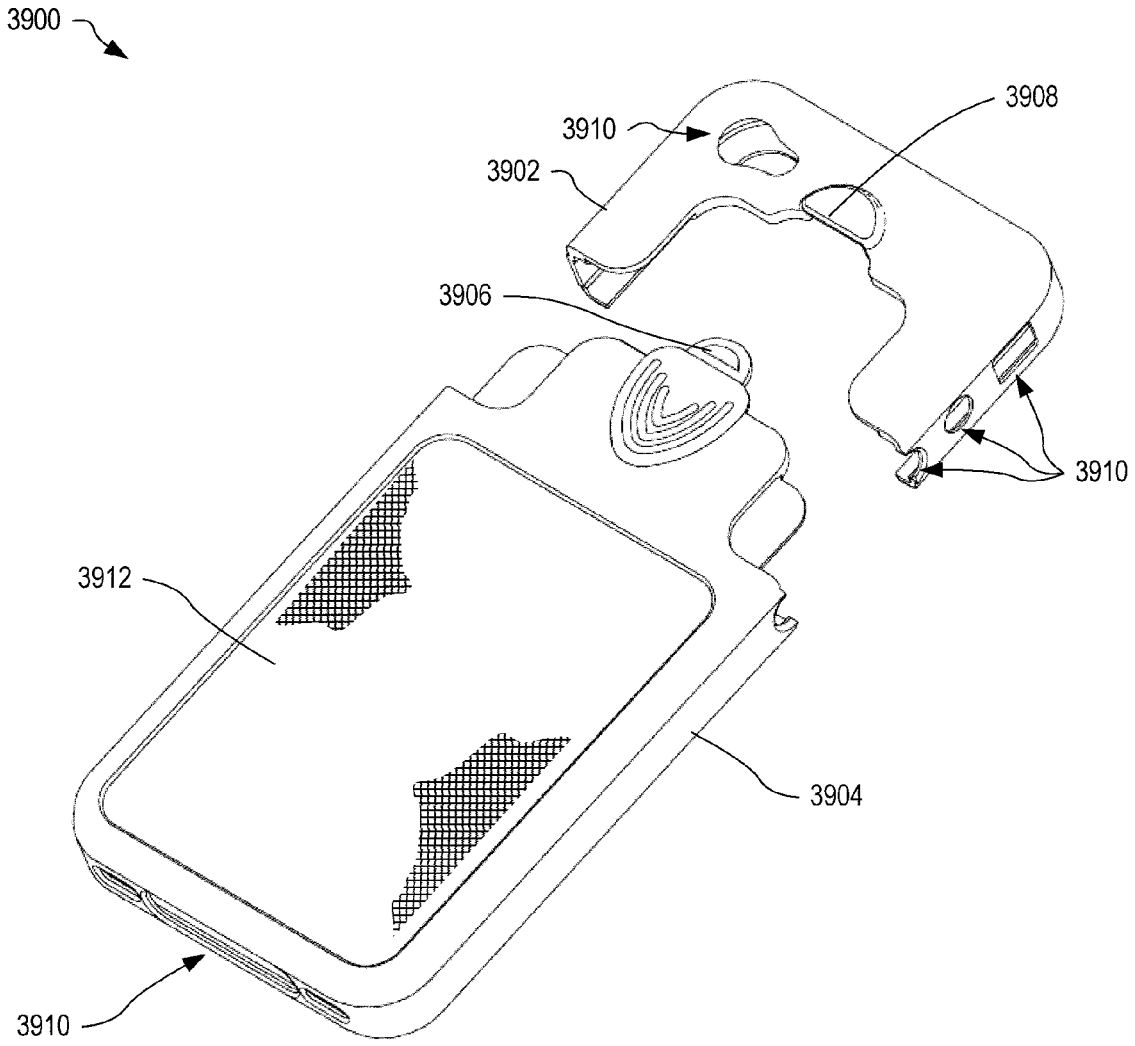
FIG. 138 is a perspective view of one exemplary case that attaches to the rear of a DMD for storing earphones or similar sized items, in an embodiment.

FIG. 138 is a perspective view of one exemplary two part, snap-together case 3900 that attaches to the rear of a DMD for storing earphones or similar sized items. Case 3900 is formed with a top portion 3902 that has a receptacle 3908 and a bottom portion 3904 that has a latch 3906. Top portion 3902 and bottom portion 3904 couple together (e.g., latch 3906 couples with receptacle 3908) to attach case 3900 to the rear of the DMD. Top portion 3902 and bottom portion 3904 may include one or more apertures 3910 that facilitate operation of the DMD with case 3900 attached thereto. Bottom portion 3904 may be removed from the DMD without requiring removal of top 3902. Bottom portion 3904 has a cutout covered by a flexible material 3912 that stretches over items (e.g., an earphone set wound onto a retaining clip) stored within case 3900. In one example of operation, bottom portion 3904 is separated from top portion 3902, by releasing latch 3906 from receptacle 3908, and at least partially removed from the DMD such that earphones 300 wound onto retaining clip 3500 of FIG. 135 for example may be inserted beneath material 3912 proximate the rear of the DMD. Bottom portion 3904 is then re-attached to the DMD and coupled with top portion 3902 such that latch 3906 engages with receptacle 3908 to retain case 3900 on the DMD. Material 3912 may be deformed by the stored item(s), which are securely held proximate the rear of the DMD by material 3912. Case 3900 may store other items without departing from the scope hereof.

In one embodiment, top portion 3902 and bottom portion 3904 are configured to couple with a protective case (not shown) that remains attached to the DMD, such that the DMD remains protected from damage even when bottom portion 3904 is removed to gain access to the storage area.

In another embodiment, case 3900 includes a second material positioned on an inside of the case to form a pocket for storing items, wherein the second material is detachable (see the features of FIG. 158) or has an opening (e.g., a slit) that allows access to the pocket.

Figure 139:
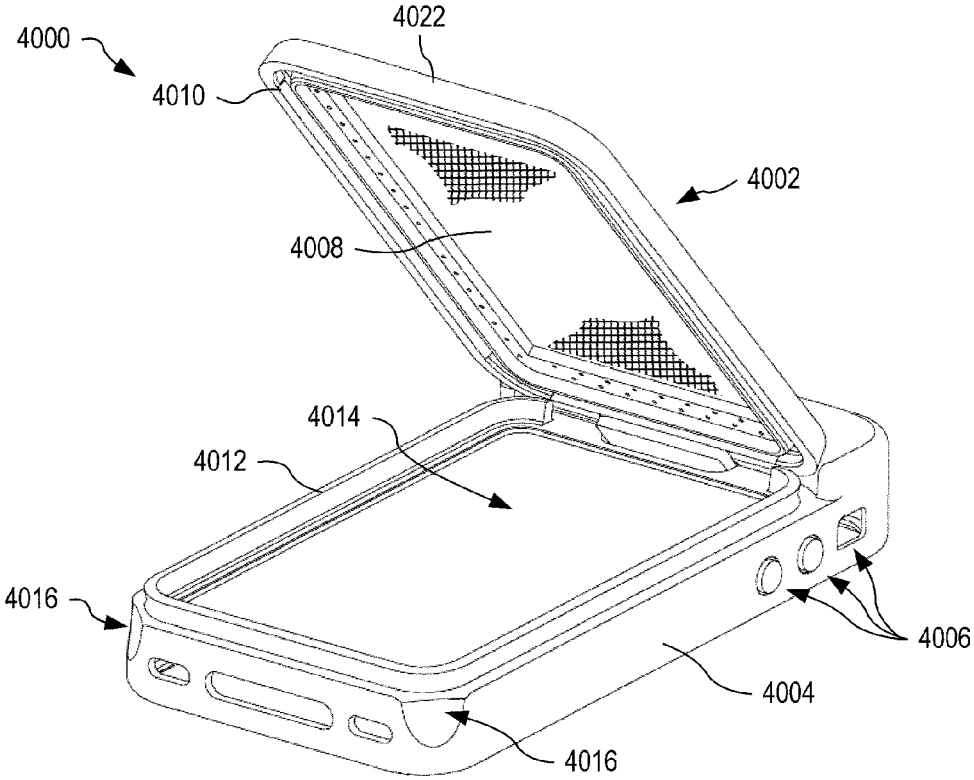
FIGS. 139-143 show one exemplary peel-case that attaches to the rear of a DMD for storing earphones or similar sized items, in an embodiment.
Figure 140:
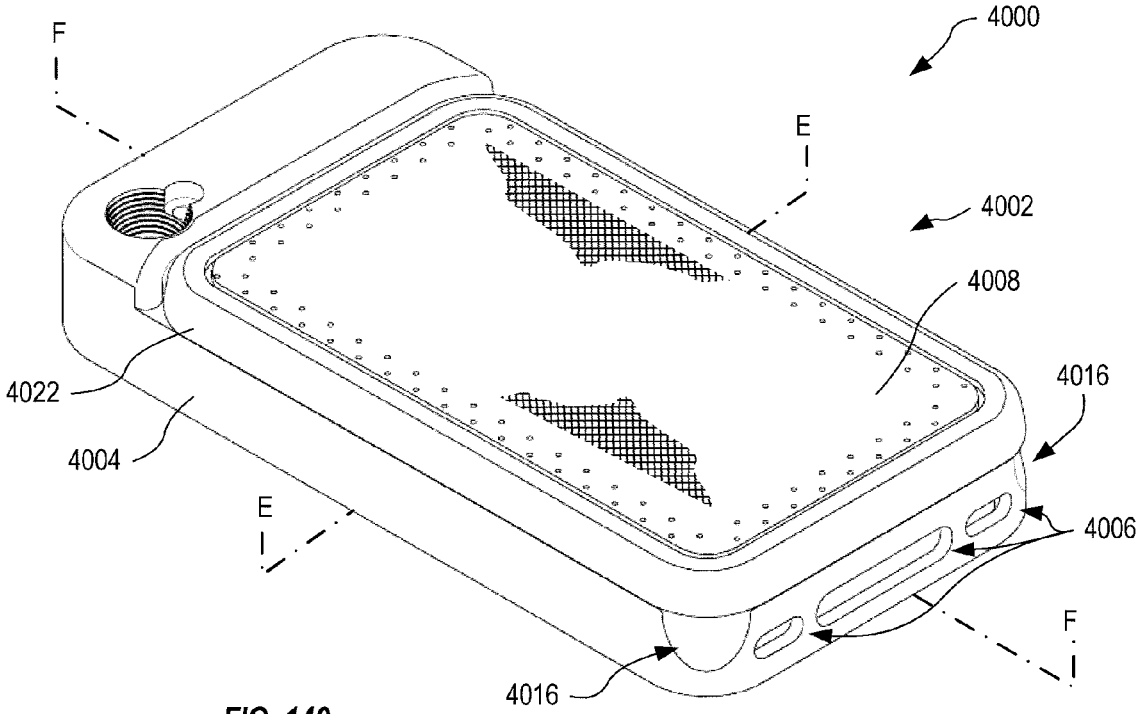
Figure 141:
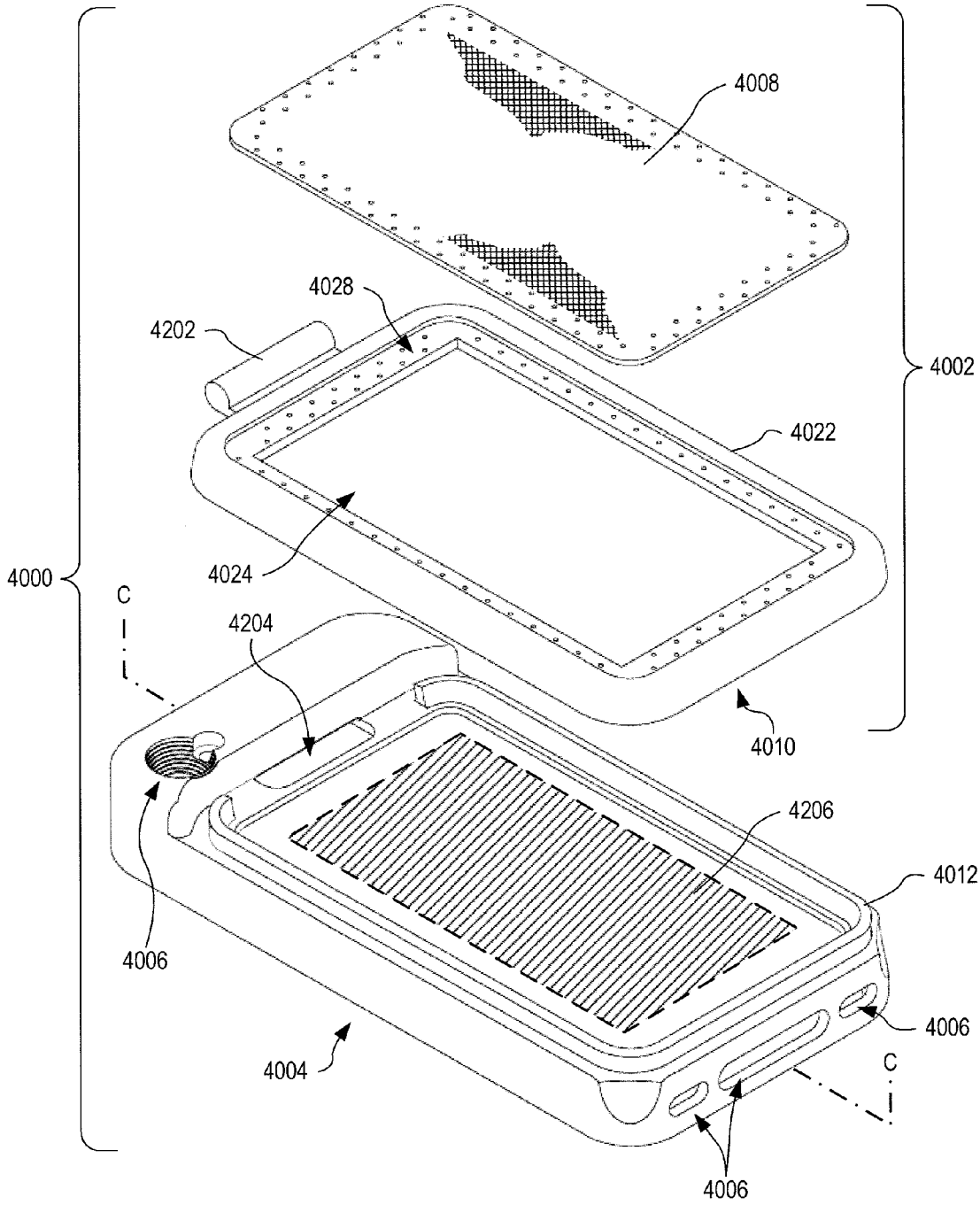
Figure 142:
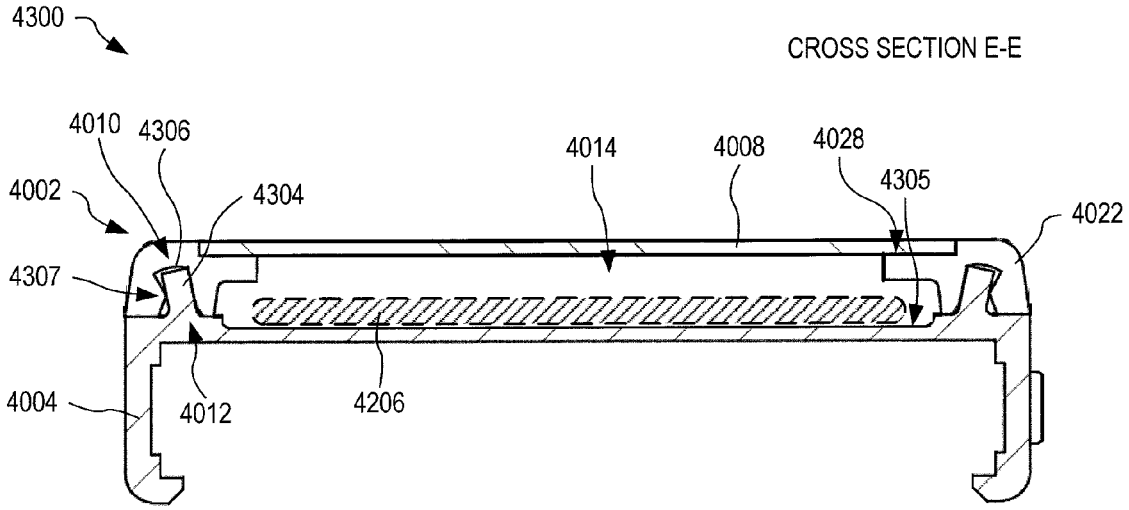
Figure 143:
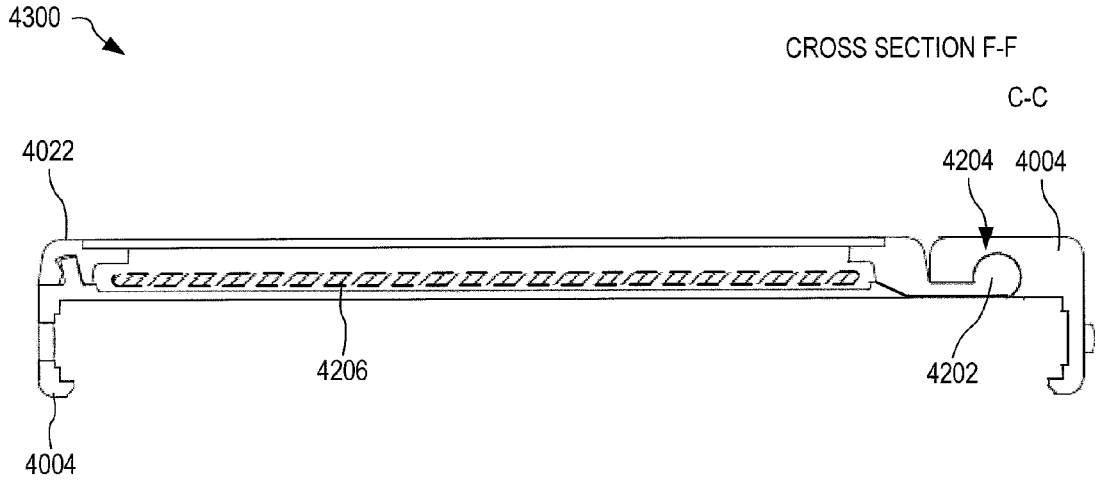

FIGS. 139-143 show one exemplary peel type case 4000 that attaches to the rear of a DMD for storing earphones or similar sized items. FIG. 139 is a perspective view showing case 4000 opened, FIG. 140 is a perspective view showing case 4000 closed, FIG. 141 is an exploded view showing exemplary construction of case 4000, and FIGS. 142 and 143 show exemplary cross sections through case 4000. FIGS. 139-143 are best viewed together with the following description.

Case 4000 is formed with a top portion 4002 and a bottom portion 4004. Bottom portion 4004 couples with the DMD and may function to protect the DMD. Bottom portion 4004 is for example a substantially rigid material (e.g., plastic) and may include one or more apertures 4006 that allow operation of the DMD with the bottom portion 4004 coupled therewith. Top portion 4002 is formed with a stiff pliable material 4022 (e.g., a flexible material that may be deformed by a force and that returns to its original shape when the force is removed, such as rubber, plastic, etc.) and incorporates a female locking mechanism 4010 to form a perimeter edge 4022 around an aperture 4024 that is covered by a stretchable material 4008. Female locking mechanism 4010 mates with a matching male locking mechanism 4012 positioned around a periphery of bottom portion 4004. Top portion 4002 and bottom portion 4004 may be pressed together such that female locking mechanism 4010 engages with male locking mechanism 4012 to retain top portion 4002 in a closed position (see FIG. 140).

As shown in FIGS. 139, 142 and 143, male locking mechanism 4012 is formed as a ridge on bottom portion 4004 and female locking mechanism 4010 is formed as a matching slot within perimeter edge 4024 of top portion 4002. When coupled together, top portion 4002 and bottom portion 4004 form a storage area 4014 for storing earphones or similar sized items. When storing an item, top portion 4002 is mated with bottom portion 4004 and stretchable material 4008 may be deformed by the stored item, thereby retaining the item securely. Bottom portion 4004 has shaped corners 4016 that facilitate removal of top portion 4002 from bottom portion 4004, for example by a peeling action started at one of the shaped corners 4016.

As shown in FIG. 141, perimeter edge 4022 is formed with a retaining hinge 4202 located central to a short edge thereof. Bottom portion 4004 includes a receptacle 4204 that receives and retains hinge 4202 and allows top portion 4002 to pivot about hinge 4202 and receptacle 4204 when case 4000 is opened. In an alternate embodiment, hinge 4202 and receptacle 4204 may be omitted, wherein top portion 4002 is retained only by coupling of male locking mechanism 4012 and female locking mechanism 4010.

As shown in FIGS. 142 and 143, male locking mechanism 4012 is formed as a ridge 4304 that extends above a back surface 4305 of bottom portion 4004 at a slight angle from perpendicular to surface 4305. This slight angle is selected to create an appropriate retaining force between male locking mechanism 4012 and female locking mechanism 4010. Female locking mechanism 4010 is formed as a slot 4306 that is slightly wider than a width of ridge 4304 and formed at the same angle. An entrance 4307 of slot 4306 is narrower than the width of ridge 4304 to create friction to retain slot 4306 on ridge 4304 when coupled together. An optional material 4320 (e.g., an elastomer or a soft loop material) may be applied to surface 4305 within storage area 4014 for additional protection and security of items stored therein. Stretchable material 4008 is fixedly coupled to pliable material 4022 within a recess 4028, for example by one or more of stitching, adhering, and welding.

In one example of operation, a user uses shaped corner 4016 to peel top portion 4002 away from bottom portion 4004 to access storage area 4014. The user inserts an item (e.g., earphones wound onto a retaining clip) onto optional material 4406 and reengages top portion 4002 with bottom portion 4004, whereupon material 4008 stretches to accommodate and store the item securely proximate the rear of a DMD.

Figure 144:
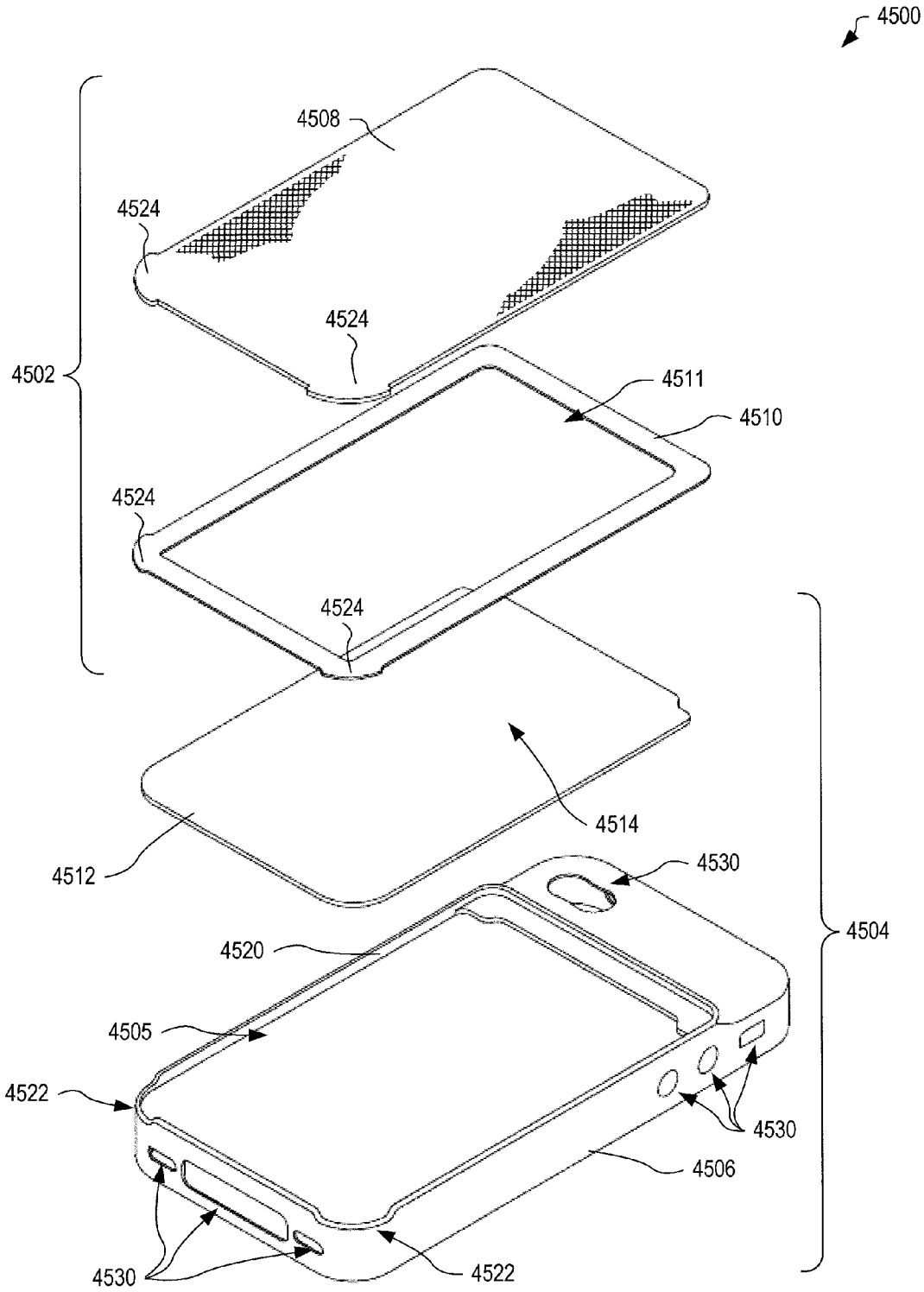
FIG. 144 shows one exemplary exploded view of a rip-case for storing earphones, or similar sized items, proximate a rear of a DMD, in an embodiment.
Figure 145:
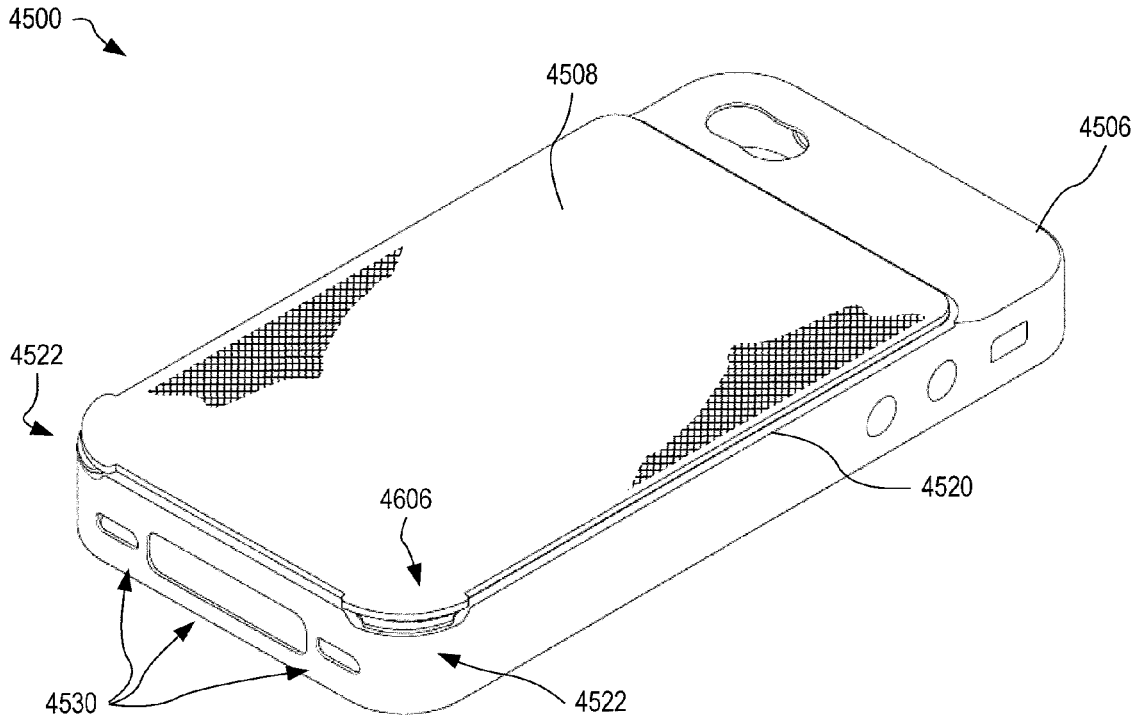
FIG. 145 is a perspective view of the rip-case of FIG. 144 when closed with nothing stored therein.

FIG. 144 shows one exemplary exploded view of a rip-case 4500 for storing earphones, or similar sized items, proximate a rear of a DMD. FIG. 145 is a perspective view of rip-case 4500 closed with nothing stored therein. FIGS. 144 and 145 are best viewed together with the following description.

Case 4500 is formed of a top portion 4502 and a bottom portion 4504. Top portion 4502 is composed of a rectangular stretchable material 4508 and a Velcro™ hook layer 4510 having a size and shape similar to material 4508, with a central cut out 4511 to leave a perimeter of substantially constant width. Layer 4510 is fixedly attached around an outer perimeter of material 4508 on one side with the hooks facing away from material 4508. In one example, layer 4510 is stitched and/or adhered to material 4508. Bottom portion 4504 is formed with a base 4506 that is substantially rigid and couples with the DMD, and a Velcro™ nap layer 4512 that is sized and shaped similar to material 4508. Nap layer 4512 is fixedly attached (e.g., adhered) into a recess 4505 on a back surface of base 4506. Top portion 4502 attaches to bottom portion 4504, using the hooks of hook layer 4510 and the nap of nap layer 4512, to form a storage area 4514 therebetween.

Recess 4505 is formed by a rim 4520 that surrounds and protects edges of top portion 4502 when coupled with bottom portion 4504. As shown in FIGS. 144 and 145, rim 4520 may be omitted at outer corners 4522, and corresponding corners 4524 of top portion 4502 may extend to allow a user to easily remove (e.g., by peeling back) top portion 4502 from bottom portion 4504. Base 4506 may include one or more apertures 4530 that allow operation of the DMD when coupled with base 4506.

In one example of operation, the user may remove or peel back top portion 4502 from bottom portion 4504 to gain access to storage area 4514, wherein upon inserting an item (e.g., earphones) into storage area 4514, the user presses top portion 4502 back down to attach to bottom portion 4504. Material 4508 may be stretched by the item stored therein to securely hold it in place proximate material 4512, base 4506, and thus the rear of the DMD coupled therewith.

Figure 146:
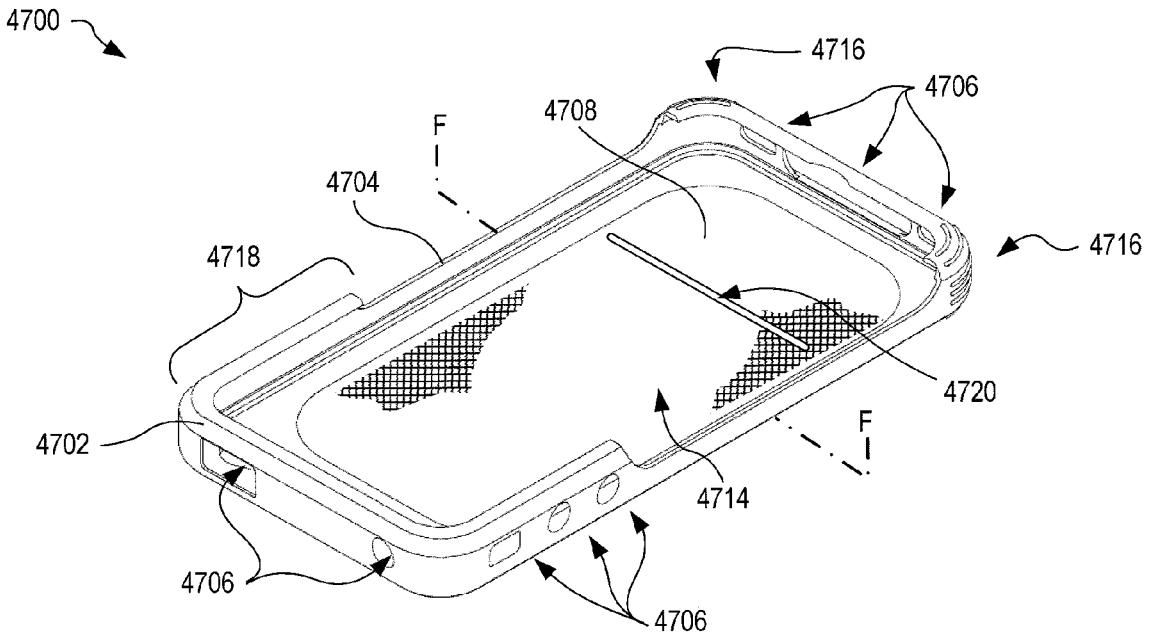
FIG. 146 is a perspective view of one exemplary case for storing earphones, or other similar sized items, proximate a rear of a DMD, in an embodiment.

FIG. 146 is a perspective view of one exemplary flexible case 4700 for storing earphones, or other similar sized items, proximate a rear of a DMD. Case 4700 attaches directly to the DMD (e.g., in a manner similar to existing protective cases) and includes one or more apertures that allow operation of the DMD while case 4700 is attached thereto. Optionally, case 4700 may attach to a base portion (not shown) that remains to protect the DMD when case 4700 is removed to gain access to storage area 4714.

Case 4700 has a shell 4702 that retains its shape and is flexible (e.g., a flexible plastic that may be deformed by a force and that returns to its original shape when the force is removed) and a stretchable material 4708 that is permanently attached to shell 4702 across an aperture 4704 in shell 4702. Aperture 4704 and material 4708 are positioned proximate the rear of a DMD when case 4700 is attached thereto. Case 4700 is shaped to securely attach to the DMD at a first end 4718 (e.g., a top portion of case 4700 corresponding to a top portion of the DMD) and to be detached from the DMD at the opposite end. In one embodiment, grips 4716 are formed on corners of the opposite end of shell 4702 to facilitate removal of that end from the DMD.

When coupled with the DMD, case 4700 forms a storage area 4714 between material 4708 and the rear of the DMD. To access storage area 4714, case 4700 is at least partially removed from the DMD. When earphones (e.g., earphones 300, FIG. 1) are positioned within storage area 4714, case 4700 is re-attached to the DMD, wherein material 4708 may be deformed by the stored item and thereby securely held adjacent the rear of the DMD.

Figure 176:
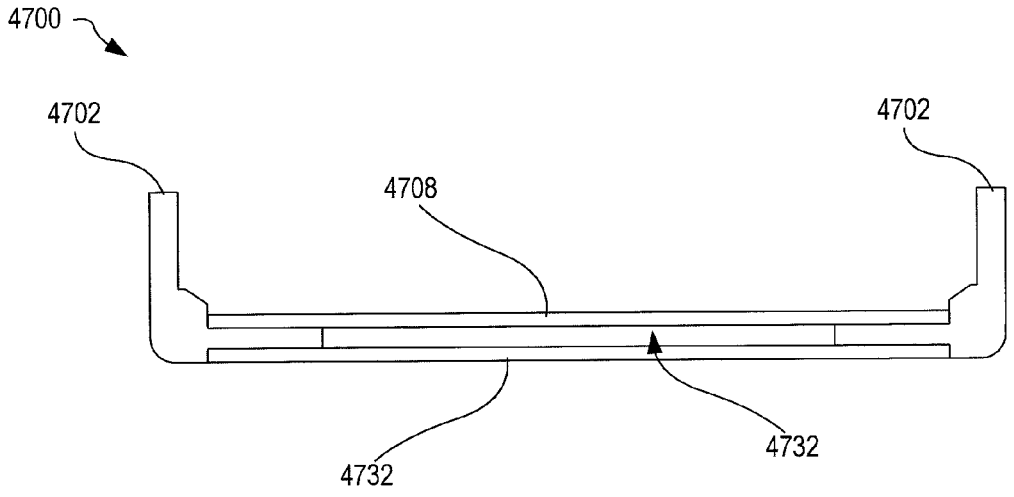
FIG. 176 is a schematic cross-section of the case of FIG. 146.

In one embodiment, material 4708 is forms a first layer with a slit 4720 on the layer nearest the DMD, and a second layer allows, when case 4700 is removed from the DMD, an item (e.g., earphones or similar sized items) to be placed in a storage area formed between layers. Thus, items are less likely to be dropped when removing case 4700 from the DMD. FIG. 176 is a schematic cross-section of case 4700 taken at line F-F shown in FIG. 146, showing portions of shell 4702, material 4708 and second layer 4732, with storage area 4732 therebetween.

Figure 147:
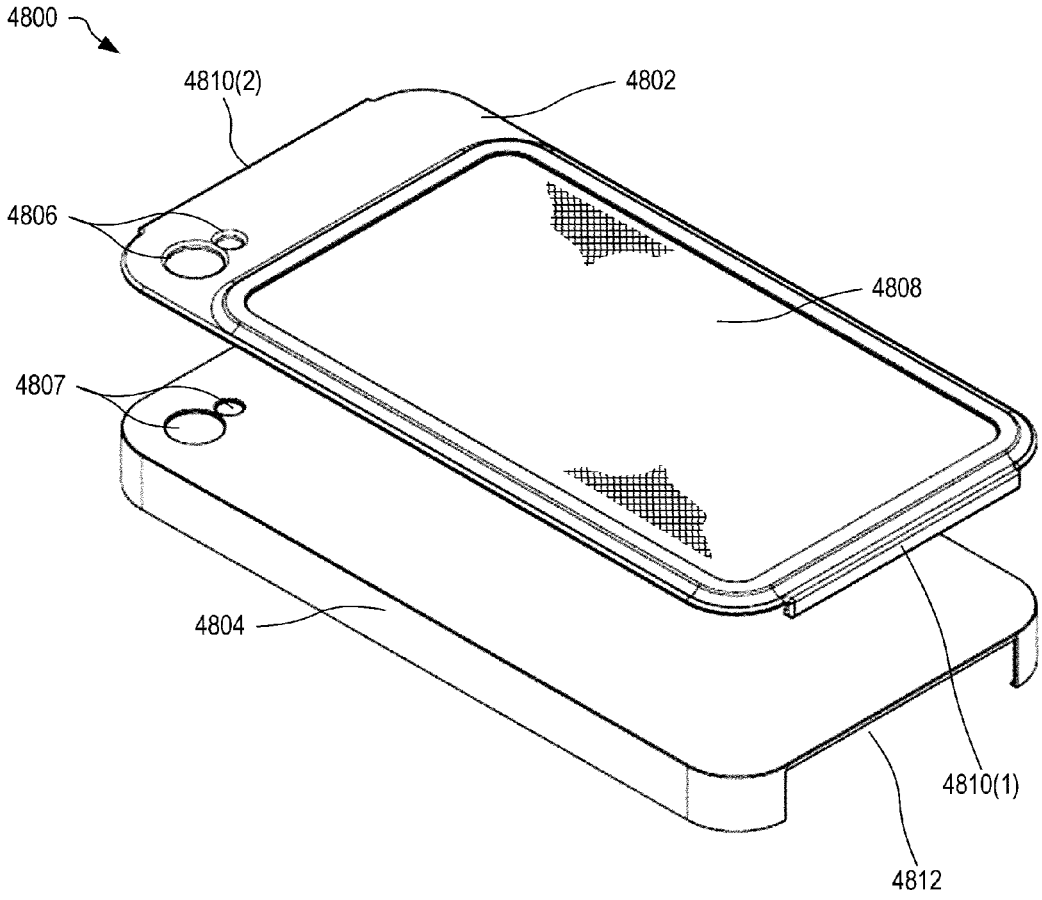
FIG. 147 is a perspective view of one exemplary press-tab case for storing earphones, or other similar sized items, proximate a rear of a DMD, in an embodiment.

FIG. 147 is a perspective view of one exemplary snap-on case 4800 for storing earphones, or other similar sized items, proximate a rear of a DMD. Case 4800 is formed with a press-tab top 4802 that attaches to a base 4804. Base 4804 attaches to the DMD and is similar to other protective cases for DMDs. Latches 4810(1) and 4810(2) of top 4802 engage base 4804, which may have one or more receptacles/apertures 4812 to cooperate with the latches 4810. Receptacles/apertures 4812 may have other functionality within base 4804, for example to facilitate access to features of a DMD to which base 4804 is attached. In one embodiment, latches 4810 (and associated receptacles/apertures) are positioned on opposing long sides of case 4800. Top 4802 is fowled with a flexible structure that has an aperture covered by a stretchable material 4808 that forms a storage area between base 4804 and top 4802. Base 4804 may also have one or more apertures 4807 that align with apertures 4806 within top 4802 to allow the DMD to function without removal of case 4800 therefrom.

In one embodiment, top 4802 is configured attach directly to a DMD wherein the storage area is formed between top 4802 and the DMD. In one example of operation, latch 4810 (1) is released (popped off) from base 4804 to provide access to the storage area. Once an item is placed within the storage area, top 4802 is pressed down onto base 4804 such that latch 4810(1) reengages with base 4804 (or the DMD when base 4804 is not used). Material 4808 is stretched by the stored item and securely holds the stored item in place.

In one embodiment, material 4808 is formed as two layers with a slit on the layer nearest the DMD to allow earphones (or similar sized items) to be placed in a storage area formed between the two layers when top 4802 is removed from base 4804.

Figure 148:
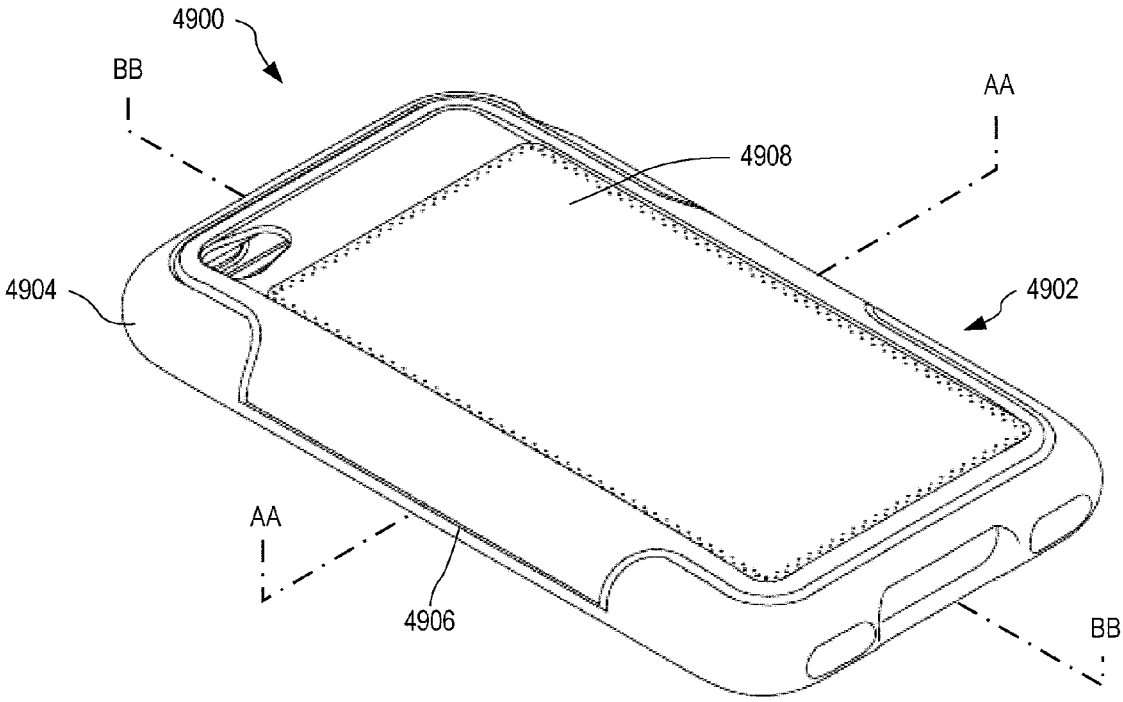
FIG. 148 is a perspective view of one exemplary closed hinged case for storing earphones, or other similar sized items, proximate a rear of a DMD, in an embodiment.
Figure 149:
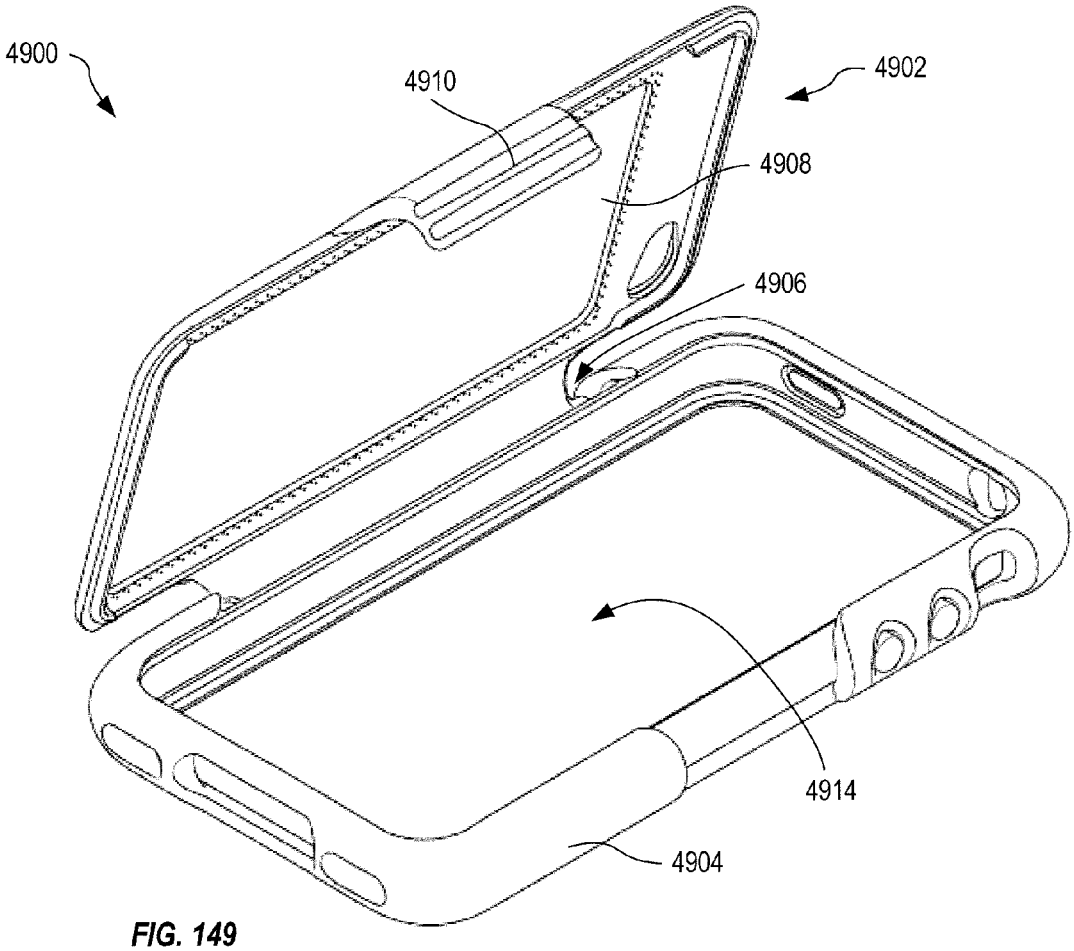
FIG. 149 is a perspective view of the case of FIG. 148 when open and showing a storage area.
Figure 150:
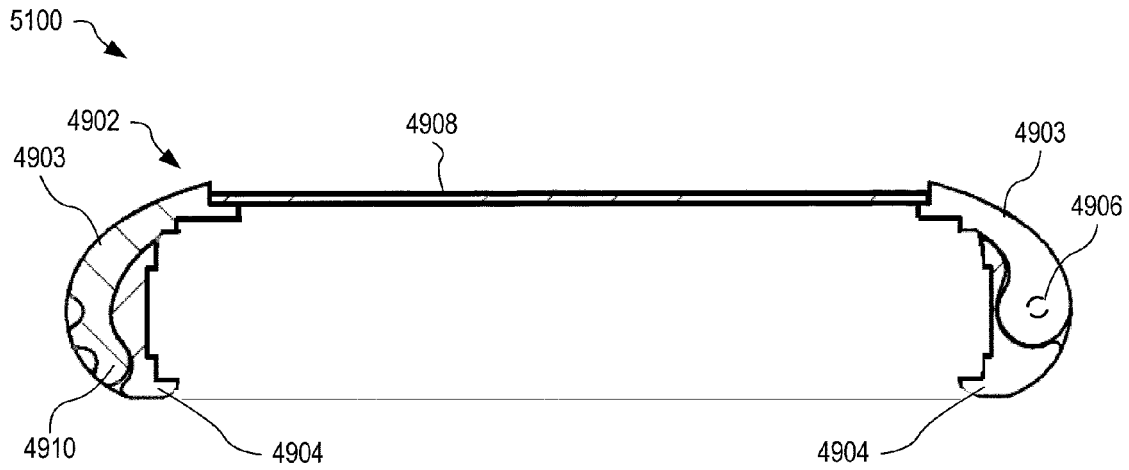
FIG. 150 shows a cross section through the top of the case of FIGS. 148 and 149, illustrating a hinge and latch mechanism.
Figure 151:
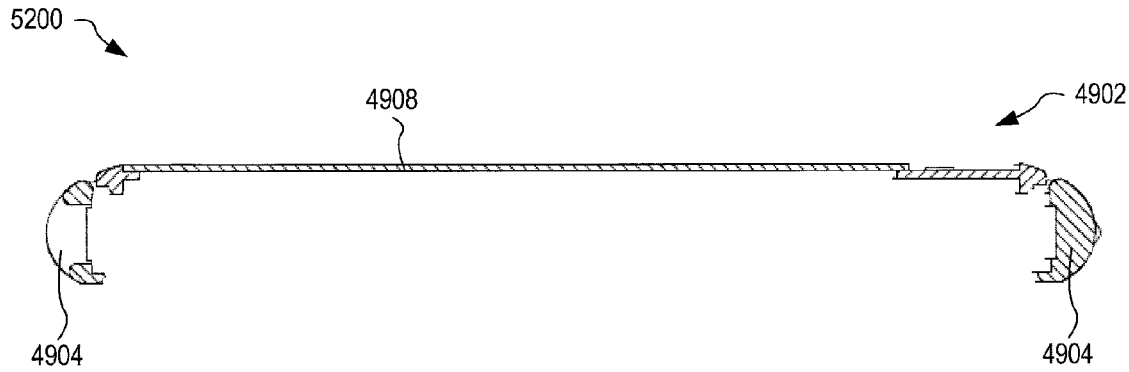
FIG. 151 is a cross section at a plane orthogonal to the cross section of FIG. 150 through top of the case of FIG. 148.
Figure 152:
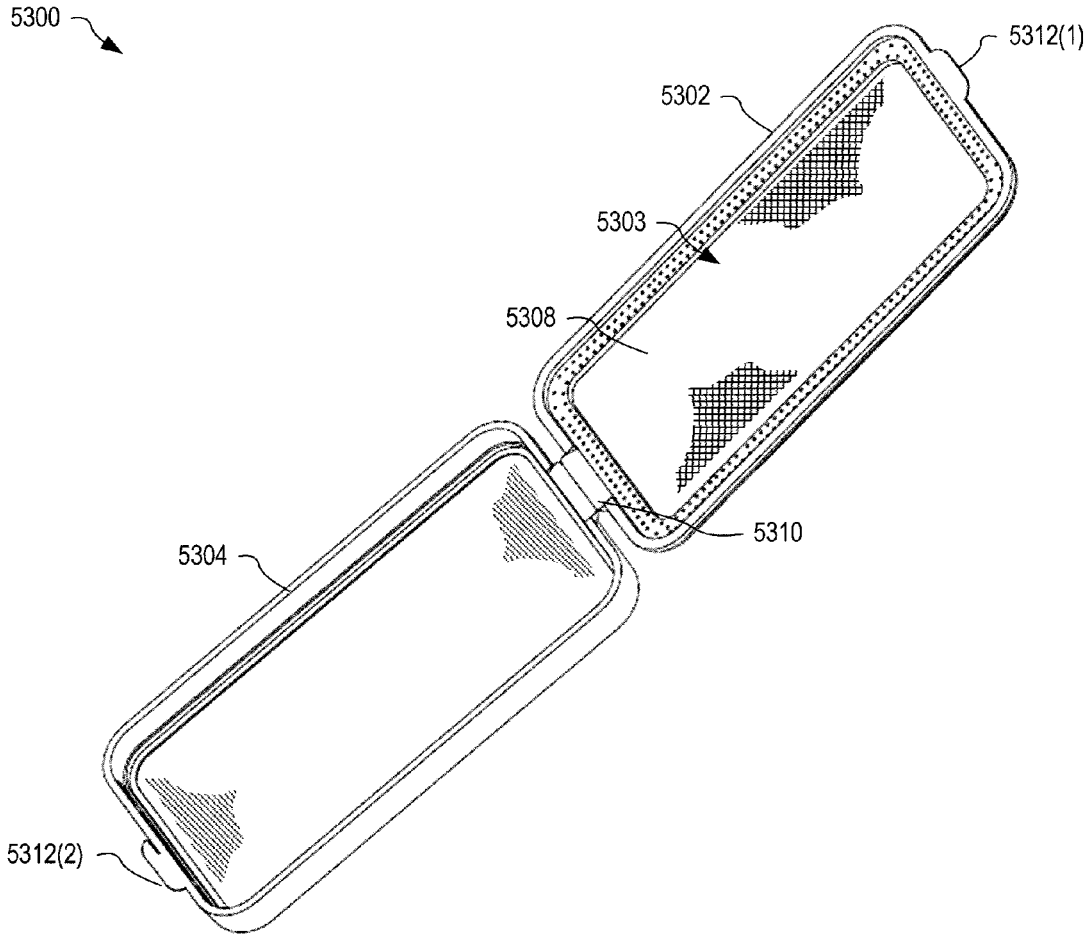
FIGS. 152-153 is a perspective view showing one exemplary storage case formed with a substantially rectangular top and a matching base that are joined along a short side by a living hinge, in an embodiment.

FIGS. 148-151 show one exemplary hinged case 4900 for storing earphones, or other similar sized items, proximate a rear of a DMD. FIG. 148 is a perspective view showing case 4900 closed, FIG. 50 is a perspective view showing case 4900 open with access to a storage area 4914, and FIGS. 151 and 152 show cross sections 5100 and 5200, respectively, at orthogonal planes through case 4900. FIGS. 148-151 are best viewed together with the following description.

Case 4900 has a top 4902 that couples by a hinge 4906 to a base 4904. Case 4900 is similar to case 2400 of FIGS. 90 and 91, but top 4902 is more integrated with base 4904. Top 4902 is formed as a substantially rigid rectangular shell with a cutout (aperture) that is covered by a stretchable material 4908. Base 4904 couples with a DMD to position storage area 4914 proximate the rear of the DMD. A latch mechanism 4910 of top 4902 engages with base 4904 to hold top 4902 closed to base 4904, thereby retaining any item(s) stored within storage area 4914. Hinge 4906 and latch mechanism 4910 are not positioned on a top surface of case 4900, but are positioned substantially central to a thickness of case 4900, as shown in FIG. 150, thereby providing a wrap around design.

When one or more items are placed within storage area 4914 and top 4902 closed and latched, the stored items may deform stretchable material 4908.

Figure 153:
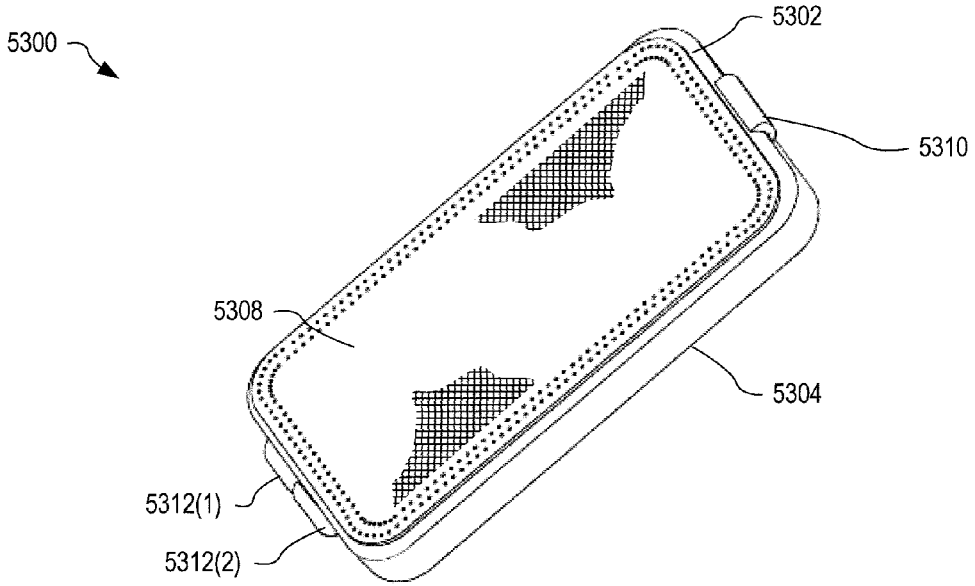

FIGS. 152 and 153 show one exemplary storage case 5300 formed with a substantially rectangular top 5302 and a matching base 5304 that are joined along a short side by a living hinge 5310. FIG. 152 shows case 5300 open, and FIG. 153 shows case 5300 closed. FIGS. 152 and 153 are best viewed together with the following description.

Living hinge 5310 is formed of a flexible plastic that allows top 5302 to fold over and mate with base 5304. Top 5302 has a rigid perimeter with a large aperture 5303 that is filled with a stretchable material 5308. An item enclosed by case 5300 may stretch material 5308 when case 5300 is closed and latched. A first thumb tab 5312(1) is positioned on the short side opposite hinge 5310 of top 5302 and a second thumb tab 5312(2) is positioned on the shorter side opposite hinge 5310 of base 5304 such that case 5300 may be easily opened. Case 5300 provides independent storage of earphones or other similar sized devices. In another embodiment, base 5304 may attach (e.g., using double sided adhesive tape) to a rear surface of a DMD.

Case 5300 may be coupled with another device (e.g., a laptop computer) and used to store a retaining clip (e.g., one of retaining clips 500, 600, 700, 800, 900, 1000, 3500, 3600, and 3700, of FIGS. 5, 6, 7, 8, 9, 10, 35, 36, and 37, respectively) wound with earphones (e.g., one of earphones 300, 320, and 360, of FIGS. 1, 2, and 4, respectively). Case 5300 may also be used independently of any device. When storing an item, material 5308 may be stretched when case 5300 is closed, thereby holding the item in position within the case.

Figure 154:
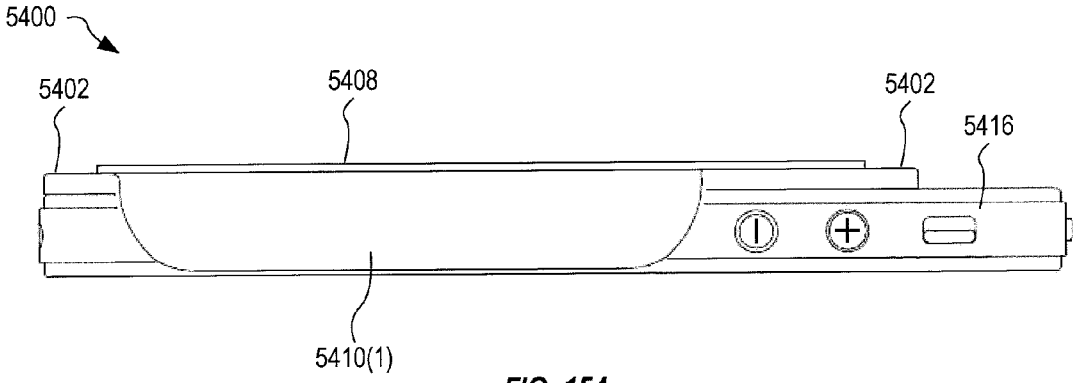
FIG. 154 shows a side elevation of one exemplary slap-on case that is empty and attached to a DMD, in an embodiment.
Figure 155:
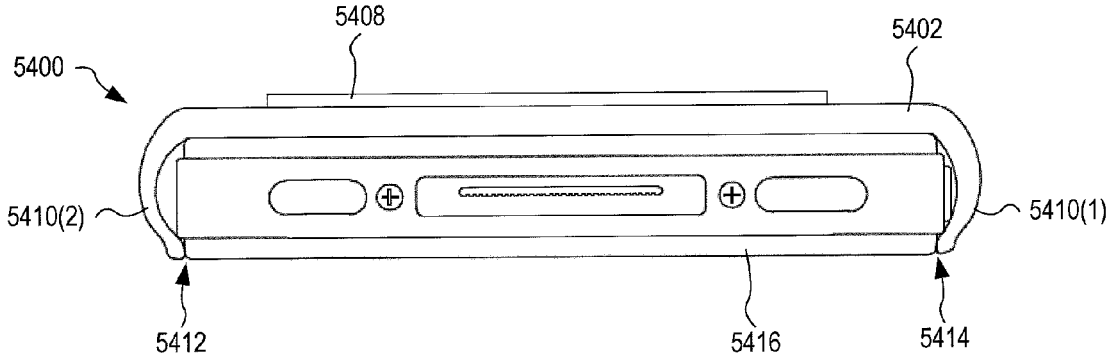
FIG. 155 shows an end elevation of the slap-on case of FIG. 154 attached to the DMD.

FIGS. 154-159 show one exemplary slap-on case 5400 for coupling with a DMD to store one or more items proximate the rear of the DMD. FIG. 154 shows a side elevation of slap-on case 5400 that is empty and is attached to a DMD 5416. FIG. 155 shows an end elevation of slap-on case 5400 attached to DMD 5416.

Figure 156:
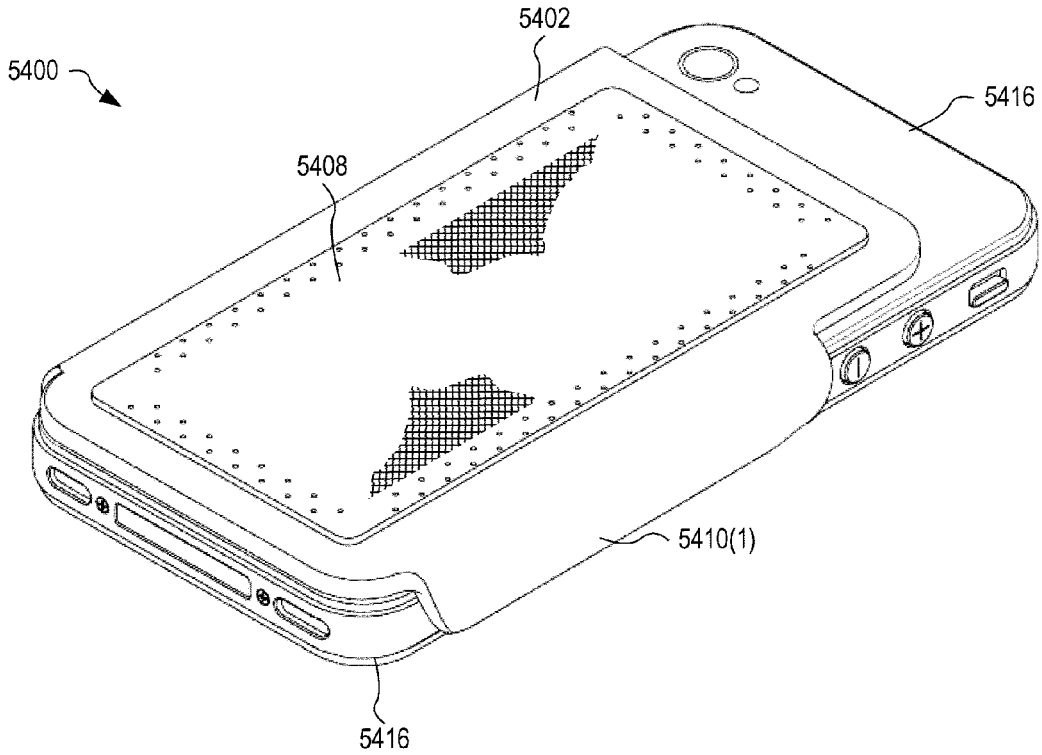
FIGS. 156 and 157 show side and end elevations of the case of FIGS. 154 and 155 wherein an item stored within the case stretches a stretchable material that forms a storage area.
Figure 157:
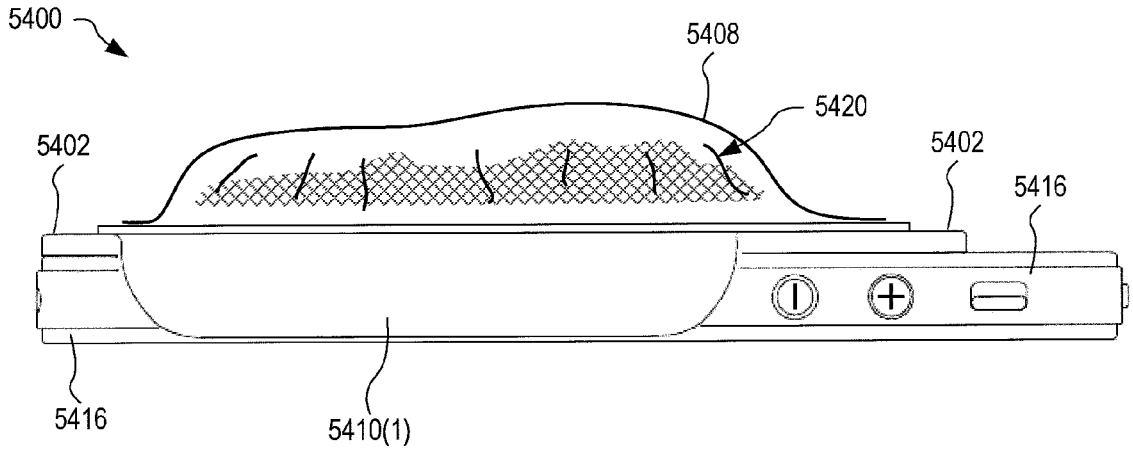
Figure 158:
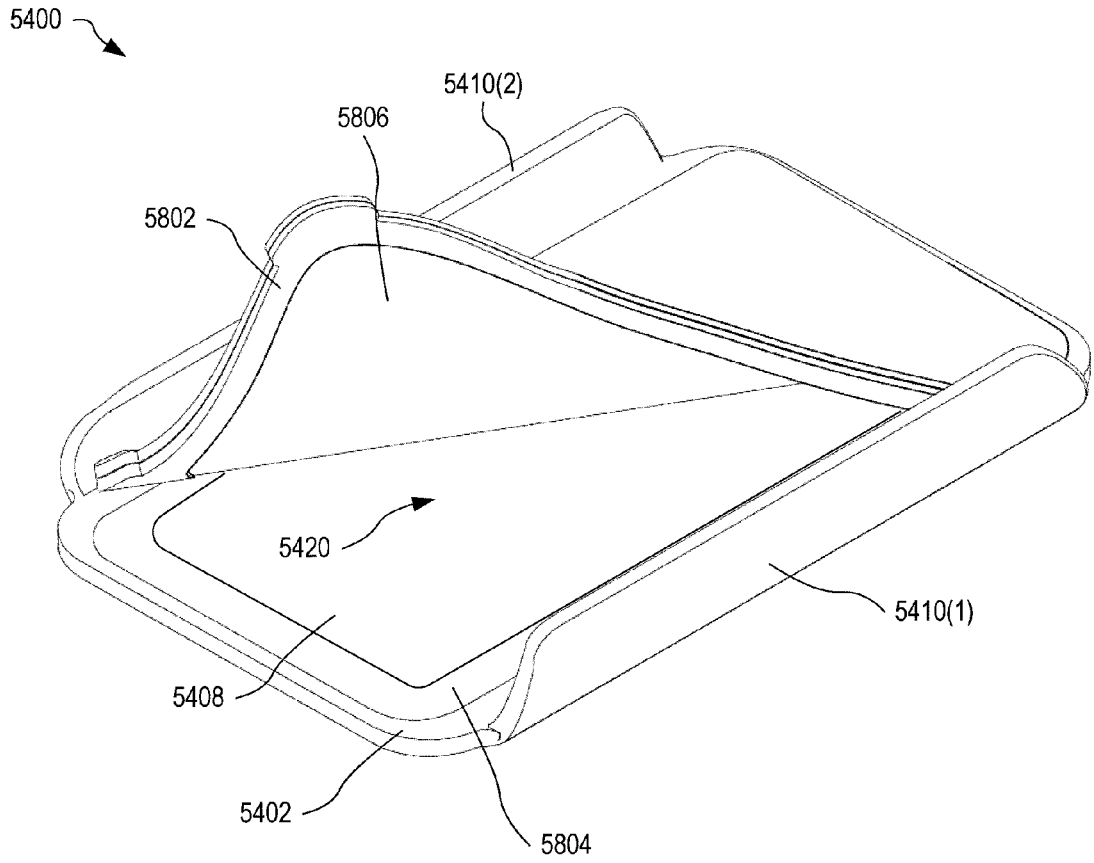
FIG. 158 shows a bottom view of the case of FIGS. 154, 155, 156, and 158, removed from the DMD and illustrating access to the storage area by peeling back a closing material from a fastening area.
Figure 159:
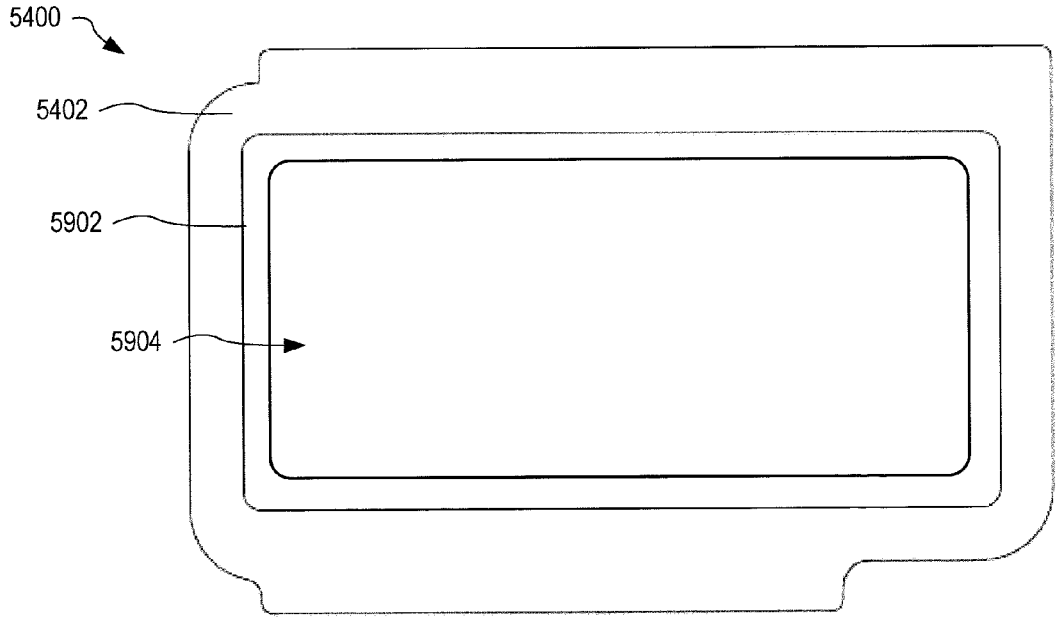
FIG. 159 shows a top view of the case of FIGS. 154, 155, 156, and 158 illustrating a recessed area that allows attachment of closing material and fastening material to the case, for example by stitching and/or adhesive.

FIG. 156 is a perspective view of case 5400 coupled with DMD 5416. FIG. 157 is a side elevation of case 5400 coupled to DMD 5416 and storing an item that deforms material 5408. FIG. 158 shows a bottom view of case 5400 of FIGS. 154, 155, 156, and 158, removed from DMD 5416, and illustrating access to storage area 5420 by peeling back a closing material 5806 from a fastening area 5804. FIG. 159 shows a top view of case 5400 illustrating a recessed area 5902 that allows attachment of stretchable material 5408 to rigid portion 5402 of case 5400, for example by stitching and/or adhesive. FIGS. 154-159 are best viewed together with the following description.

Case 5400 is similar to case 4800 of FIG. 147, and is formed with a substantially rigid portion 5402 that has side latches 5410 that extend down from the each longer side to engage with DMD 5416 at locations 5412 and 5414, and thereby retain case 5400 proximate the rear of DMD 5416. Latches 5410 may also engage a protective case configured with DMD 5416.

As shown in FIG. 158, closing material 5806 may attach to a loop material 5802 that couples with a hook material 5804 attached to rigid portion 5402.

In one embodiment, closing material 5806 is a Velcro™ nap (loop) material and fastening area 5804 has Velcro™ hooks, wherein loop material 5802 is omitted. A portion (e.g., one end) of closing material 5806 may be permanently attached to fastening area 5804 to prevent loss.

As shown in FIG. 159, rigid portion 5402 has a recessed area 5902 that surrounds an aperture 5904. Stretchable material 5408 is attached within recess 5902 and covers aperture 5904.

Figure 160:
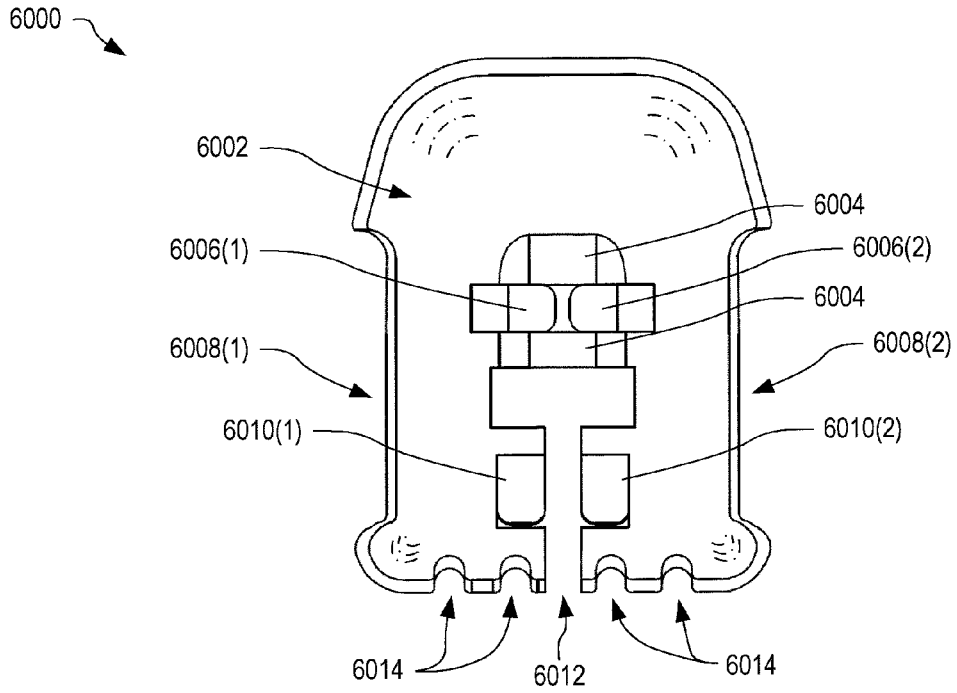
FIGS. 160-162 show one exemplary contoured retaining clip 6000 for storing and protecting an earphone set with ear-bud style earpieces, in an embodiment.
Figure 161:
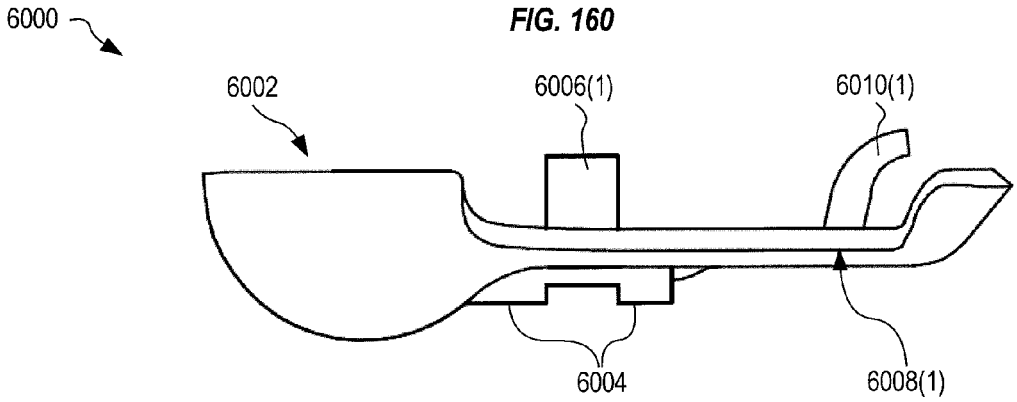
Figure 162:
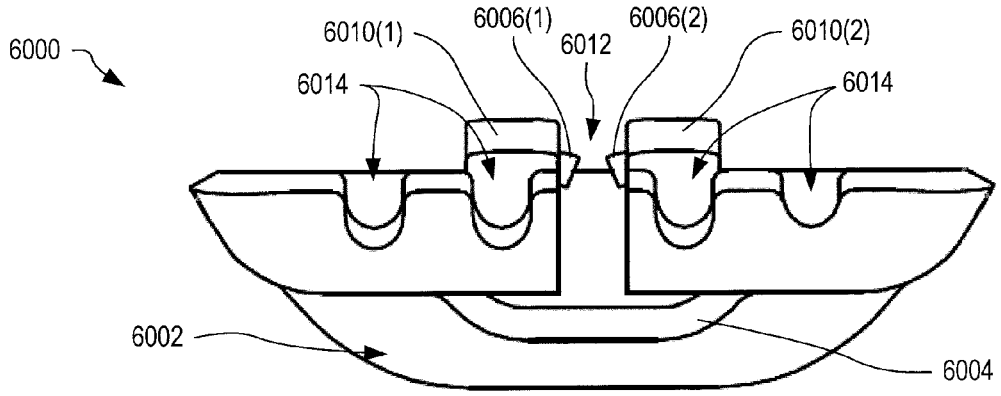

FIGS. 160-162 show one exemplary contoured retaining clip 6000 for storing and protecting an earphone set with ear-bud style earpieces (e.g., earphone set 300, FIG. 1). FIG. 160 is a top view of clip 6000, FIG. 161 is a side view of clip 6000, and FIG. 162 is a front view of clip 6000. FIGS. 160-162 are best viewed together with the following description. Clip 6000 is shown with an earpiece area 6002, a stem recess area 6004, stem retaining lugs 6006(1) and 6006(2), winding notches 6008(1) and 6008(2), jack plug retaining lugs 6010(1) and 6010(2), an alignment notch 6012, and a plurality of additional notches 6014 that may be used to vary a winding length of cable 304 and/or wires 306 around winding notches 6008. Stem retaining lugs 6006 are positioned either side of stem recess area 6004 and apply pressure to stems of the earpieces positioned within earpiece area 6002, thereby securing the earpieces (e.g., earpieces 312) to clip 6000 within earpiece area 6002. The contoured shape of earpiece area 6002 provides additional protection for earpieces 312 from damage. Jack plug retaining lugs 6010 secure a jack plug (e.g., jack plug 302) of the earphone set (e.g., earphone set 300) to retain the earphone set on clip 6000 when cable 304 and wires 306 are wound around winding notches 6008. Although shown with two jack plug retaining lugs 6010, clip 6000 may function with one or more jack plug retaining lugs 6010 that retain jack plug 302 to clip 6000.

Figure 163:
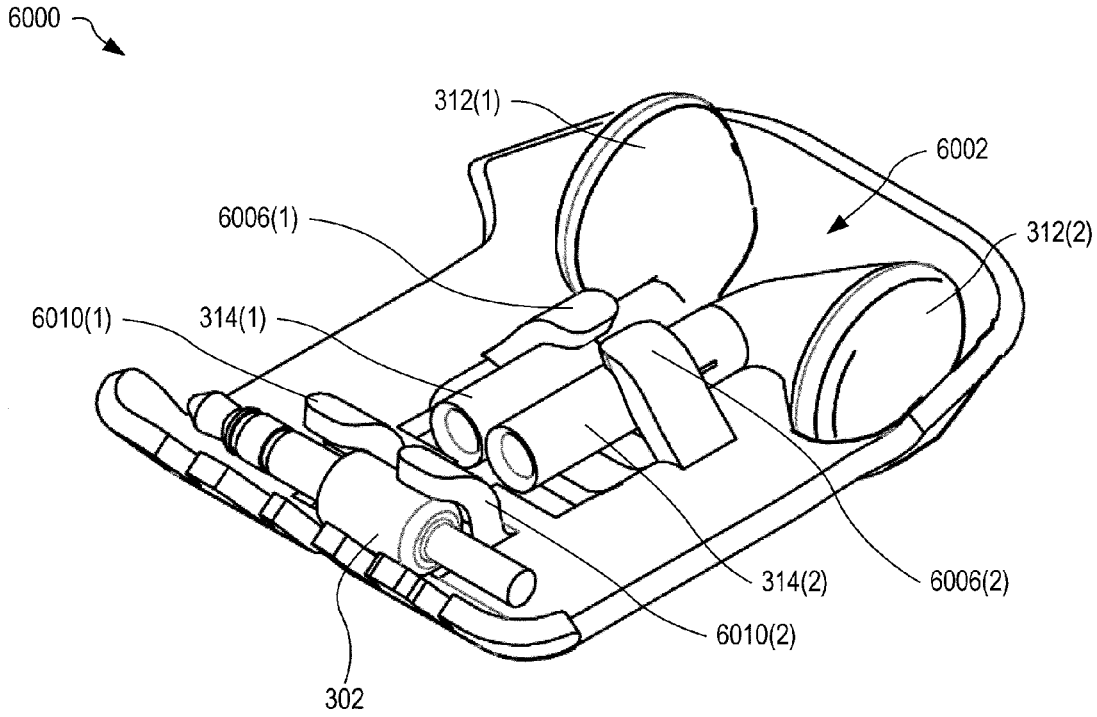
FIGS. 163 and 164 show exemplary winding of the earphone set of FIG. 1 onto the contoured retaining clip of FIGS. 160-162.
Figure 164:
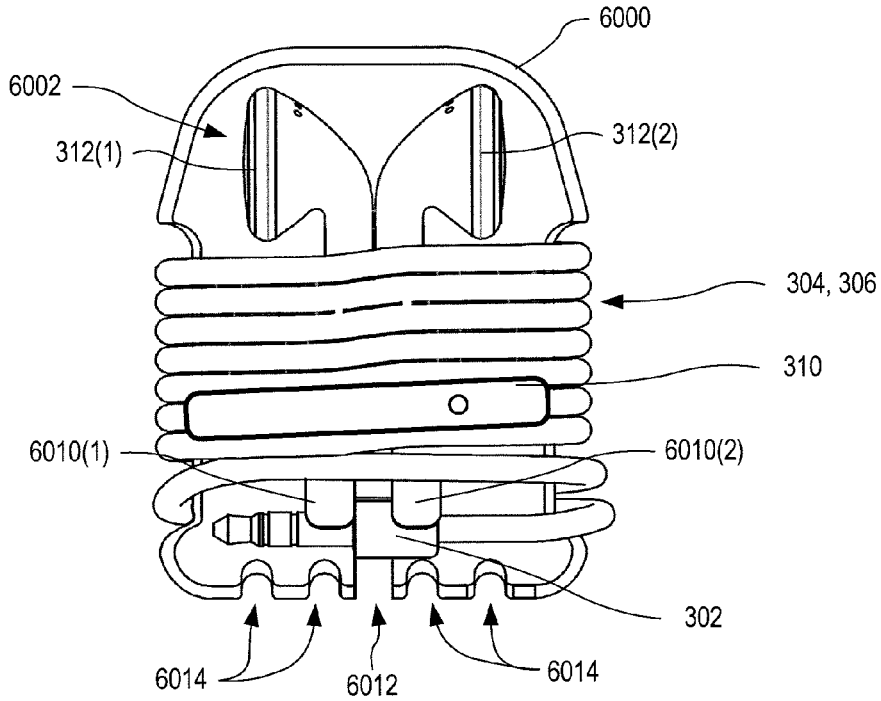

FIGS. 163 and 164 show exemplary winding of earphone set 300 of FIG. 1 into contoured retaining clip 6000 of FIGS. 160-162. FIG. 163 shows earpieces 312 inserted onto earpiece area 6002 of clip 6000, with stems 314 retained in position by stem retaining lugs 6006. Wires 306 pass through alignment notch 6012 that allows stems to be retained by stem training lugs 6006. Wires 206 and cable 304 are then wound around winding notches 6008 such that remote control and microphone 310 lies substantially flat and within a periphery of clip 6000, as shown in FIG. 164. Jack plug 302 is then positioned to be retained by jack phone lugs 6010, thereby preventing cable 304 and wires 306 from unwinding.

Figure 165:
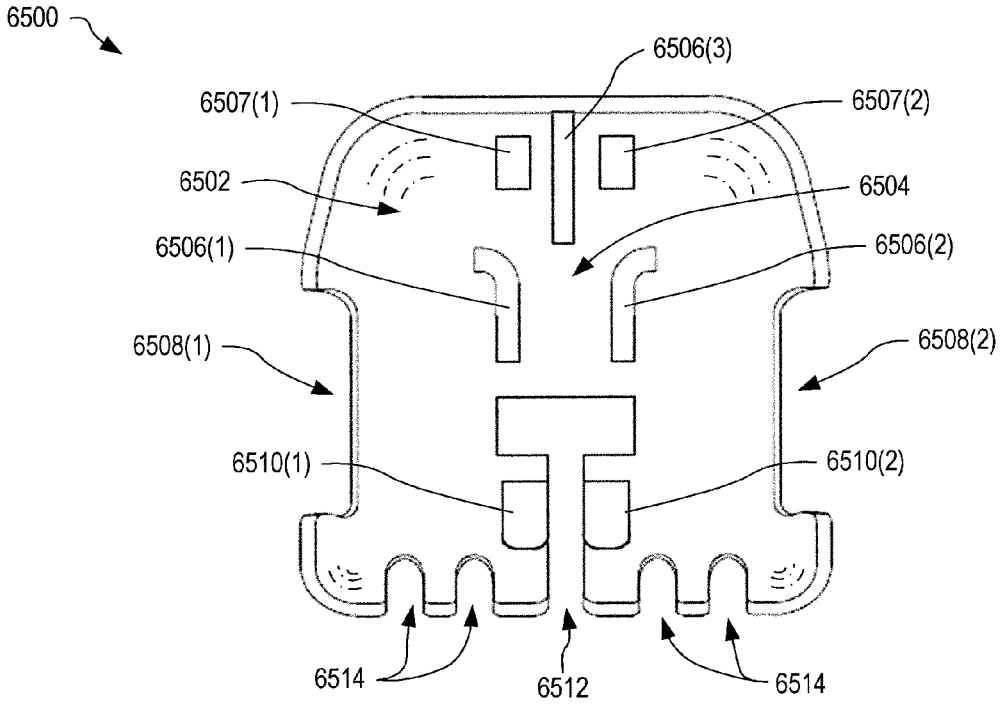
FIGS. 165-168 show one exemplary contoured retaining clip for storing and protecting an earphone set with in-ear style earpieces, in an embodiment.
Figure 166:
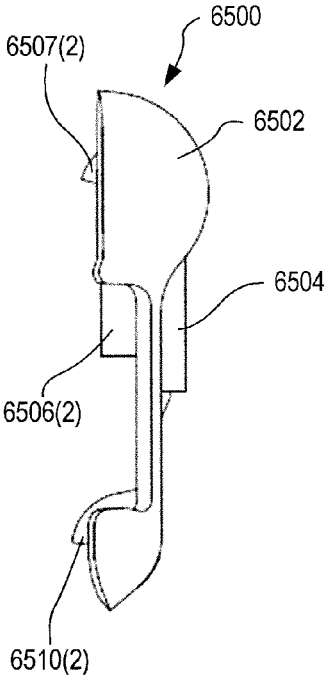
Figure 167:
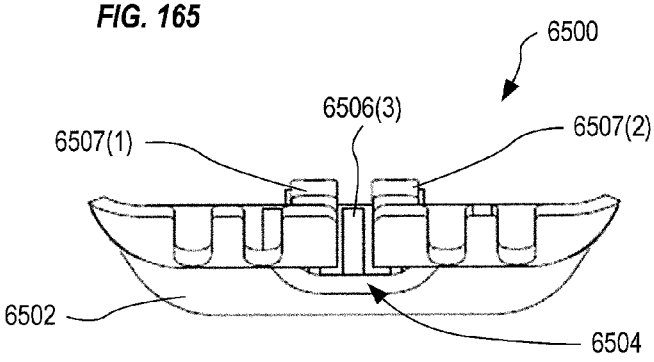
Figure 168:
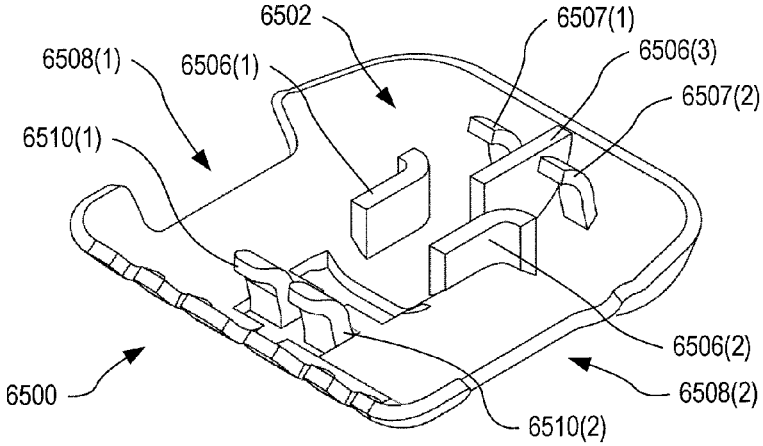

FIGS. 165-168 show one exemplary contoured retaining clip 6500 for storing and protecting an earphone set with in-ear style earpieces (e.g., earphone set 320, FIG. 2). FIG. 165 is a top view of clip 6500, FIG. 166 is a side view of clip 6500, FIG. 167 is a front view of clip 6500, and FIG. 168 is a perspective view of clip 6500. FIGS. 165-168 are best viewed together with the following description.

Clip 6500 is shown with an earpiece area 6502, a stem recess area 6504, earpiece positioning forms 6506(1)-(3), earpiece retaining lugs 6507(1) and 6507(2), winding notches 6508(1) and 6508(2), jack plug retaining lugs 6510(1) and 6510(2), an alignment notch 6512, and a plurality of additional notches 6514 that may be used to vary a winding length of cable 324 and/or wires 326 around winding notches 6508. Earpiece positioning forms 6506(1) and 6506(2) are positioned either side of stem recess area 6004 and earpiece positioning form 6506(3) is positioned between earpiece retaining lugs 6507(1) and 6507(2). Earpiece positioning forms 6506 help position earpieces (e.g., earpieces 332) within earpiece area 6502 such that earpiece retaining lugs 6507 apply pressure to stems (e.g., stems 334) to secure the earpieces within earpiece area 6002. The contoured shape of earpiece area 6502 provides additional protection for earpieces 332 from damage. Jack plug retaining lugs 6510 secure a jack plug (e.g., jack plug 322) of the earphone set (e.g., earphone set 320) to retain the earphone set on clip 6500 when cable 324 and wires 326 are wound around winding notches 6508. Although shown with two jack plug retaining lugs 6510, clip 6500 may function with one or more jack plug retaining lugs 6510 that retain jack plug 322 to clip 6500.

Figure 169:
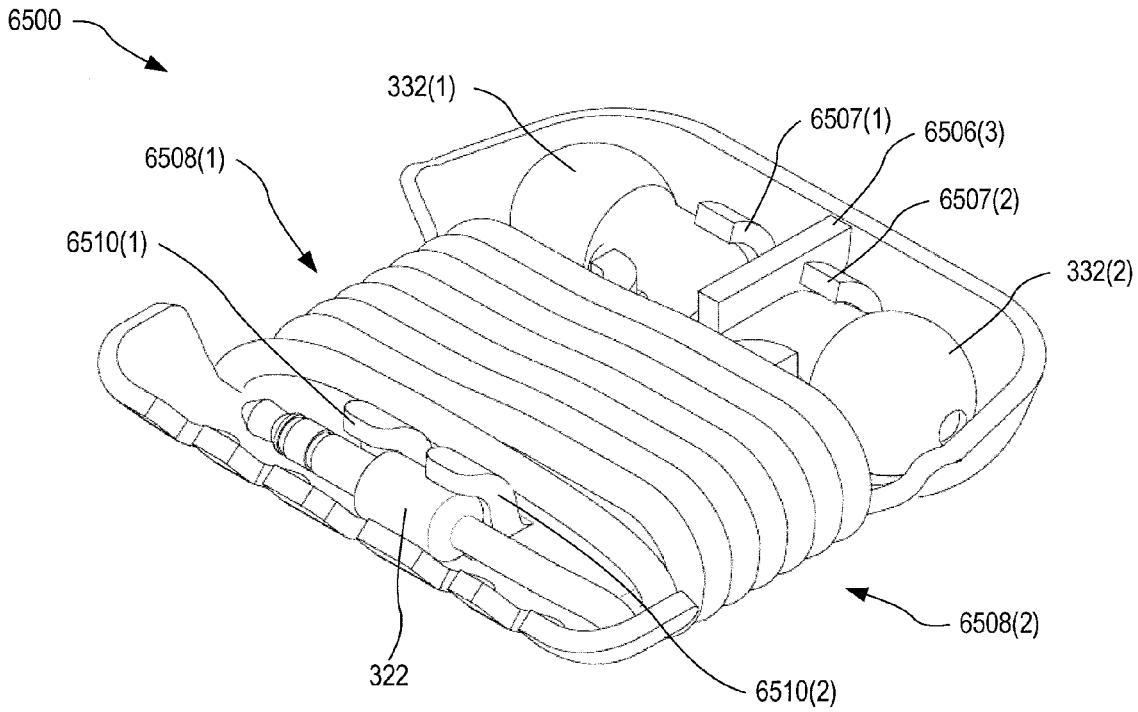
FIG. 169 is a perspective view showing the earphone set of FIG. 2 wound onto the clip of FIGS. 165-168.

FIG. 169 is a perspective view showing earphone set 320 wound onto clip 6500 of FIGS. 165-168, illustrating retention of earpieces 332 and jack plug 322 by earpiece retention lugs 6707 and jack plug retention lugs 6510, respectively.

Figure 170:
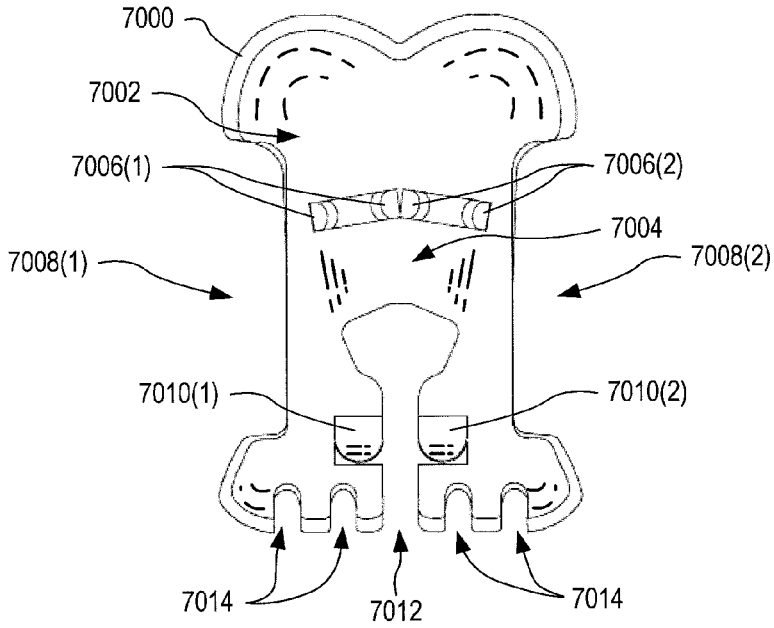
FIGS. 170-173 show one exemplary contoured retaining clip for storing and protecting an earphone set with ear-bud style earpieces.
Figure 171:
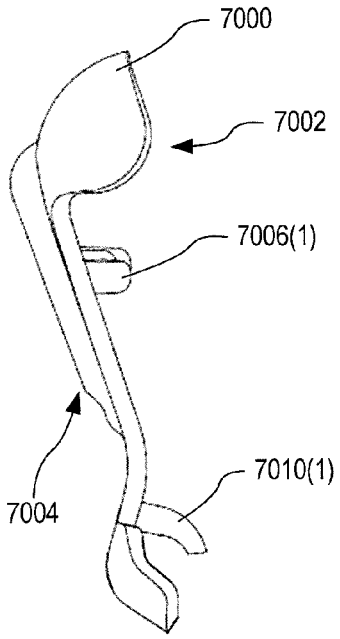
Figure 172:
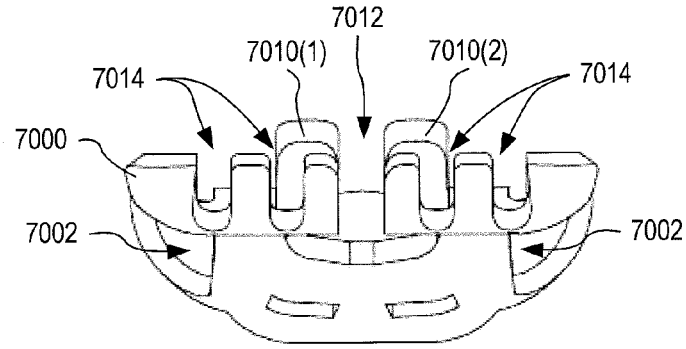
Figure 173:
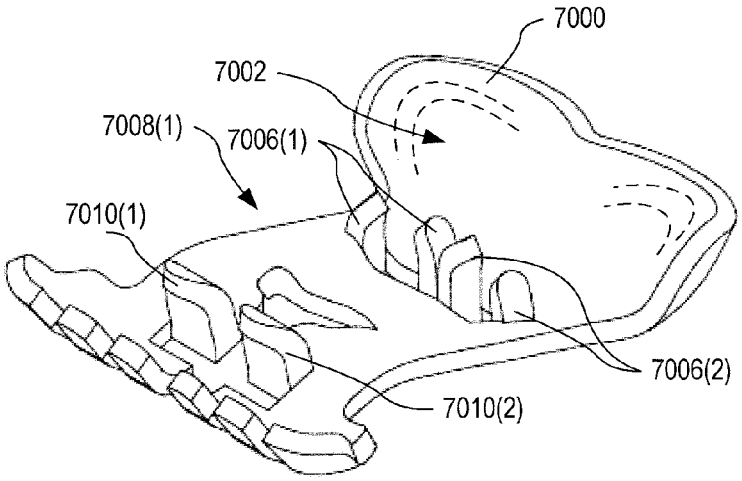

FIGS. 170-173 show one exemplary contoured retaining clip 7000 for storing and protecting an earphone set with ear-bud style earpieces (e.g., earphone set 300, FIG. 1). FIG. 170 is a top view of clip 7000, FIG. 171 is a side view of clip 7000, FIG. 172 is a front view of clip 7000, and FIG. 173 is a perspective view of clip 7000. FIGS. 170-173 are best viewed together with the following description.

Clip 7000 is shown with a contoured earpiece area 7002, a stem recess area 7004, two pairs of stem retention clips 7006(1) and 7006(2), winding notches 7008(1) and 7008(2), jack plug retaining lugs 7010(1) and 7010(2), an alignment notch 7012, and a plurality of additional notches 7014 that may be used to vary a winding length of cable 304 and/or wires 306 around winding notches 7008. Stem retention clips 7006(1) are positioned to receive and retain a stem of a first earpiece (e.g., stem 314(1) of earpiece 312(1)) and stem retention clips 7006(2) are positioned to receive and retain a stem of a second earpiece (e.g., stem 314(2) of earpiece 312(2)) when the earpieces are positioned within contoured earpiece area 7002. The contoured shape of contoured earpiece area 7002 provides additional protection for earpieces 312 from damage. Jack plug retaining lugs 7010 secure a jack plug (e.g., jack plug 302) of the earphone set (e.g., earphone set 300) to retain the earphone set on clip 7000 when cable 304 and wires 306 are wound around winding notches 7008. Although shown with two jack plug retaining lugs 7010, clip 7000 may function with one or more jack plug retaining lugs 7010 to retain jack plug 302 to clip 7000.

Figure 174:
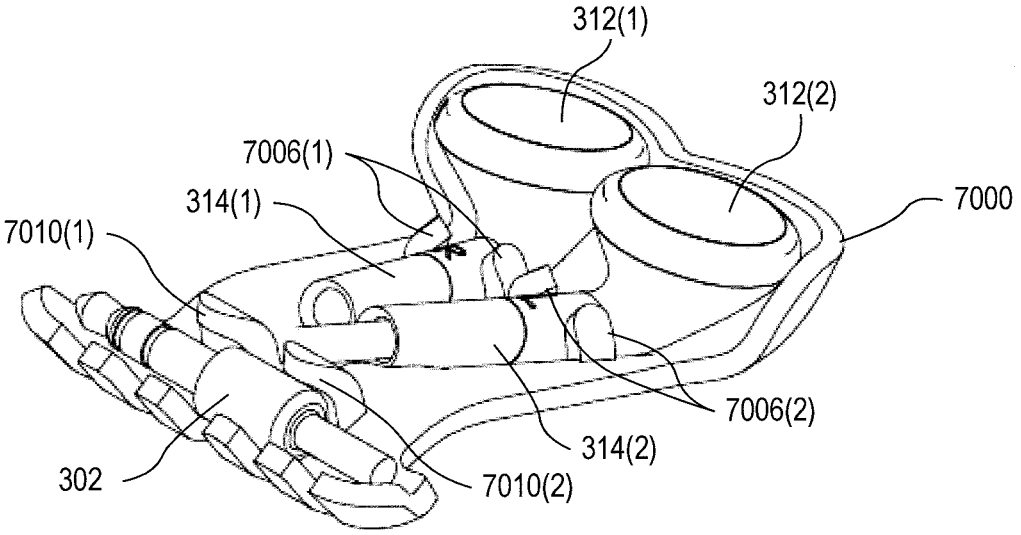
FIG. 174 is a perspective view of the contoured earphone retaining clip of FIGS. 170-173 illustrating retention of the earpieces and the jack plug of the earphone set of FIG. 1.
Figure 175:
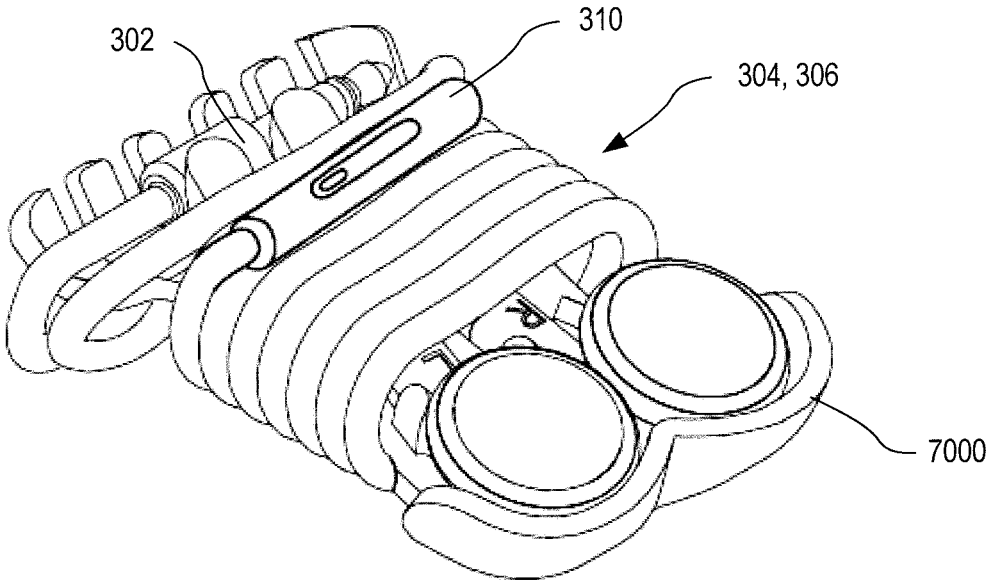
FIG. 175 is a perspective view of the clip of FIGS. 170-173 showing the cable and wires of the earphone set of FIG. 1 wound around the winding notches of the clip.

FIG. 174 is a perspective view of contoured earphone retaining clip 7000 of FIGS. 170-173 illustrating retention of earpieces 312 and jack plug 302 by stem retention clips 7006 and jack plug retention lugs 7010, respectively. Cable 304 and wires 306 are not shown in FIG. 174 for clarity of illustration. FIG. 175 is a perspective view of clip 7000 showing cable 304 and wires 306 of earphone set 300 wound around winding notches 7008 of clip 7000.

Changes may be made in the above methods and systems without departing from the scope hereof. For example, features of earphone retaining clips 500, 600, 700, 800, 900, 1000, 1100, 1200, 2900, 3500, 3600, and 3700 of FIGS. 5, 6, 7, 8, 9, 10, 11, 12, 29, 35, 36, and 37, respectively, may be interchanges as appropriate for particular earphone styles, without departing from the scope hereof. Similarly, features of storage cases 1400, 1500, 1600, 2000, 2100, 2200, 2300, 2400, 2500, 2600, 2700, 3200, 3800, 3900, 4000, 4500, 4700, 4800, 4900, and 5300, of FIGS. 14, 15, 16, 20, 21, 22, 23, 24, 25, 26, 27, 32, 38, 39, 40, 45, 47, 48, 49, and 153, respectively, may be interchanged as appropriate for storing particular earphone styles and for coupling with particular DMDs, without departing from the scope hereof. Each retaining clip embodiment may also benefit from the use of a stretchable pouch, as shown in FIGS. 54 through 57, that wrap around the clip. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

The invention claimed is:

1. A case for storing an earphone set proximate a digital media device (DMD), comprising:

a first portion that is sized and shaped to couple with the DMD;

a substantially rigid second portion that couples with the first portion and forms a storage area for containing the earphone set; and, a retaining clip for capturing the earphone set, the retaining clip having a flat portion for receiving one or more earpieces of the earphone set, and a first and second raised portion with a valley therebetween, each of the first and second raised portion having a cutout that together form a winding area, the valley having first cutouts, second cutouts, and an earphone stem support portion.

2. The case of claim 1, wherein the retaining clip includes a hinge point for removably securing the clip within the storage area.

3. The case of claim 1, wherein the retaining clip is shaped to compactly capture the earphone set when wound thereon.

4. The case of claim 1, wherein the retaining clip is configured to hold the earphone set such that cables of the earphone set are wrappable about the retaining clip.

5. The case of claim 1, the second portion comprising a door for providing external access to the storage area.

6. The case of claim 5, wherein the door is hinged from the second portion.

7. The case of claim 1, wherein the second portion comprises a top portion and a base portion that couple together, and wherein the base portion removably couples with the first portion.

8. The case of claim 7, where the base portion slides into grooves formed in the first portion.

9. The case of claim 1, the first portion including a receptacle, and the second portion including a hook such that, when the receptacle is coupled with the hook, the hook remains under tension and within the receptacle.

10. The case of claim 9, wherein the hook includes a plurality of hooks and the receptacle includes a plurality of receptacles each positioned to receive one or more of the plurality of hooks.

11. The case of claim 9, the hook having a ball or disk and a neck portion, and the receptacle including a slot having a first end sized to allow the ball or disk to pass therethrough and a second end smaller than the ball or disk but greater or equal in size to a diameter of the neck.

12. The case of claim 1, each of the first and second portion including a different one of a retention post and a retention slot such that the first portion couples with the second portion using the retention post and retention slot.

13. The case of claim 1, the second portion including finger grips that allow a user to grip the second portion when coupled with the first portion or when not coupled with the first portion.

14. The case of claim 1, the first portion including a plurality of slots sized and shaped such that the second portion slides into the slots to couple to the first portion.

15. The case of claim 14, the first portion including a lid component and a base component, wherein the lid component and base component are secured together when the first portion is coupled to the second portion within the slots.

16. The case of claim 14, the first portion including a lid component including a plurality of first keyed features, and a base component including a plurality of second keyed features that mate with the plurality of first keyed features.

17. The case of claim 14, the first portion including a lid component and a base component, one of the lid and base components including a hinge for attaching to an earphone retaining clip.

18. The case of claim 14, the first portion including a lid component having a plurality of finger grips and a base component, the lid component and base component coupled together by a hinge.

19. The case of claim 18, the base component including a second hinge capable of mating with an earphone retaining clip.

20. The case of claim 1, the earphone retaining clip further having one or more of one or more notches for changing a winding length of a cable of the earphone set, and holes for securing a jack plug of the earphone set.

21. The case of claim 1, the second portion having a hole sized and shaped to receive a cable and a jack plug of the earphone set, a retractable mechanism that automatically winds the cable such that the earphone set is compactly stored within the storage area when not in use.

* * * * *

UNITED STATES PATENT AND TRADEMARK OFFICE

CERTIFICATE OF CORRECTION

PATENT NO. : 8,787,610 B2
APPLICATION NO. : 13/336918
DATED : July 22, 2014
INVENTOR(S) : Dean Stevinson It is certified that error appears in the above-identified patent and that said Letters Patent is hereby corrected as shown below:

In the Specification,

Column 5, Line 6, "FIGS. 152-153 is" should read --FIGS. 152-153 are--.
Column 6, Line 25, "include" should read --includes--.
Column 8, Line 50, "wrapped the earphone" should read --the wrapped earphone--.
Column 9, Line 50, "positions" should read --position--.
Column 10, Line 11, "302 pass" should read --302 to pass--.
Column 13, Lines 21 and 22, "materials or materials" should read --material or materials"--.
Column 14, Line 47, "remains" should read --remain--.
Column 15, Line 37, "are" should read --is--.
Column 16, Line 44, "are" should read --is--.
Column 16, Line 63, "shows" should read --show--.
Column 17, Line 22, "built-in to" should read --built into--.
Column 18, Line 18, "facilitate" should read --facilitates--.
Column 18, Line 33, "shapes" should read --shaped--.
Column 21, Line 2, "couples" should read --coupled--.
Column 26, Line 4, "4708 is forms" should read --4708 forms--.
Column 26, Line 33, "configured attach" should read --configured to attach--.
Column 27, Line 54, "from the each" should read --from each--.
Column 29, Line 50, "interchanges" should read --interchanged--.

Signed and Sealed this
Third Day of March, 2015

Michelle K. Lee

Michelle K. Lee
*Deputy Director of the United States Patent and Trademark Office*